US006497564B2

(12) United States Patent
Klassen

(10) Patent No.: US 6,497,564 B2
(45) Date of Patent: Dec. 24, 2002

(54) BALANCED ROTORS POSITIVE DISPLACEMENT ENGINE AND PUMP METHOD AND APPARATUS

(76) Inventor: James B. Klassen, 1903 Front St., Lynden, WA (US) 98264

( * ) Notice: Subject to any disclaimer, the term of this patent is extended or adjusted under 35 U.S.C. 154(b) by 0 days.

(21) Appl. No.: 09/757,126

(22) Filed: Jan. 8, 2001

(65) Prior Publication Data

US 2001/0031215 A1 Oct. 18, 2001

Related U.S. Application Data

(60) Provisional application No. 60/174,890, filed on Jan. 7, 2000, provisional application No. 60/178,492, filed on Jan. 27, 2000, provisional application No. 60/195,952, filed on Apr. 10, 2000, and provisional application No. 60/218,228, filed on Jul. 14, 2000.

(51) Int. Cl.[7] ..... F01C 3/08; F04C 3/08

(52) U.S. Cl. ..... 418/195; 418/186

(58) Field of Search ..... 418/183, 186, 418/195

(56) References Cited

U.S. PATENT DOCUMENTS

| | | | | | |
|---|---|---|---|---|---|
| 32,372 | A | | 5/1861 | Jones | 418/195 |
| 351,129 | A | | 10/1886 | Salomo | 418/195 |
| 914,155 | A | | 3/1909 | Mills et al. | 418/212 |
| 991,576 | A | * | 5/1911 | White, Jr. | 418/186 |
| 2,101,051 | A | | 12/1937 | Cuny | 418/195 |
| 2,101,428 | A | | 12/1937 | Cuny | 418/195 |
| 2,242,058 | A | | 5/1941 | Cuny | 418/195 |
| 2,431,817 | A | * | 12/1947 | Mann | 418/195 |
| 3,101,700 | A | * | 8/1963 | Bowdish | 418/195 |
| 3,106,912 | A | | 10/1963 | Kahlert | 418/195 |
| 3,156,222 | A | | 11/1964 | Miller, Jr. | 418/68 |
| 3,236,186 | A | | 2/1966 | Wildhaber | 418/195 |
| 3,272,130 | A | | 9/1966 | Mosbacher | 418/9 |
| 3,816,038 | A | | 6/1974 | Berry | 418/68 |
| 3,816,039 | A | | 6/1974 | Berry | 418/68 |
| 3,856,440 | A | | 12/1974 | Wildhaber | 418/195 |
| 5,755,196 | A | | 5/1998 | Klassen | 418/195 |
| 6,036,463 | A | | 3/2000 | Klassen | 418/195 |

FOREIGN PATENT DOCUMENTS

| | | | |
|---|---|---|---|
| CA | 2069607 | 11/1993 | |
| DE | 1551081 | 4/1970 | |
| DE | 2639760 | 3/1978 | |
| DE | 3221994 | * 12/1983 | 418/195 |
| FR | 916277 | 8/1946 | |
| GB | 5686 | 11/1902 | |
| GB | 805370 | 12/1958 | |
| GB | 1099085 | 1/1968 | |
| IT | 268459 | 1/1933 | |
| JP | 55-72683 | 5/1980 | |

OTHER PUBLICATIONS

Excerpt from a book titled Rotary Piston Machines by Felix Wankel, Classification of design principles for engines, pumps and compressors, 16 pages, 1965.

Granco Positive Displacement Rotary Pump product brochure, 6 pages, with attached article, Principles of operation and performance characteristics of Rotary Ball Pumps by Michael L. George, Challenge Manufacturing Co. Inc. Oakland, CA 4 pages, Plant Engineering Dec. 10, 1981.

* cited by examiner

*Primary Examiner*—John J. Vrablik
(74) *Attorney, Agent, or Firm*—Mike Hughes

(57) ABSTRACT

A machine to convert energy providing positive displacement of a fluid contained in operating chambers. The machine can either increase the pressure of a fluid or extract energy from a pressure differential to a rotating shaft. The machine having desirable balance features about various axis of the rotors. The machine additionally having desirable axial flow characteristics to pass fluids substantially in the axial direction.

22 Claims, 39 Drawing Sheets

20
30
10a
14a
12a
24
12b
14b
22
80
10b

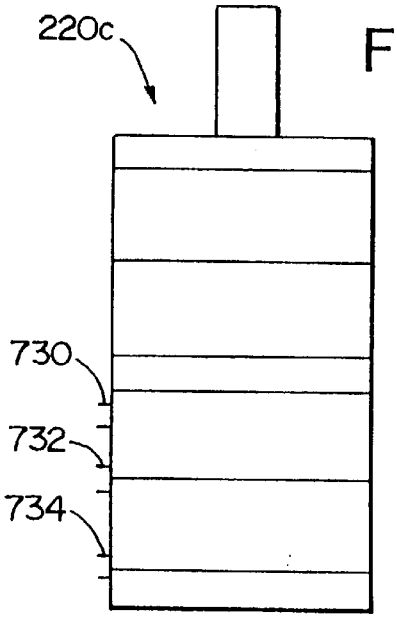
FIG. 48
FIG. 49
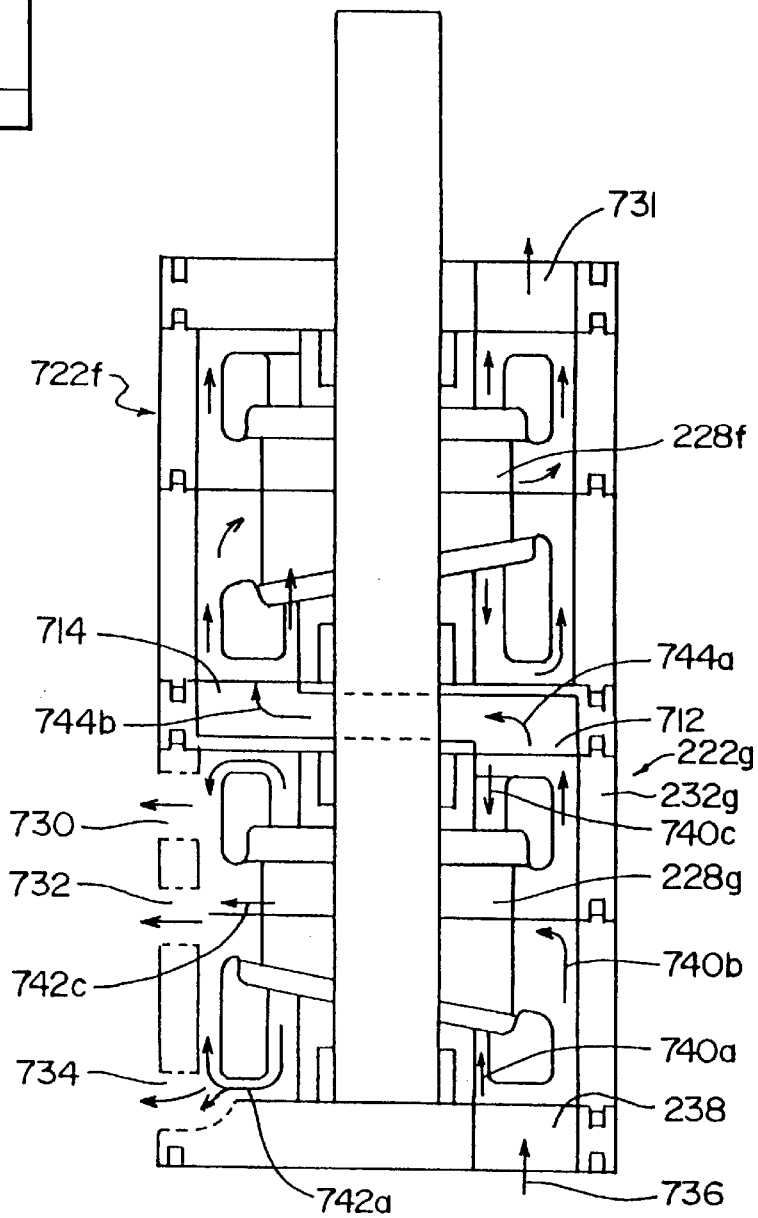

BALANCED ROTORS POSITIVE DISPLACEMENT ENGINE AND PUMP METHOD AND APPARATUS

RELATED APPLICATIONS

This application claims priority of U.S. Provisional Applications Ser. No. 60/174,890 filed Jan. 7, 2000, Ser. No. 60/178,492 filed Jan. 27, 2000, Ser. No. 60/195,952 filed Apr. 10, 2000, and Ser No. 60/218,228 which was filed Jul. 14, 2000.

FIELD OF THE INVENTION

The invention relates to positive displacement machines that convert energy, namely positive displacement pumps that have continuous rotation to displace fluid contained in operating chambers. The present invention is particularly advantageous for providing balance about the various axes of the apparatus.

BACKGROUND

One of the limitations of certain types of fluid pumps is the inconsistent rotational force on the rotors caused by the force of the fluid pressure acting on the rotors as they rotate. In a gear pump, for example, the non-meshing portion of each of the gears is exposed to a consistent fluid pressure at the discharge port, but in the area where the gear teeth mesh together, each tooth on each rotor seals a tooth on the opposing rotor from the pressure of the fluid on the output side of the pump. This creates a rotationally imbalanced situation where each rotor alternates between balanced (with equal surface area exposed to the high pressure fluid on both "sides" of their center axis) and imbalance (with one "side exposed to the high pressure fluid, and one "side" sealed from this high pressure fluid by a tooth on the opposing rotor). The term "side" refers to one half of the total surface area exposed to the high pressure fluid of the outlet port of a pump, compressor, hydraulic motor, actuator, or other related device.

The problems which result from this hydraulic rotational imbalance are mostly related to an inconsistent rotational contact force between the moving parts. As the parts rotate, the fluid force will act on each of the rotors to cause it to rotate forward or backward relative to the rotation of the other rotor. The "stiffness" of the fluid film between the rotors, the inertia of the rotors themselves, and the viscosity of the fluid, are all factors which determine at what pressure and at what speed a particular pump can operate without breaking through the fluid film and causing rotor to rotor contact.

Rotor to rotor contact can be tolerated to a certain extent depending on materials and other factors, but the intermittent contact that is caused by this hydraulic rotational imbalance can cause damage or wear to the contacting parts at certain pressures and speeds and can cause damage to sensitive fluids (e.g. blood).

The higher the fluid viscosity, the "stiffer" the fluid film, and the higher the pressure an "imbalanced pump" can tolerate without contact occurring. Speed also increases the fluid film rigidity but speed also has the detrimental effect of increasing the "impact" or "shock" characteristic of the hydraulic rotational imbalance as the pump gears (or rotors) switch back and forth from balanced to imbalanced. For certain pump configurations, it has been found that the beneficial fluid film "stiffness" effects of speed is very closely counteracted by the detrimental effects of speed due to the increased "impact" force.

To the best knowledge of the applicant, gear pumps, for example, are not used in many high pressure, low fluid viscosity applications due to the hydraulic rotational imbalance.

In the case of a pump such as the single face Outland™ CvR™ pump, the effect of any hydraulic rotational imbalance is even greater due to the high volume output and corresponding high surface area which the high pressure fluid acts on.

The most significant characteristic of apparatus of the present invention is the rotational hydraulic balancing of the slave rotor. By allowing fluid to flow past the power rotor tips at "bottom dead center" (BDC) but not past the slave rotor tips at BDC. The surface area of the slave rotor which is exposed to the high pressure is within approximately 5%–10% at "top dead center" (TDC) as it is at BDC at all times. This is compared to a 100% difference between top and bottom surface areas on a pump such as the Outland™ CvR™ pump as disclosed in U.S. Pat. No. 5,755,196.

The rotational hydraulic imbalance is known to cause rotor to rotor contact between the Outland™ CvR™ rotors at approximately 500 psi with DTE Oil Light. The hydraulic rotational imbalance of the present invention is approximately 2–5% of the hydraulic rotational imbalance of the Outland™ CvR™ pump. This means that the pressure which could cause rotor to rotor contact with this new pump design (with DTE Oil Light) would be greater than 20,000 psi. With thicker fluids this pressure would have to be even greater.

In addition, the remaining imbalance does not occur as the rotors enter and leave the ports, but results from the movement of the contact point around the tip of the slave rotor. This reduces the "impact" characteristic still further and should allow higher fluid pressures and lower fluid viscosity without contact between the rotors.

This hydraulic rotational imbalance has been accomplished by "unsealing" the tip of the power rotor at BDC and creating a prolonged seal between the tips of the slave rotor at BDC. This maintains a much more equal surface area between the slave rotor lobes at TDC and BDC at all times, thereby hydraulically balancing the rotors rotationally at all times. The power rotor, with this new pump design, has a consistent torquing force applied thereto as a result of the fluid pressure acting upon the radially extending surface where the full surface area of each lobe is exposed to the high pressure fluid at the outlet port at TDC but not at BDC. This pressure distribution scheme is necessary for output work to be carried out by the pump (or compressor or hydraulic motor or actuator or other related device). The important characteristic of this pump is that the slave rotor "floats" rotationally and can therefor be positioned rotationally by the fluid film of low "stiffness" between it and the power rotor. Furthermore, if a fluid film does not exist due to operation conditions (drawing a vacuum, for example) the force between the rotors is low enough to be within the allowable "PV" value of many available materials. When an incompressible fluid is not present to establish a fluid film, it is likely that either the pressure is low enough to not create the imbalanced shock (i.e. drawing a vacuum). If there is high-pressure while a compressible fluid is present which may not establish the fluid film the presence of a compressible fluid would act as a shock absorber thereby reducing the impact effect.

Creating this hydraulic rotationally balanced characteristic has been accomplished in this new pump design by allowing fluid to flow past the power rotor tips at BDC. This is done by removing material from the slave rotor where it used to seal against the power rotor tip. A seal is maintained between the rotors in this phase of rotation by adding material to the power rotor to allow it to seal against the slave rotor tip as each slave rotor tip enters the sealed zone at BDC. This seal is maintained between each slave rotor Up and the power rotor until each slave rotor tip passes from the output port to the input port at BDC.

Further, the slave rotor can also be used as the drive rotor if a consistent contact force between the rotors is desirable. This might be the case with a single direction pump.

SUMMARY OF THE INVENTION

The invention comprises a machine that converts energy such as a pump to increase the pressure of a fluid, or a motor, turbine, or actuator taking a pressure differential in a fluid to create rotary motion about a shaft. The invention comprises a housing that has an inner surface. A first rotor is mounted for rotation in the housing about a first axis and has a first outer surface that is adapted to intimately engaged the inner surface of the housing. There is further a second rotor having a forward portion and a rearward portion and is mounted for rotation and the housing about a second axis that is offset from the first axis and being collinear by an angle a and intersects at a common center of the rotors. The second rotor has a second inner surface that defines at least part of a sphere having a common center with the center of the first rotor. There is a second outer surface that is adapted to engage the inner surface of the housing. The first rotor further has a first contact face that is defined by a locus formed by points on the second rotor as the second rotor rotates about the second axis and the first rotor further has a first contact surface positioned in the forward region of the first rotor.

The second rotor further has a second contact face that is defined by a locus formed by points on the first rotor as the first rotor rotates about the first axis. The second rotor further has a rearward surface that is positioned in the rearward portion of the second rotor. The points of each rotor that define the locus along an outer edge of a common central axis is essentially a radius extending outward from the common centers of the rotor at an angle $\alpha/2$ from the normal to the axis of the other rotor.

The first contact surface of the first rotor does not come in contact with the rearward surface of the second rotor allowing fluid to pass therein between.

BRIEF DESCRIPTION OF THE DRAWINGS

FIG. 48 is an outside view of the casing showing various possibilities of exit ports to allow radially exiting flow from the apparatus;

FIG. 49 is a sectional view with the cap from either FIG. 46 or FIG. 47 connecting the two rotor sections and illustrating the possibility of radial ports;

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 4:
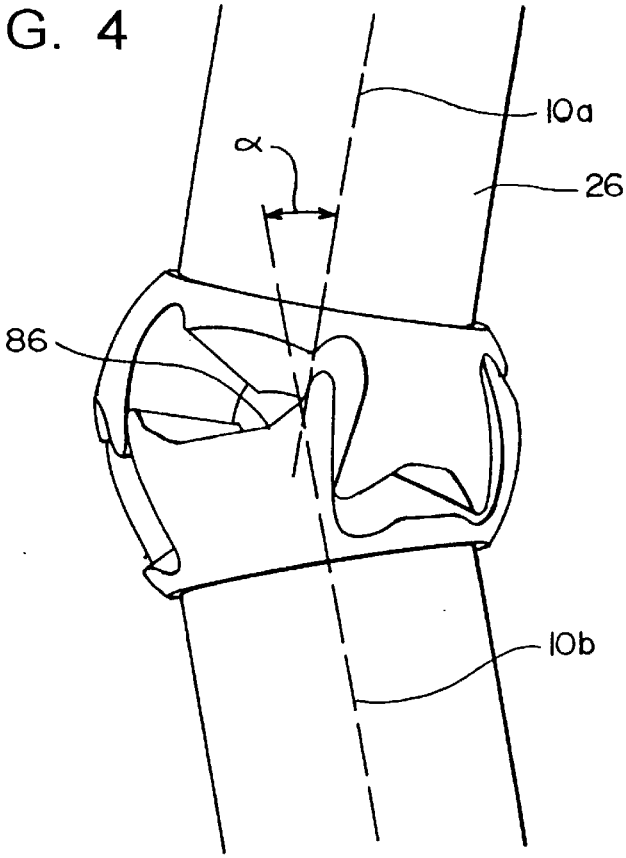
FIG. 4 is a side view of the rotor assembly showing the axis of each rotor.

To ease explanation, two axis systems are defined, one for a first rotor and a second axis for a second rotor where the angle between the axis is defined as α (see FIG. 4). The axis 10*a* is referred to as the longitudinal or axial power axis and is defined as the center of rotation of shaft 30 for the power rotor 26. Likewise, the axis 10*b* is referred to as the longitudinal or axial slave axis and is defined as the center of rotation for shaft 80 of the slave rotor 28. The axis indicated at 12*a* is referred to as the power radially lateral axis and axis 12*b* is referred to as the slave radially lateral axis. Further, the arrow 14*a* is the power radially transverse axis pointing in a forward direction and the arrow 14*b* is a slave radially transverse axis indicating a forward direction.

Figure 1:
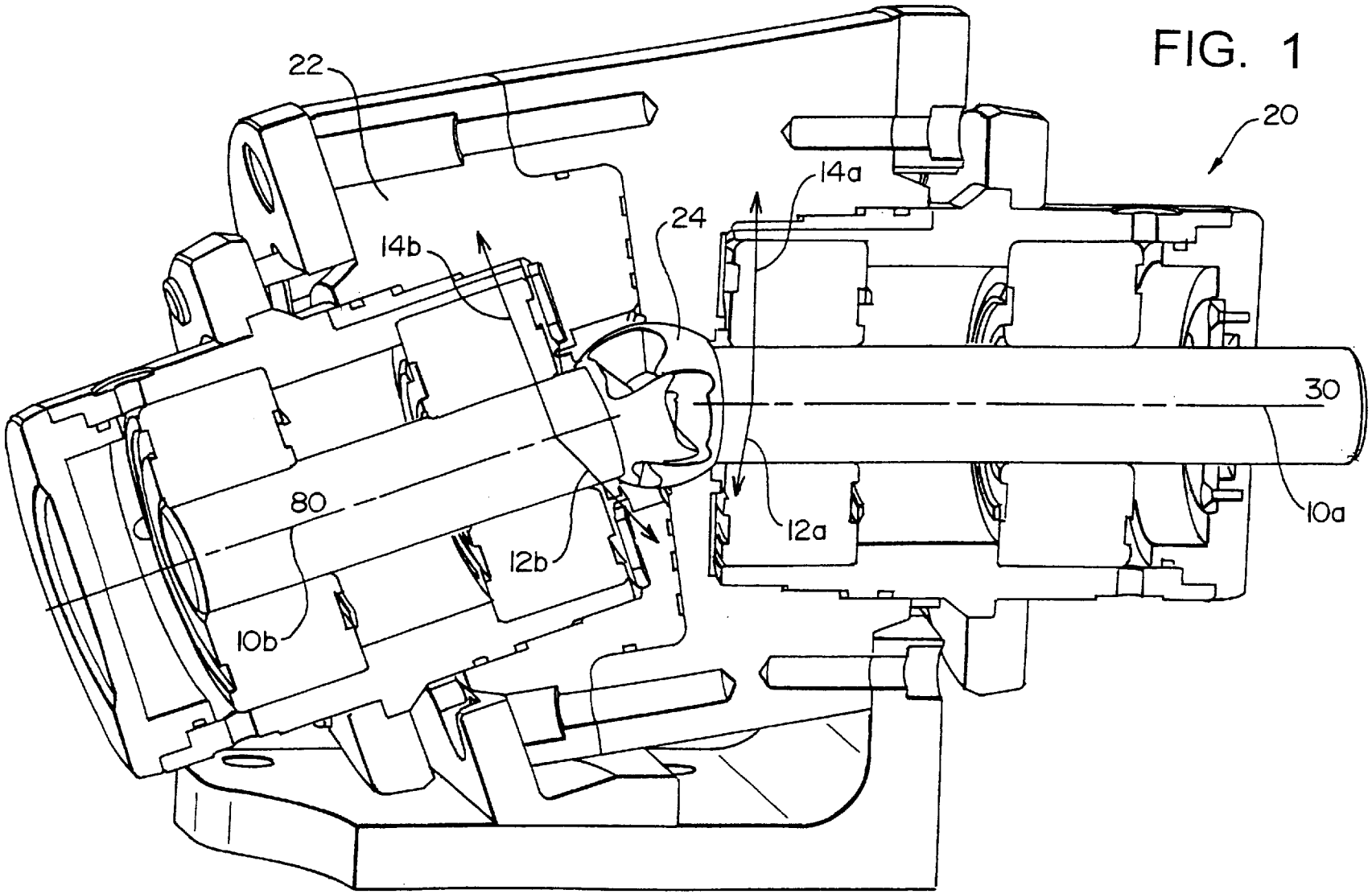
FIG. 1 is an isometric view of the apparatus and also showing an axis system used to define portions of the slave and power rotors.

The engine (machine to convert energy, including a pump, external combustion engine, motor, turbine, compressor, etc.) as 20 shown in FIG. 1 comprises a housing 22, a bearing 23, and a rotor assembly 24.

Figure 2:
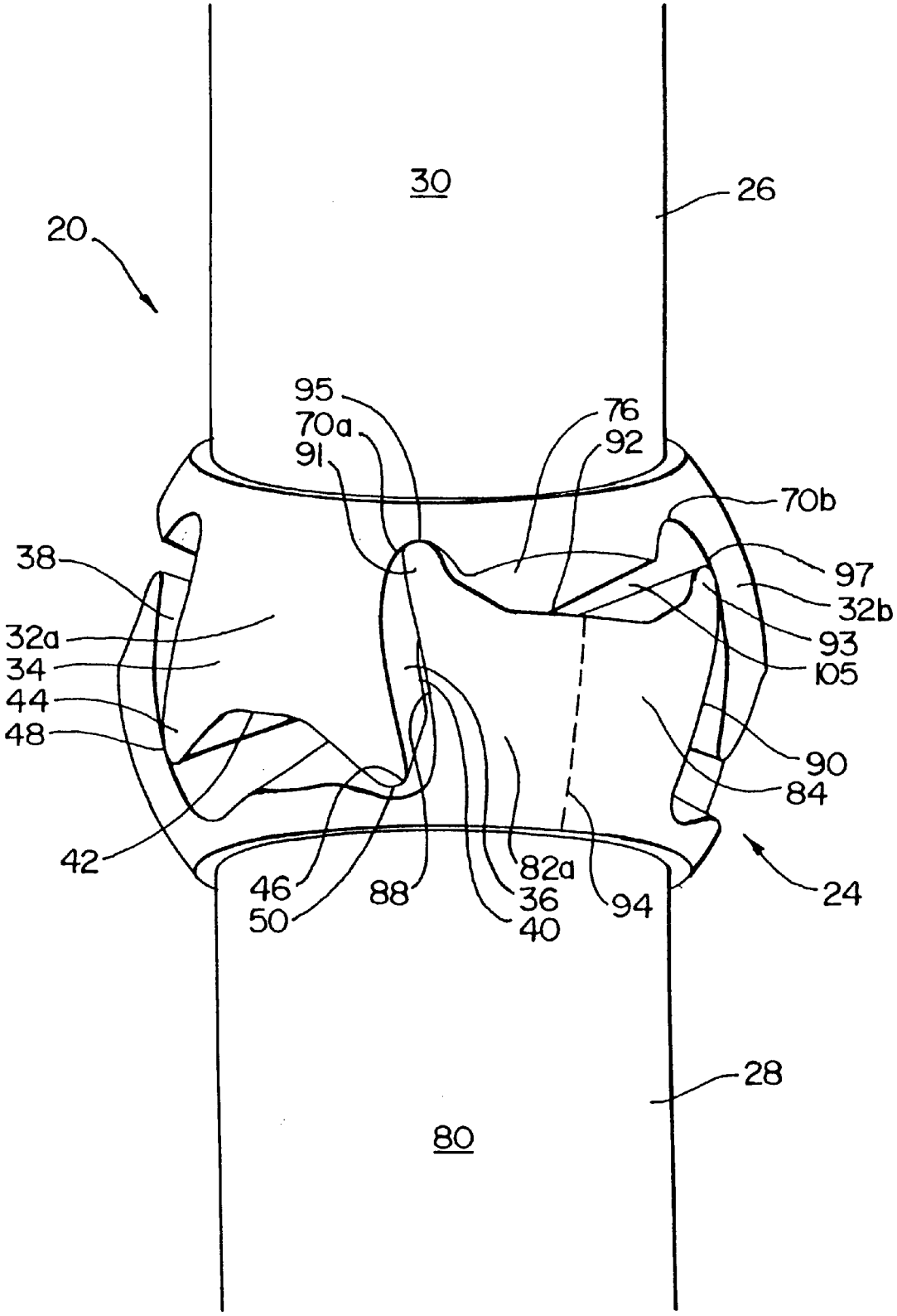
FIG. 2 is a front view of the rotor assembly at the bottom dead center position.
Figure 3A:
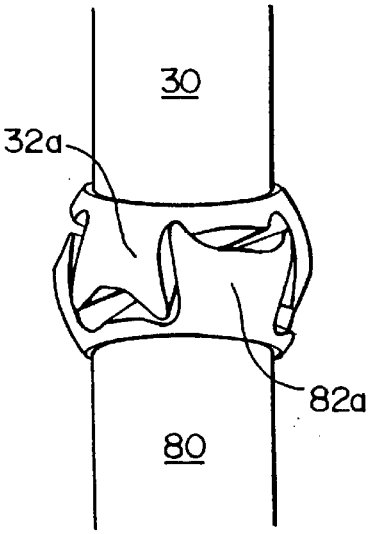
FIGS. 3A–3S show a number of views of the rotor assembly in one position but taken from isometric perspectives at approximately twenty degree increments.
Figure 3B:
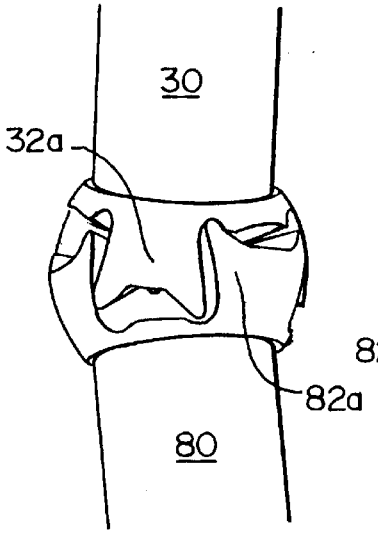
Figure 3C:
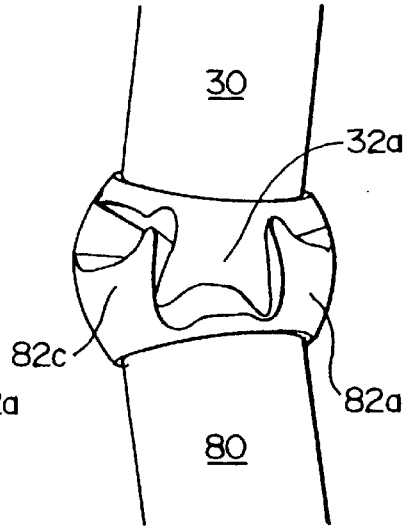
Figure 3D:
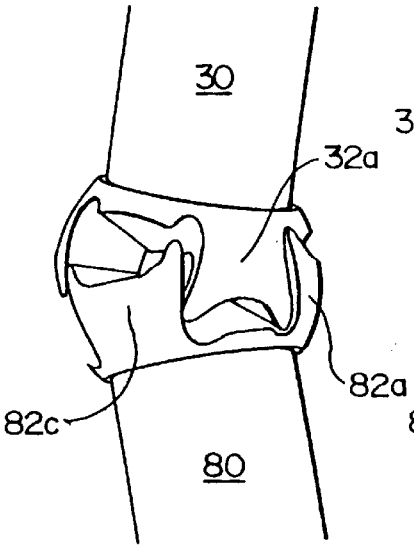
Figure 3E:
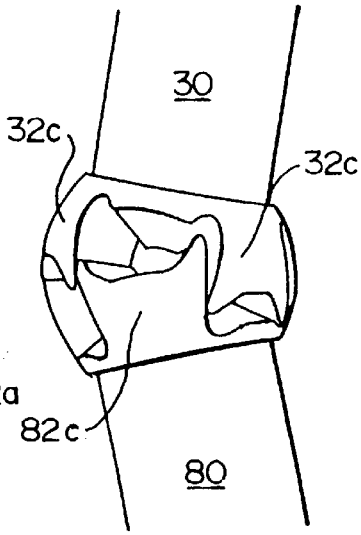
Figure 3F:
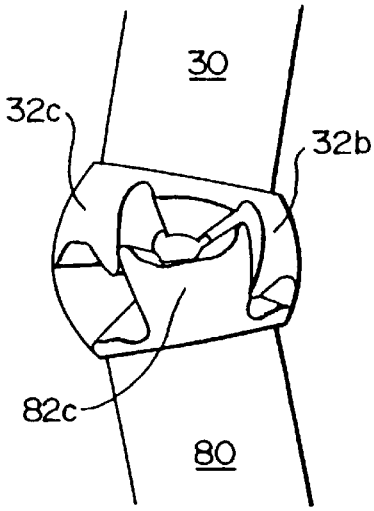
Figure 3G:
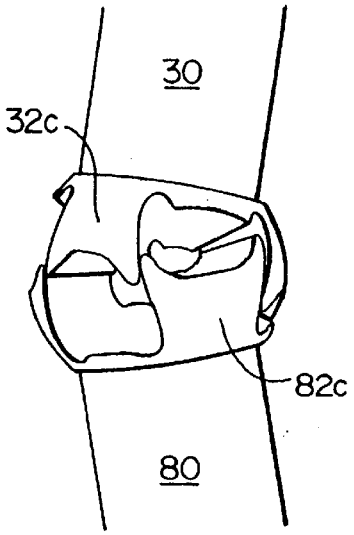
Figure 3H:
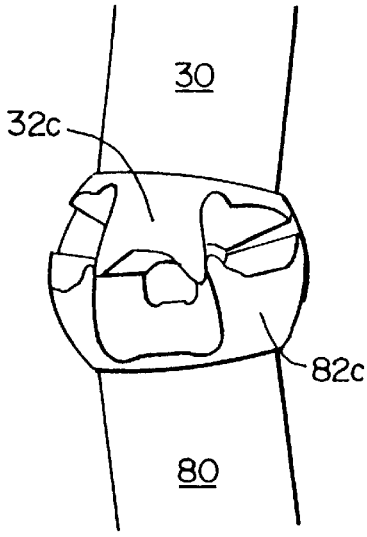
Figure 3I:
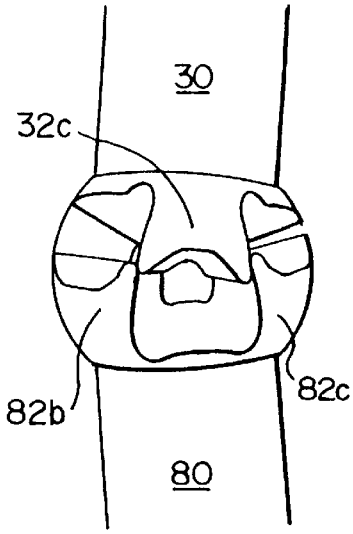
Figure 3J:
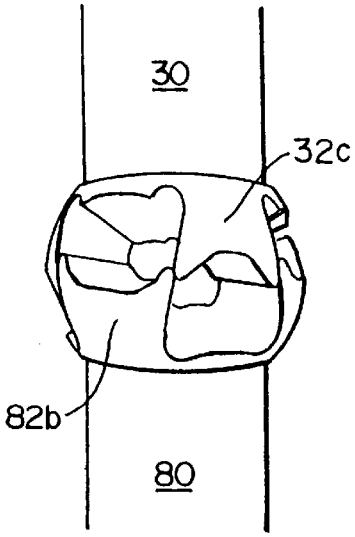
Figure 3K:
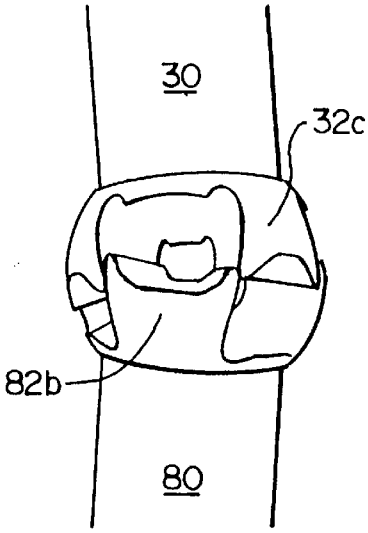
Figure 3L:
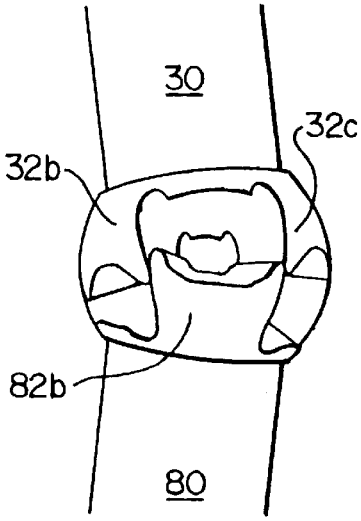
Figure 3M:
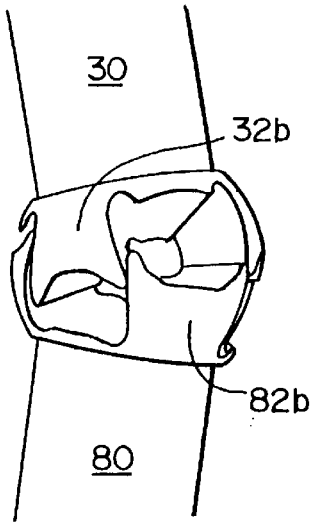
Figure 3N:
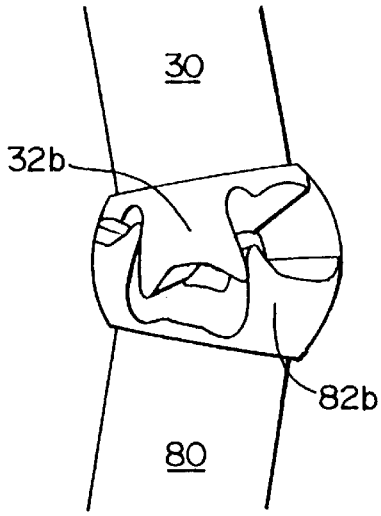
Figure 3O:
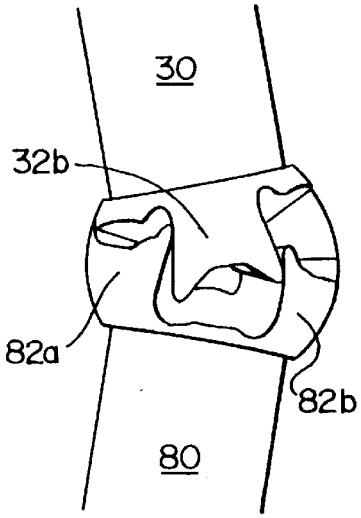
Figure 3P:
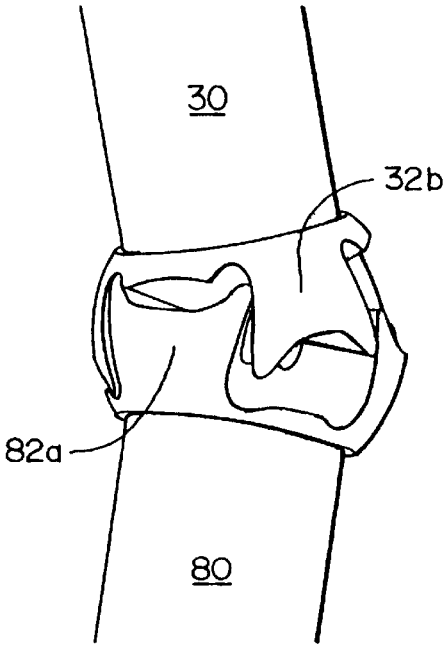
Figure 3Q:
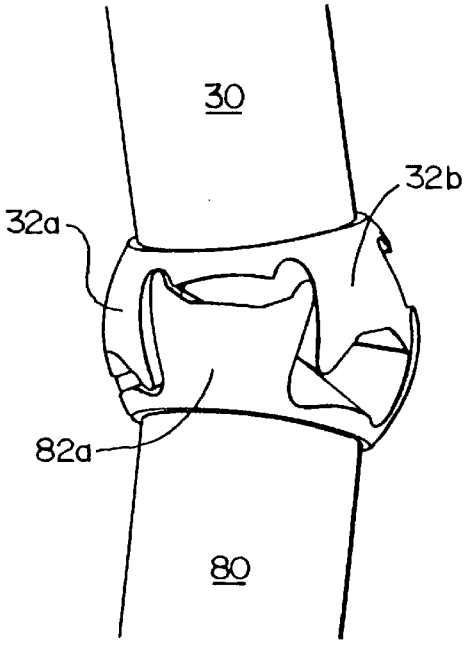
Figure 3R:
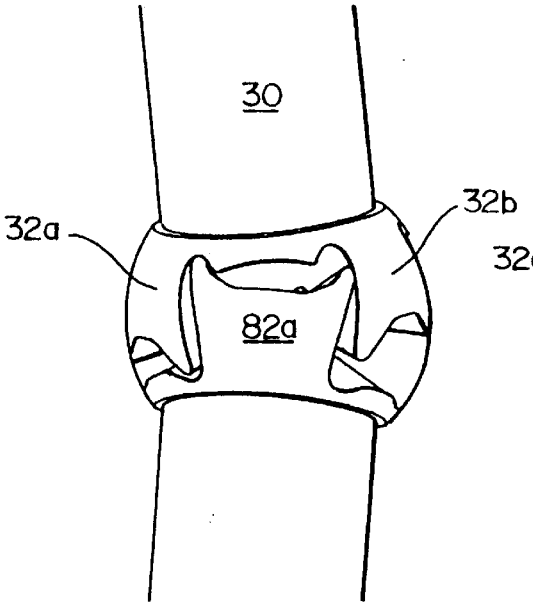
Figure 3S:
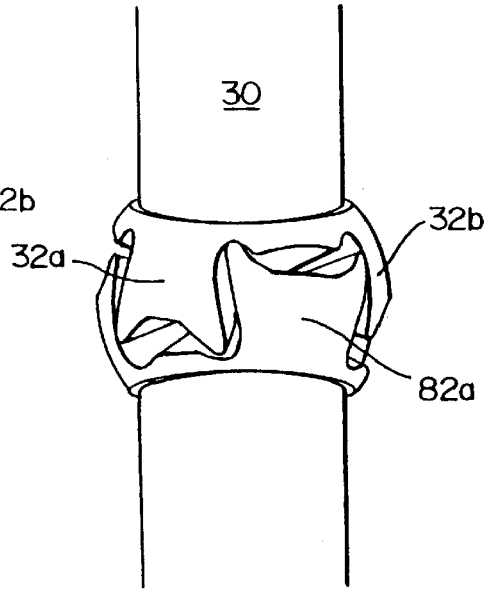

As seen in FIG. 2, the rotor assembly 24 comprises a master rotor 26 and a slave rotor 28. The master rotor comprises a shaft 30 and a plurality of lobes 32. For ease of discussion, the lobe 32*a* will be described in detail with the understanding the specification applies to all of the lobes on the power rotor. Likewise, additional lobes could be employed without departing from the basic geometries that create sealed chambers and balanced radial forces (further discussed herein).

The lobes 32 have a radial outer surface 34, a first surface 36, a second surface 38, a spherical inner surface 40, and a forward surface 42. The lobes 32 further have tips 44 and 46 that define cones extending at common angle between α that are used to define the faces of the rotor assembly. These tips each have a contact surface 48 and 50. The surfaces 36, 38, 48 and 50 are described further herein.

The surface 34 defines at least part of a sphere and is adapted to engage the inner surface of the housing 22. The spherical inner surface 40 also defines a portion of a sphere and is intimately engaged or is a unitary piece with a center bearing 23.

The surfaces 36 and 38 (as well as the forward portions of surfaces 88 and 90) are described thoroughly in U.S. Pat. Nos. 6,036,463 and 5,755,196 and further in the pending U.S. patent application Ser. No. 09/318,572 which are incorporated by reference. However, the important features of the surfaces are discussed herein.

Figure 5:
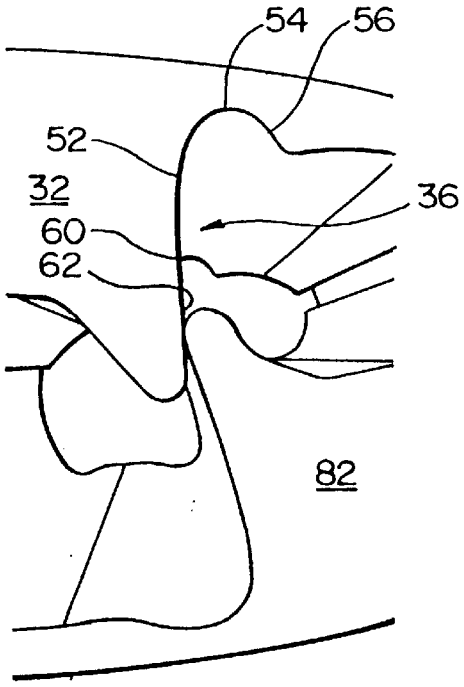
FIG. 5 shows in detail the contact surface of the master rotor.

In general, the surfaces 36 and 38 comprise a concave and convex continuous surface with a precisely placed inflection point. As seen in FIG. 5, at the base portion of the lobe 32, the first surface 36 extends rearwardly to a first concave portion 52 then to a rearward portion 54 and the continuous surface continues forwardly to surface 56. The aforementioned concave surfaces 52, 54 and 56 are defined as the base surface 58.

Best seen in FIG. 5, the base surface 58 extends forwardly to an inflection point 60. At the inflection point 60, the first surface 36 transforms from a concave to a convex surface. Therefore surface 62 is a convex surface that is also adapted to receive the tip 91 of the slave lobe 82.

Figure 6:
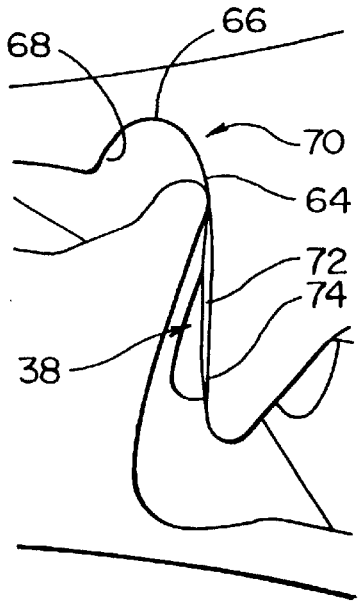
FIG. 6 is another view of one of the contact surfaces of the master rotor.

Consistent with the foregoing, FIG. 6 shows the second surface 38 extends rearwardly to a first concave portion 64 then to a rearward portion 66 and the continuous surface continues forwardly to surface 68. The aforementioned concave surfaces 64, 66 and 68 are defined as the base surface 70. Best seen in FIG. 6, the base surface 70 extends forwardly to an inflection point 72. At the inflection point 72, the first surface 38 transforms from a concave to a convex surface. Therefore surface 74 is a convex surface that is also adapted to receive the vane 93 of the slave lobe 82. A more thorough discussion of the relationships between the surfaces of the master rotor and the slave rotor will follow after a thorough description of the slave rotor.

Now referring back to FIG. 2, the surface 76 is positioned between base surfaces 70*a* and 70*b* of lobes 32*a* and 32*b*. Surface 76 does not come in contact with the slave rotor 28 but cooperates with the inner surface of the housing 22, the outer surface of the bearing 23 and the forward surface 92 of the slave rotor 28 to define a chamber 105 that is further discussed herein.

There will now be a detailed discussion of the slave rotor 28 where reference is made to FIG. 2. The slave rotor 28 comprises a shaft 80 and a plurality of lobes 82. As with the description of the power rotor 26, only lobe 82*a* (otherwise referred to as slave lobe or second lobe) will be described in detail with the understanding this specification applies to all of the lobes 82 on the slave rotor 28. Further, the invention is not limited to the number of lobes as shown in the preferred embodiment.

As seen in FIG. 2, the slave lobes 82 comprise a spherical outer surface 84, a spherical inner surface 86 (see FIG. 4), a first surface 88, a second surface 90, and finally a forward surface 92. Further, the lobes 82 has a first tip 91 and a second tip 93. The tip 91 has a contact surface 95 and tip 93 has a contact surface 97. The contact surfaces 95 and 97 are adapted to engage surface 88 of the power rotor 26. The contour of these surfaces are fully described in U.S. Pat. Nos. 6,036,463 and 5,755,196 and further in the pending U.S. patent application Ser. No. 09/318,572 that have been incorporated by reference.

A first embodiment, lobes 82 are symmetrical about the radially extending plane 94 (see FIG. 2) and hence the first surface 88 will be described in detail with the understanding the geometry and other pertinent features relates to the second surface 90 has a mirrored image about plane 94. It should be noted that certain symmetrical variations could be employed in the lobes 82 about plane 94.

Figure 7:
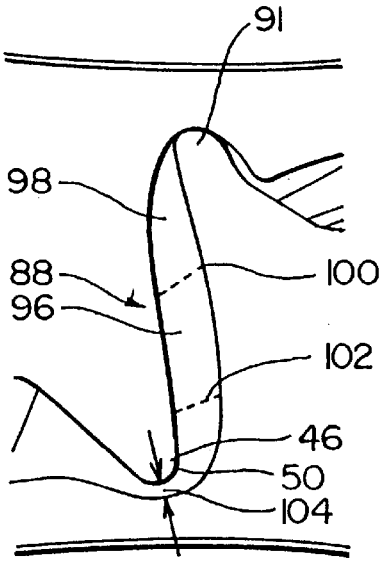
FIG. 7 illustrates the contact surface of the slave rotor.
Figure 8:
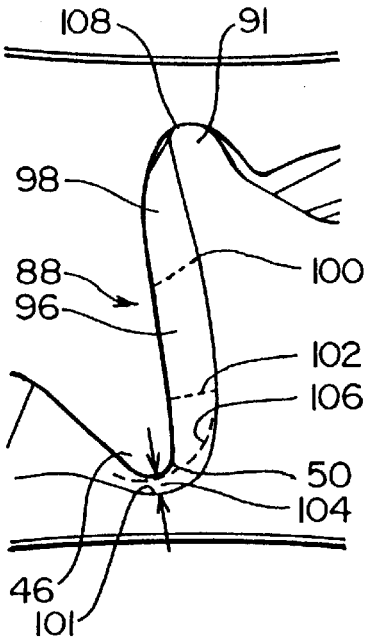
FIG. 8 is a second close-up view of the slave rotor illustrating the gap that is provided between the same of the master rotor and the rearward surface of the slave rotor.

The first surface 88 is shown in FIG. 7 where the rotor assembly 22 is in a bottom dead center position. The first surface 88 comprises a concave portion 96 and a convex portion 98. The inflection point line 100 is the location where the surface 88 transforms from a concave to a convex configuration. As seen in FIG. 8, the concave surface 96 has a forward portion 99 and a rearward base portion 101. The concave surface 96 further has a loss of contact line 102. The loss of contact line 102 defines the point where the contact surface 50 of the vane 46 radially repositions from the surface 88 and separates (or partially separates) the forward portion 99 from the rearward base portion 101. It should be noted that the contact surface 50 and first surface 88 are not necessarily in direct contact in operation, but rather there is a thin fluid film thereinbetween. Therefore the term "communication" or "in contact" between two surfaces is defined to include a possible thin fluid film. However, as a contact surface 50 rotates to the bottom dead center position as seen in FIG. 7, the annular gap 104 is produced. As shown in FIG. 8, the dashed line 106 defines a curved plane that is defined by contact surface 50 as the power rotor rotates about its axis 10 (see FIG. 4).

Figure 9:
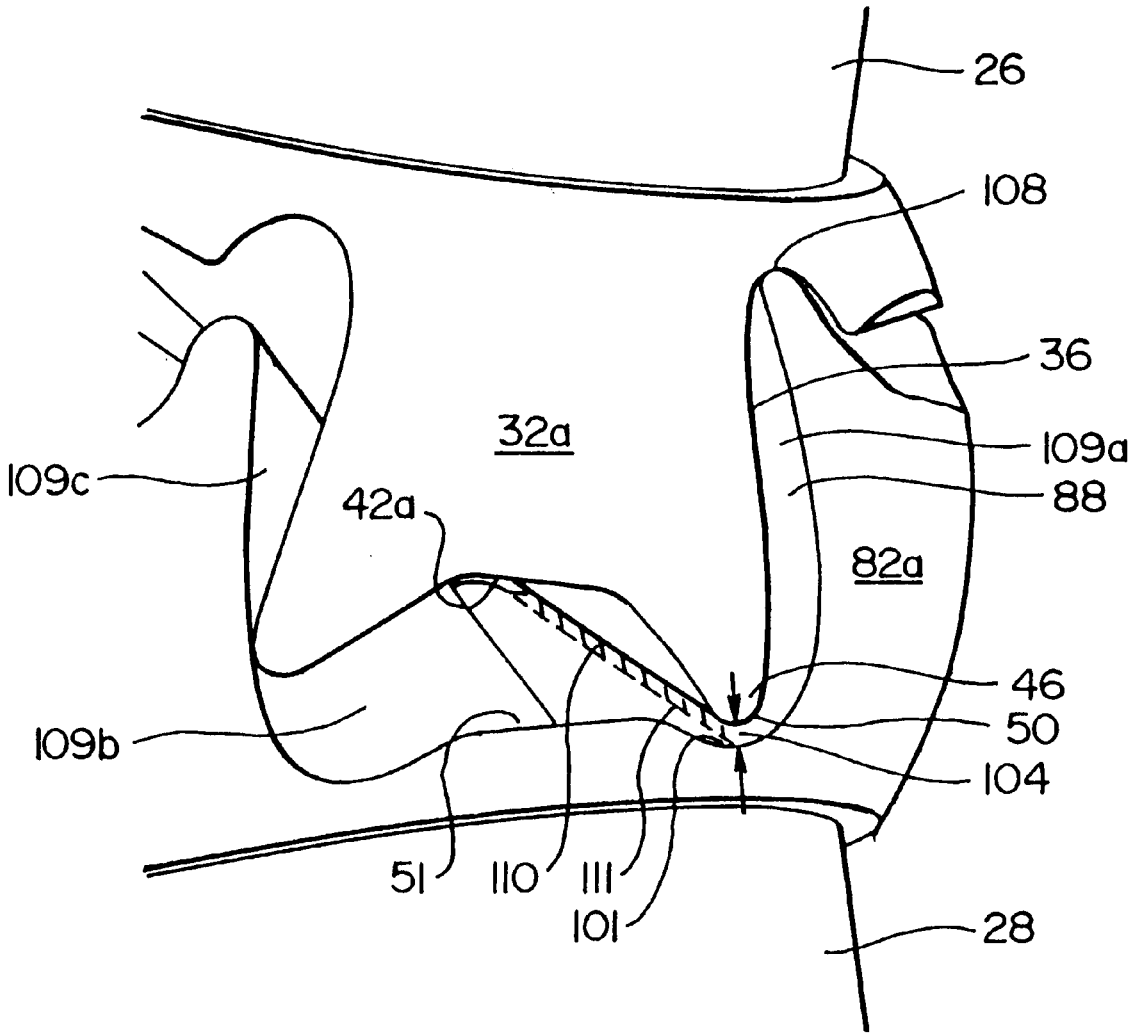
FIG. 9 shows the gap which is present between the master and slave rotors at the bottom dead center position to allow a pressure difference be distributed therethrough.

The perpendicular distance between curved plane 106 and rearward base surface 101 defines the annular gap 104. The distance of this gap changes with respect to the radial position. Hence, the open area 110 is defined as the open area defined between surface 50 of the power rotor 26 surface 101 of the slave rotor 28 the housing 22 and the bearing 23 (see FIG. 9). FIG. 9 shows the open area 110 has a hatched open area where the dashed line 111 indicates the perpendicular distance between contact surface 50 of vane 46 and rearward surface 101. It should be noted that rearward surface 101 has a greater radius of curvature then contact surface 50 and hence the narrowest passage between secondary-chamber 109*b* and secondary-chamber or semi-chamber 109*a* (defined further herein) is open area 110. The cross-sectional area gap of open area 110 could have certain ratios with respect to the viscosity of the fluid medium that is passed therethrough. For example, if the engine 20 is designed to pump high viscosity fluids, open area 110 could be larger to allow the pressure transfer to happen quickly between semi-chambers 109*a* and 109*b*. Consistent with the foregoing communication between semi chambers 109*b* and 109*c* have a similar communication means between vane 44 and the base surface 50 of the slave rotor 28.

The ratio of the distance 101 and the ratio of the contact film distance between the vane 91 and the base surface 52, 54, and 56 can be in the order of 20 to 1 in a preferred form for many fluids. This ratio is further relevant to the net cross-sectional open area 110 and the net cross-sectional area of the fluid film at location 108. A secondary range for the net cross-sectional areas can be between 30–1 and 10–1 and the ranges therein between and at certain ratios with certain fluids. In some cases much lower ratios can achieve the fluid pressure balancing between semi chambers. For this patent application, communication is defined as sufficient open area allowing a desirable pressure equalization between two adjacent semi chambers.

It should be noted that a very minimal amount of flow between the cross-sectional open area 110 is necessary to create a pressure balancing effect in some conditions. For example, at high speed and low-pressure, a very low ratio can create desirable balancing results.

The rotor assembly 24 comprises several chambers and semi-chambers. A chamber is defined as a substantially sealed and closed area where leakage of fluid from or to the chamber only occurs due to a passage through a thin fluid film layer between two surfaces. A secondary-chamber or semi chamber is defined as a cavity where two adjacent secondary-chambers comprise a chamber; however, the open area 104 allows fluid passage therein between.

As seen in FIG. 2 the forward surface 92 of lobe 82 and rearward surface 76 of the power rotor 26 along with the surface of the bearing and additionally the inner surface of the housing 22 create a sealed chamber 105. Now referring to FIG. 9, the first surface 88 of lobe 82 and the first surface 36 of lobe 32 along with the outer surface of bearing 23 and inner surface of the housing 22 define the first semi-chamber 109*a*. The forward surface 42 of lobe 32 and rearward surface 51 in-combination with the surface of bearing 23 and the inner surface of housing 22 define the second semi chamber 109.

Figure 10A:
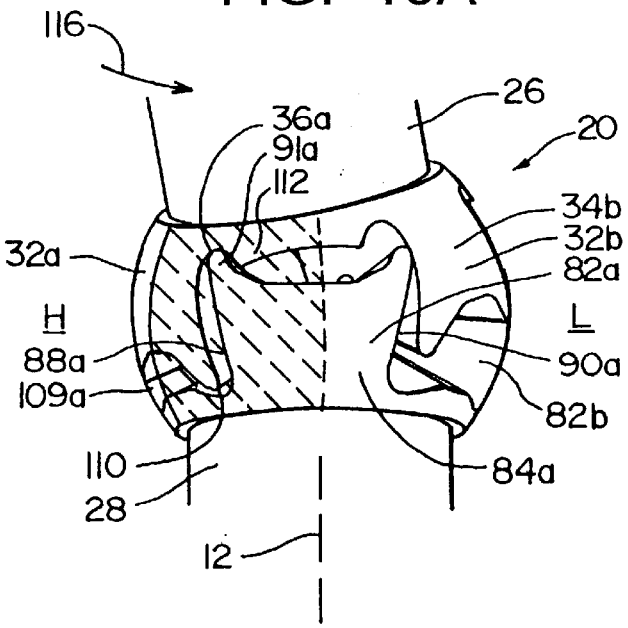
FIGS. 10A–10C have three substantial front views of each of the three slave lobes to illustrate the pressure balance acting upon these lobes.

Given the foregoing, the importance of the open surface area 110 to allow rotational balance of the slave rotor 28 will now be discussed with reference to FIGS. 10–11. FIG. 10 shows a front view of each of the lobes 82*a*–82*c* of the slave rotor 28. In this particular configuration the apparatus 20 is schematically shown in a pump configuration. The housing 22 that intimately engages the outer spherical surfaces and 34 and 84 is shown as the hatched surface 112 and 114 at the lower and upper portions respectively. The power rotor 26 is rotating in the direction indicated by arrow 116 and hence in FIG. 10*a* the area to the left is a high-pressure area indicated by the letter "H" and the area to the right is the low-pressure area indicated by the letter "L". It should be noted that the high and low pressure areas are not in communication and the only means by which a fluid can pass from the low to the high pressure area is through the chambers 105.

FIG. 10 is a snapshot of the rotor configuration 22 at a specific rotational orientation with respect to the housing 22. As will be shown herein, the pressure upon first and second surfaces 88 and 90 for each of the slave lobes (i.e. 82*a*, 82*b* and 82*c*) have offsetting pressures and balance with respect to the central axis 12 (i.e. the slave rotor 28 has no pressure difference amongst the sum of its faces to induce a rotation). In this embodiment three slave lobes 82 are employed; however, additional lobes could be added without departing from the teachings of the present invention.

First looking at FIG. 10*a*, first surface 88*a* is subject to a high-pressure. The high-pressure from the fluid is a result of an open circuit through open surface area 110. In other words, the high-pressure fluid that has access to the open semi-chamber 109*b* and transmits the pressure through the open surface area 110 to semi-chamber 109*a*. The vane 91*a* is in close communication with the first surface 36*a* and hence provides a substantial seal between the high and low-pressure zones. The second surface 90*a* is exposed to the low-pressure zone.

Figure 10B:
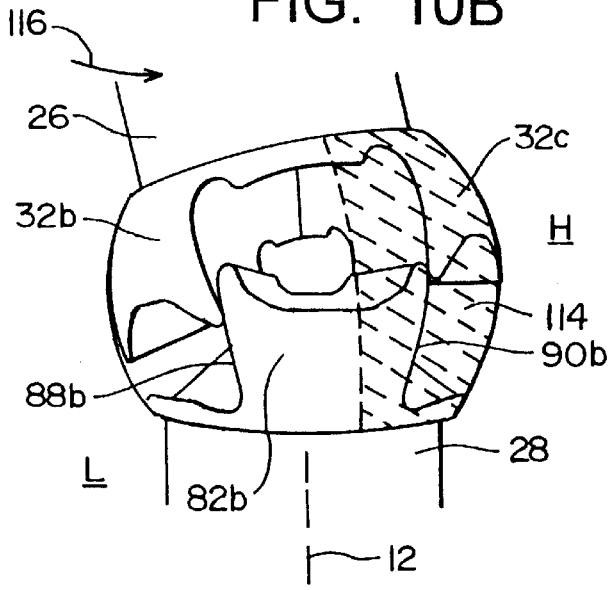

Now referring to FIG. 10*b*, first surface 88*b* of lobe 82*b* is subjected to a low-pressure zone. However, second surface 90*b* is subject to a high pressure zone (refer to FIG. 10*c* where high-pressure fluid enters into chamber 105*c* at the open portion indicated by arrow 115).

Figure 10C:
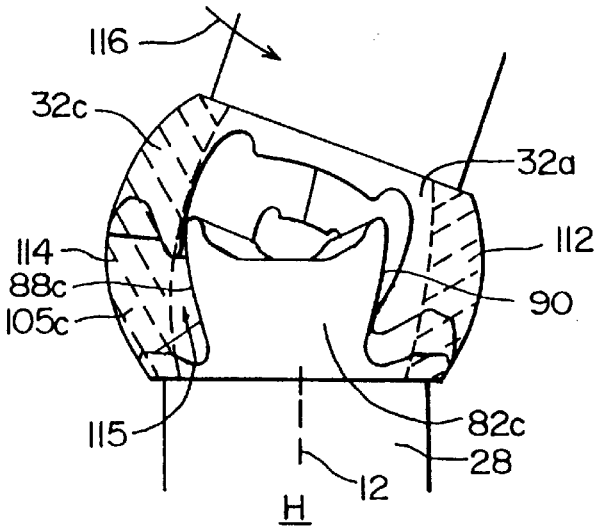

Finally referring to FIG. 10*c*, first surface 88*c* and second surface 90*c* of lobe 82*c* are both subjected to high-pressure. Lobe 82*c* is directly in the high pressure port of the housing 22.

Figure 11A:
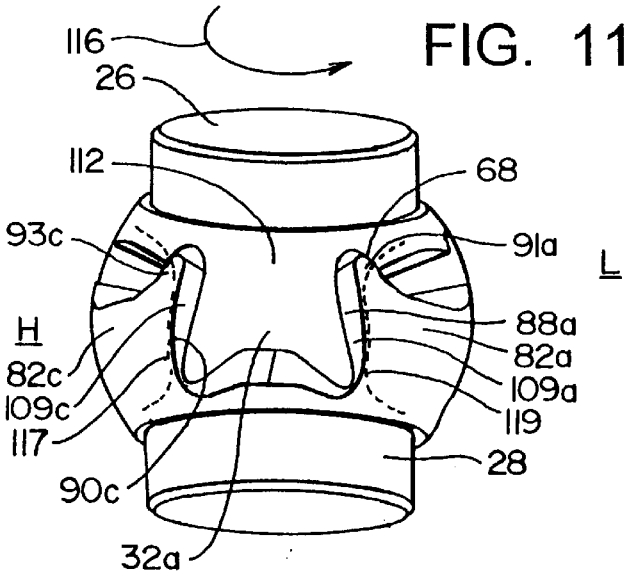
FIGS. 11A–11F illustrate the motion of the master and slave rotors as they pass through the bottom dead center position, whereas each progressive figure shows approximately fifteen–twenty degrees of rotation.
Figure 11B:
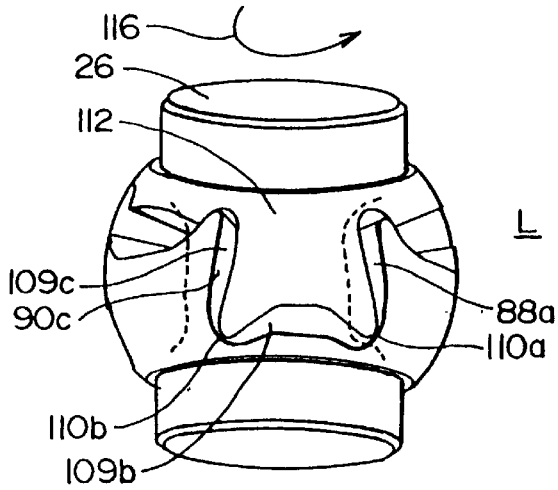

As seen in FIGS. 11*a*–11*b*, there is shown a front view of the surface 112 that represents the portion of the housing that is in communication with the outer surfaces 34 and 84 of the lobes 32 and 82 respectively. The power rotor 26 is rotating in the direction indicated by arrow 116 and hence the left hand portion of FIG. 11 is designated as the high-pressure side indicated by the "H" and the right hand portion is a low-pressure side (a fluid intake side) indicated by the letter "L". The border 117 of the high-pressure port is indicated at 117 and the border 119 of the low-pressure port each have a characteristic shape discussed further herein.

As seen in FIG. 11*a*, vane 91*a* is in communication with surface 68 of the power rotor 26. The vane 93*c* is in communication with surface 66. Therefore, the semi chambers 109*a* and 109*c* have the fluid held therein under high-pressure. Therefore, surfaces 88*a* and 90*c* both have high pressure fluid acting thereon. Surfaces 90*a* and 88*b* (not shown) have low pressure fluid acting thereon. Finally, a high-pressure fluid is exposed to surfaces 88*c* and 90*b*. Therefore, the radial forces upon the slave rotor 28 are balanced.

Now referring to FIG. 11*b* the power rotor has rotated approximately 10 degrees in the direction indicated at arrow 116 and the surface 88*a* is now exposed to the low pressure zone "L". The fluid in semi chamber 109*c* is additionally in a low pressure zone because as mentioned above, the fluid is allowed to pass through open area 110*a* and 100*b*.

Figure 11C:
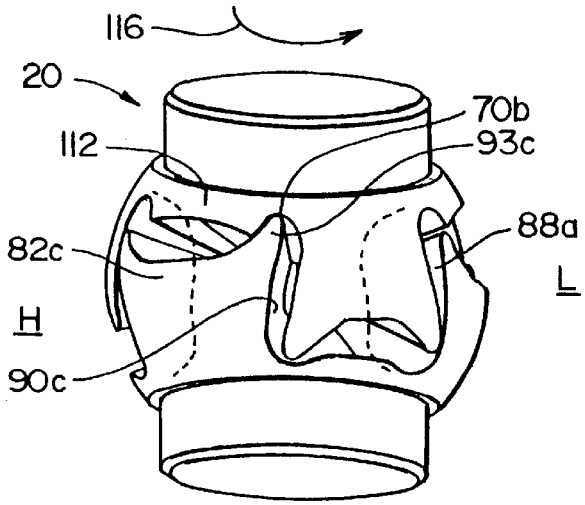

As seen in FIG. 11*c*, the rotor assembly 20 has rotated several degrees further in the direction indicated by arrow 116. The vane 93*c* is in communication with base surface 70*b*. It should be noted that the tight communication with the fluid film allows very little backflow from the high-pressure zone "H" to the low-pressure zone "L".

Figure 11D:
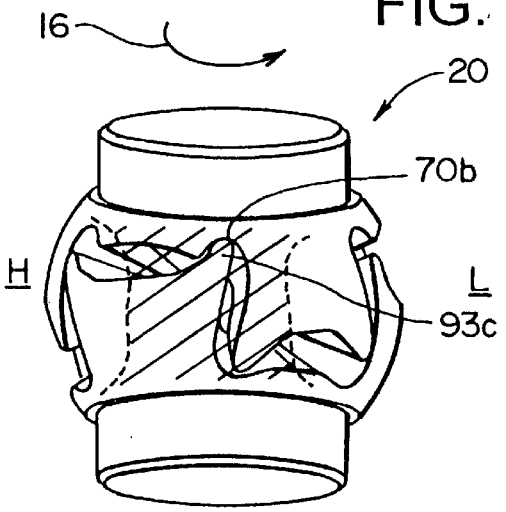

FIG. 11*d* shows a rotor assembly rotated a few more degrees in the direction indicated by arrow 116 where the contact between vane 93*c* and base surface 70*b* maintains the pressure difference between the high and low-pressure zones.

Figure 11E:
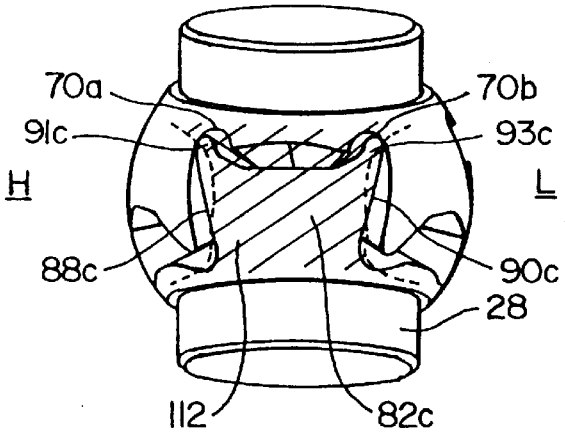

FIG. 11*e* now shows the slave lobe 82*c* positioned substantially behind surface 112 of the housing. At this position vane 93*c* and 91*c* are in tight communication with the base surfaces 70 at this position surface 90*c* is exposed to the low pressure zone "L" and surface 88*c* is in communication with the high-pressure fluid zone "H". Further, surface 88*a* and 90*a* are in communication with the low-pressure zone "L" and surfaces 88*b* and 90*b* are in communication with the high-pressure zone "H". Therefore the tangential forces acting upon the slave rotor 26 are balanced.

Figure 11F:
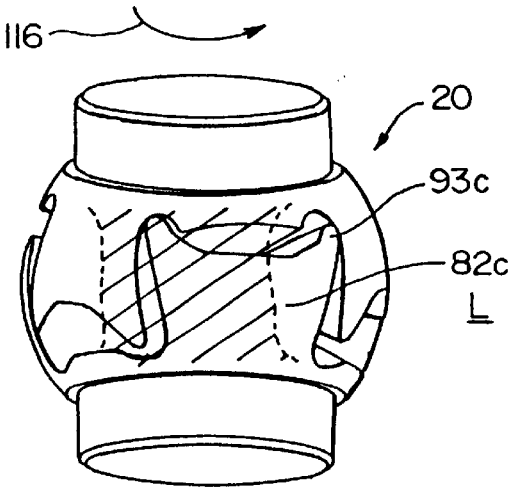

Finally as seen in FIG. 11*f*, the rotor assembly 20 has rotated approximately fifteen degrees in the direction indicated by arrow 116. In this position the contact seal provided by vane 93*c* is in the low-pressure zone "L".

With the foregoing in mind, it can be appreciated that the open area region 104 allows communication to the lobes that are located adjacent to the casing at the bottom dead center or top dead center. Hence, the slave rotor is rotationally balanced about the longitudinal slave axis.

Figure 12:
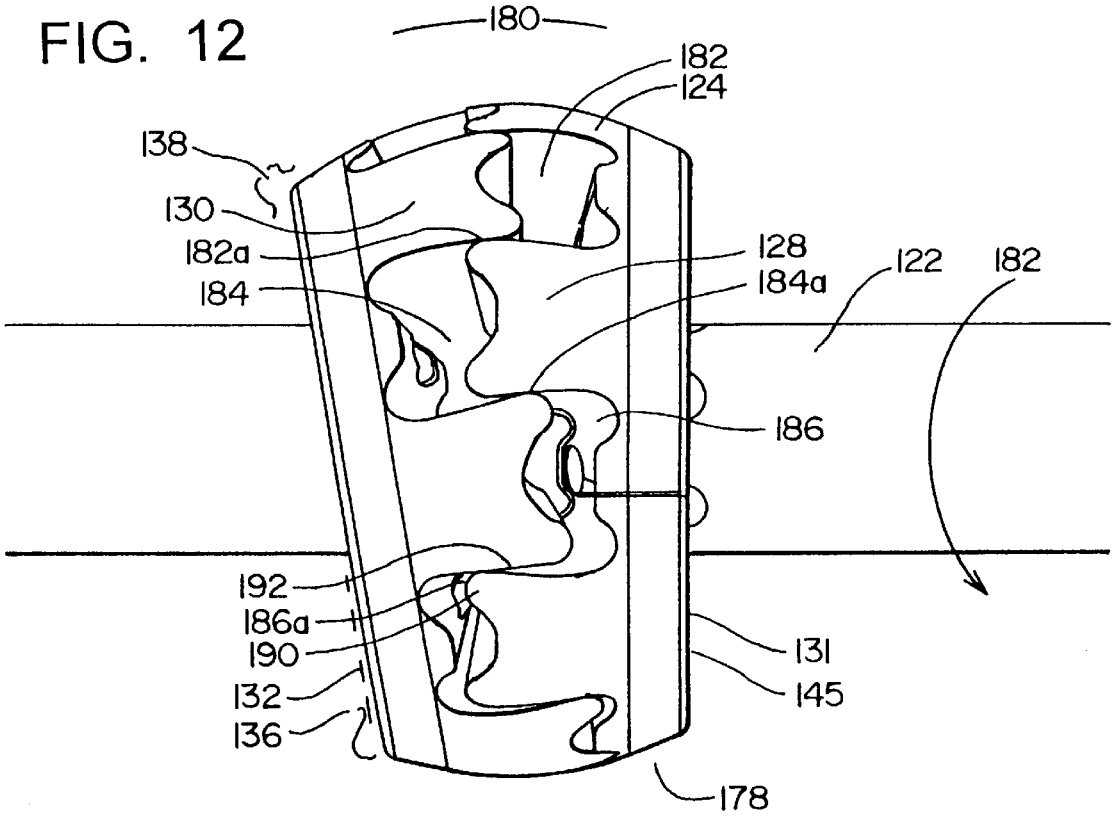
FIG. 12 is a side view of a second embodiment of the present invention that allows axial flow of a fluid.
Figure 13:
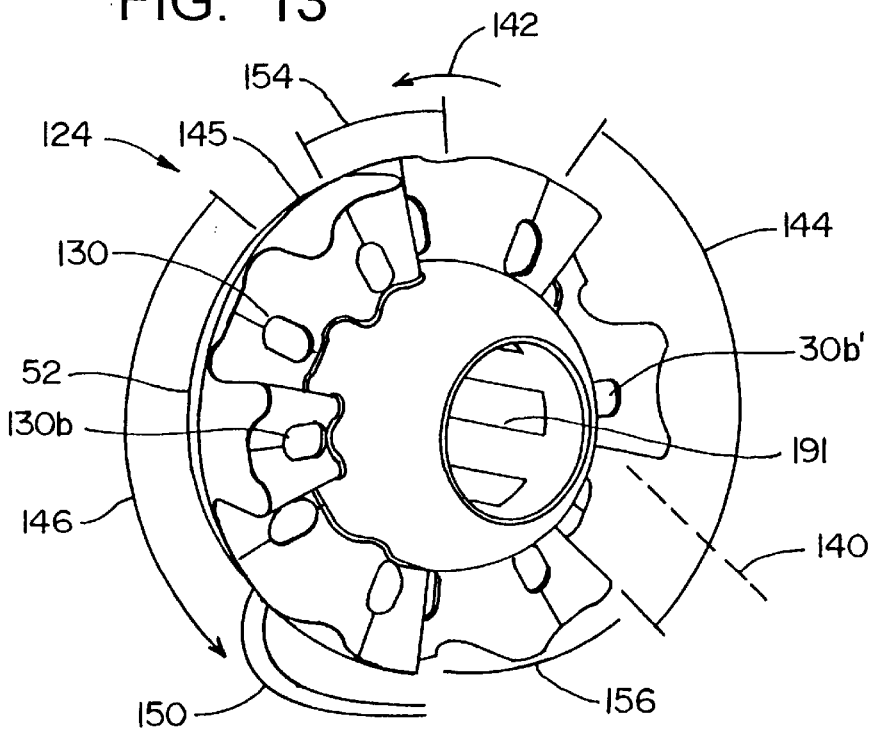
FIG. 13 is an isometric view of the contoured surfaces of the power rotor.
Figure 14:
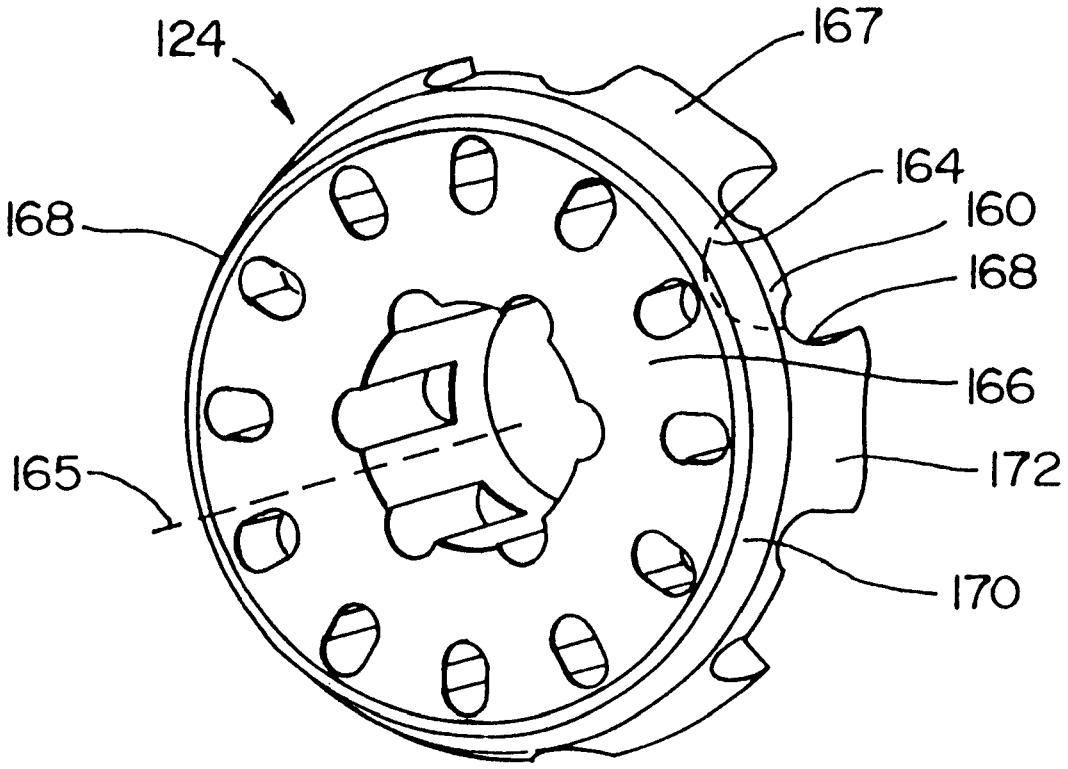
FIG. 14 is a rearview of the power rotor.

FIGS. 12–14 show a second embodiment that allows axial flow of fluid. In this embodiment the aforementioned method of balancing the slave rotor could be applied as well. In general, the second embodiment allows the working fluid to substantially flow in line with the axis of rotation of the shaft 122.

Referring to FIG. 12, there is a rotor assembly 120 comprising a shaft portion 122, a first rotor 124 and a second rotor 26. The first rotor comprises a plurality of lobes 128. Likewise the second rotor also has a plurality of lobes 130. The shaft 122 passes therethrough the first rotor 124 and does not need to be a unitary structure. There are several advantages for this configuration; the first being that it expands the choice of materials for the rotor 124 in that the shaft could be a less-expensive material with different properties such as Modulus of Elasticity, hardness, rigidity, etc.

In this embodiment, the rotor 124 is the master rotor and rotor 126 is the slave rotor. Thereby rotor 126 would be pressed against a casing surface at indicated by the dashed line 132.

There will now be a discussion of the improvements in the conduits 131. The rotor ports that are located in a high pressure portion 136 allow pressure equalization so longitudinally offset force does not result in an imbalance of the slave rotor high portion 136 and the low pressure portion generally designated as 138.

FIG. 13 is an isometric front view of a rotor. The longitudinally extending ports 130 are positioned at the base portion of the lobes as well as the upper portion indicated at 130*b*.

There will now be a discussion of the axial flow balancing of the rotors 124 and 126. Looking at FIG. 13, there is shown an isometric view of the power rotor 124 where the dashed line 141 indicates the central axis of the power rotor (axis of rotation) and dashed line 140 indicates the axis of the slave rotor. The power rotor 124 rotates in the direction indicated at arrow 142 about axis 141. The inlet ports that are located in the casing (not shown) are indicated within the approximate range indicated at 144 and discharge or outlet port approximately indicated at range 146. To maintain balance about a vertical axis to prevent a longitudinally offset force upon the rotors (where the center of the force is either on side 144 or 146), the ports indicated by 130 and 130*b* allow an open circuit between the closed chambers of the engine and the chamber portion defined between the rotors and the housing. Therefore, in the right hand side of FIG. 13 (the low pressure side) the ports 130*b*' do not allow a pressure difference between the inner chamber and the backwall 145 and the housing. Likewise, on the high pressure side indicated at 146, there is no net pressure difference between the inner portions of the chamber and the outer portions of the chamber. There can also be conduits through the casing to allow this pressure equalization to take place.

As seen in FIG. 13, the portions 154 and 156 represent a portion of the housing which are in communication with the perimeter surface of the power rotor 124. This ensures that the high pressure side 146 does not lead fluid back into the low pressure side 144.

As seen in FIG. 14, there is an isometric rearview of a master rotor each where the central axis of rotation is indicated at 165. In accordance with the other figures, the portion indicated at 160 is a high pressure side and the portion indicated at 162 is the low pressure side. A second embodiment of the present invention would be to remove the portion of the rotor indicated at the hash line 164. This would have the same function as the ports 130 (see FIG. 13) to equalize the pressure between the front and back portions of the power rotor 124. The seal between the high and low pressure portions is still maintained by the surfaces 167. The casing engages each of the surface 170 to maintain the pressure difference.

Referring now to FIG. 12, a plurality of rotor set combinations could be employed along the shaft 122. It would be preferable if the high and low pressure sides of each rotor set would be offset from one another by one hundred eighty degrees to prevent a moment perpendicular of the axis.

When the engine assembly 120 is used as a compressor the entrance and exit ports are located at top dead center 180 and bottom dead center 178 (or in that proximity). If the rotor set is rotating as indicated by arrow 183 and the visible side in FIG. 12 is the high pressure portion. In this embodiment the housing (not shown) will cover the chambers 182, 184, 186 and 188 to allow the gas to compress therein. The compressed gas is then expelled be added exit ports located in the vicinity of area 178.

One preferred method of using the rotor assembly 120 as a compressor would be to interject a fluid at the ports in the casing indicated at 180 to aid the sealing between the surfaces of the lobes 190 and the surfaces 192. The fluids primary function is to prevent leakage of gas at the contact portions at 182*a* and 184*a* and to provide calling to maintain a fluid film which reduces or eliminates contact. The viscosity other fluid inhibits the backflow of gas at these points.

It should be noted that the axial conduits and ports in the rotor assembly and the base housing can occur on a non central shaft design such as that shown in FIGS. 11–14 where the respective power shaft and slave shaft are supported by bearings at a diameter less than the diameter of the base surfaces of the rotor assemblies to provide room for the axial conduits. This design would be advantageous because the back faces of the rotors that supply a pressure force thereupon the casing and therefore do not requiring thrust bearings upon the shafts.

A fourth embodiment of the present invention is shown in FIGS. 16–29*b*. The fourth embodiment assembly indicated at 220 is particularly advantageous having a modular design suited for a production model where modular sections can be placed in-parallel or in series to produce desirable pressure and flow characteristics of the working fluid. If a higher volume of fluid is desired to pass through the assembly 220, then the modular units are placed in a parallel configuration as shown in FIG. 27. If a higher pressure differential from the input portion and the output portion of the assembly 220, the modular sections are placed in a series configuration as shown in FIG. 15 where each stage increases the pressure of the working fluid with respects to the previous stage.

Figure 28:
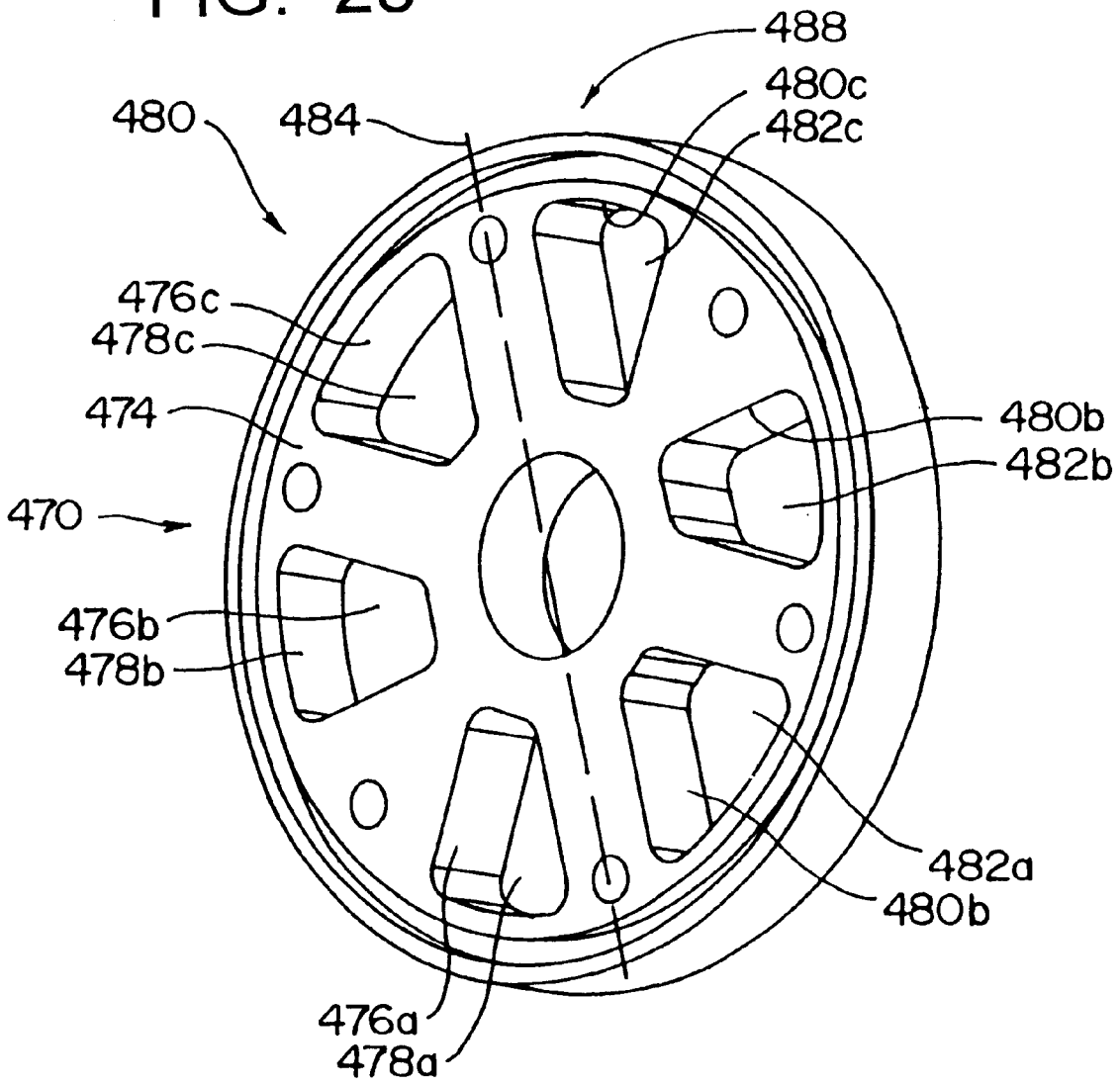
FIG. 28 is an isometric view of an interior cap used in the in-parallel arrangement flow.

In general, a series flow configuration can be changed to a parallel flow configuration by replacing the cap 234 with cap 470 as shown in FIG. 28 to allow communication between inlet ports of 256 and 258 and outlet ports 394 and 398. In other words, the cap 470 essentially allows communication so the fluid entering can enter the operating chambers of the rotor assemblies in either the first or second rotor sections 452 and 454.

Figure 15:
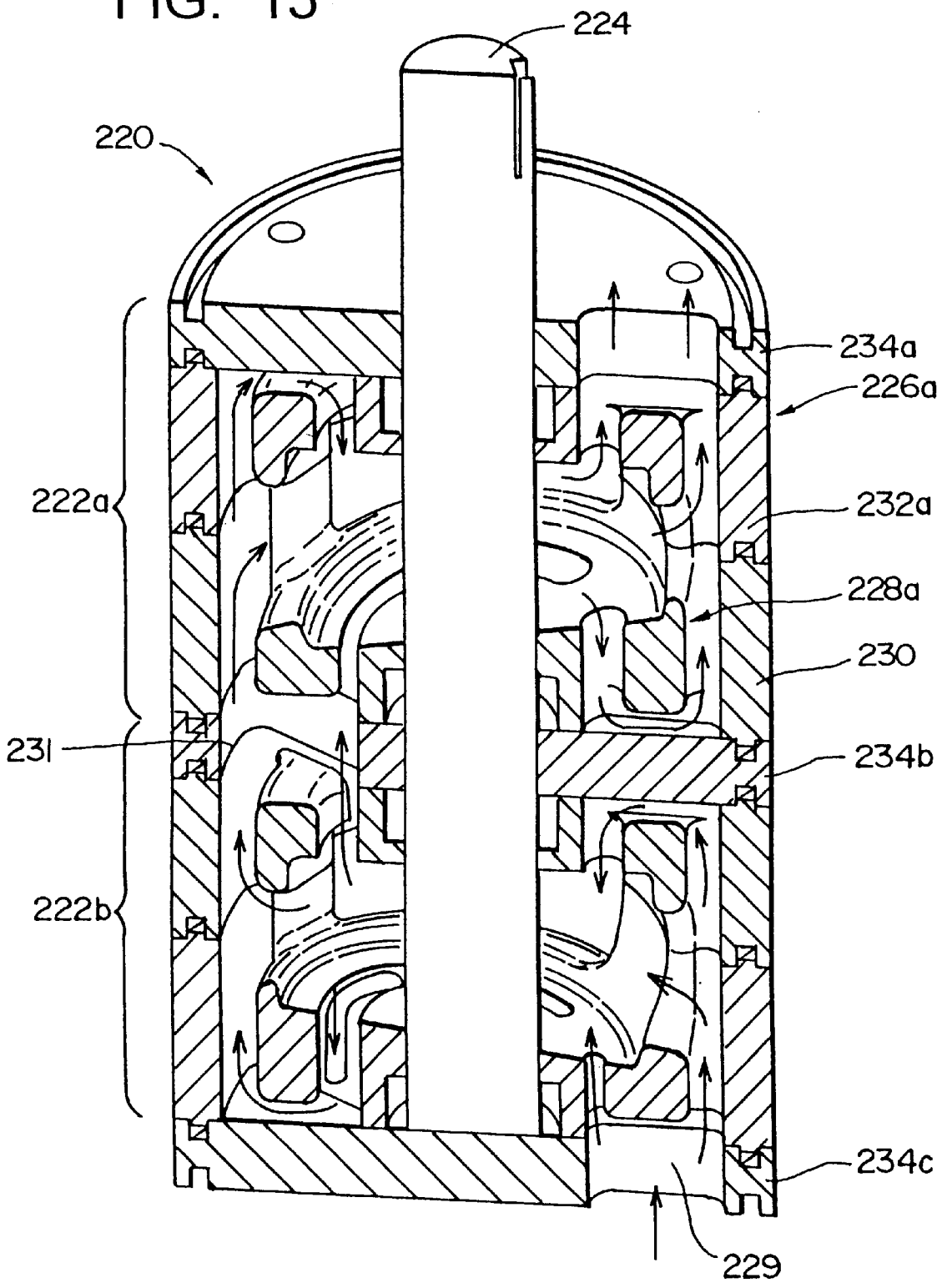
FIG. 15 is an isometric cross-sectional of view a fourth embodiment of the present invention.

As shown in FIG. 15, the assembly 220 comprises at least one rotor section 222, and a central shaft 224. The rotor sections comprise a casing portion 226 and a rotor assembly 228. Each rotor section 222 has an entrance portion 229 and an exit portion 231.

The casing portion 226 comprises three sections in the preferred embodiment, a first section 230, a second section 232 and a cap 234. The first and second sections 230 and 232 are commonly referred to as a base housing 231. In general, the sections 230 and 232 are adapted to engage one another at a peripheral edge and are used in the "in-series" embodiment, the "inparallel" embodiment, and in the "combination" embodiment.

Figure 18:
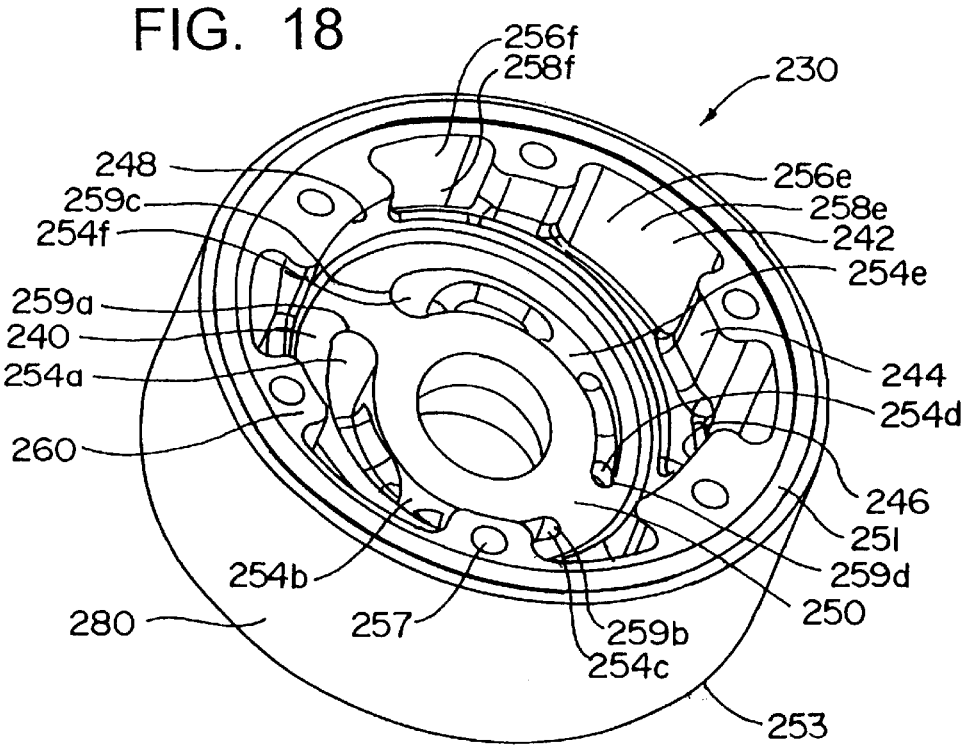
FIG. 18 is an isometric view of a slave section of the housing.

As shown in FIG. 18, the first section (slave section) 230 is a unitary design in the preferred form and comprises a fluid entry region 240 and a fluid exit region 242, a radial inward surface 244 having a first sealing portion 246 and a second sealing portion 248 described further herein. The entrance region is defined as the portion of the rotor assembly on the lateral side of the first and second sealing portions 246 and 248. Likewise, the exit region 242 is on the opposite lateral side of the first casing portion 230. The sealing portions 244 and 246 separate the entrance and exit regions 240 and 242 in conjunction with the outer surface of the rotor assembly 228.

Located in the upper portion of the first section 230 is the annular ridge 251 and located in the bottom portion is an annular recessed region 253.

The first section 230 further comprises a base contact surface 250 and axially extending surfaces 252. The axially extending surfaces 252 define axial conduits 254. The axial conduits 254*a*–254*c* are located on the entry region 240 and the axial conduits 254*d*–254*f* are located on the exit region 242.

The axial surfaces 256 located radially outwardly from the actually extending surfaces 252 define axial conduits 258. The post portions 260 defined radial conduits 262 allowing fluid to radially pass therethrough into the chambers of the rotor assembly.

Figure 16:
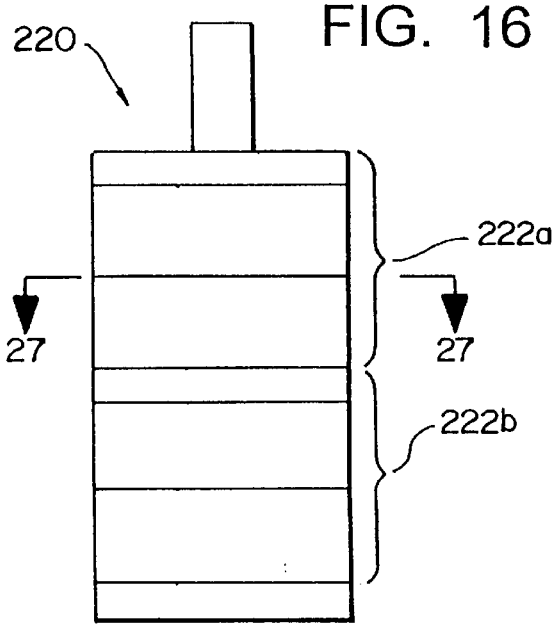
FIG. 16 is a side view of the apparatus of the fourth embodiment showing the external surfaces of the casing portions.

The outer surface 280 is preferably cylindrical about the center point 282 as shown in FIG. 16. In a preferred form the outer surfaces sections 230, 232, and 234 comprising the casing portion 226 are in alignment in the longitudinal direction. The passageways 257 allow passage of a bolt or other connecting device (see FIG. 18).

The annular ridge 251 is adapted to be received by the annular recess region at 408 of the second section 232

Figure 24:
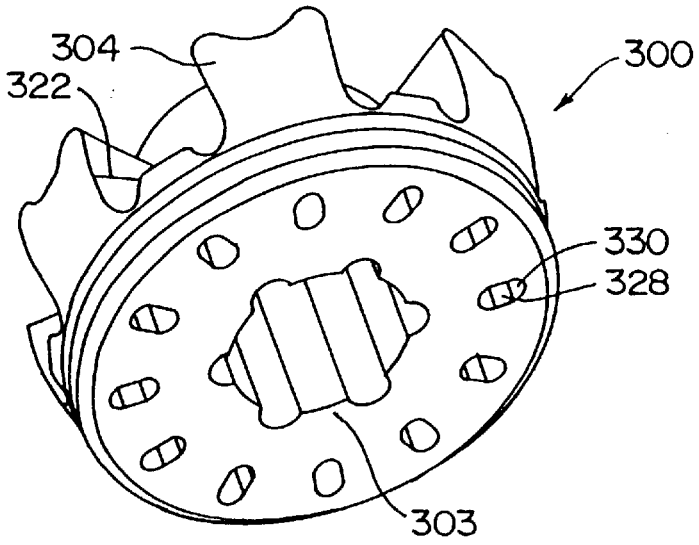
FIG. 24 is an isometric rearview of the power rotor of the fourth embodiment.
Figure 25:
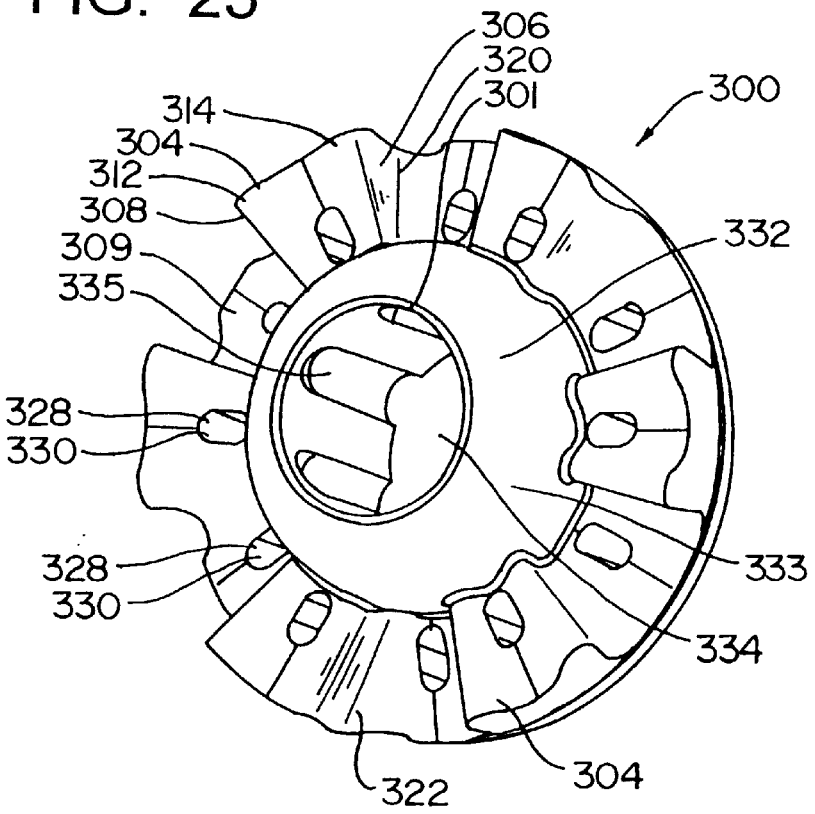
FIG. 25 is an isometric view of the inward portion of the power rotor of the fourth embodiment.

The rotor assembly 228 comprises a power rotor 300 and a slave rotor 302 as shown in FIGS. 19, 24, and 25. The rotor assembly 228 is very similar to the rotor assembly described above in the previous embodiments where the certain elements are reiterated herein below.

As shown in FIGS. 24 and 25, the power rotor 300 has an inward region 301 and an outward region 303 (see FIG. 24) and comprises a plurality of lobes 304 where each lobe has a first contact surface 306, a second contact surface 308, a base surface 309, and an inward surface 310. The tips 312 and 314 are adapted to engage the contact surfaces 342 and 344 of the slave rotor 302. The first and second contact surfaces 306 and 308 have an inflection point indicated at radially extending lines 320 and 322.

Longitudinally extending surfaces 328 define conduits 330 to allow communication between the outward region 303 and the inward region 301.

A located in the central portion of the power rotor 300 is a partial sphere 332 that has an outer contact surface 333 which forms at least part of a sphere and is adapted to engage the inward surface 346 of the slave rotor 302. Located in the central portion of the partial sphere 332 is a central passageway 334 adapted to allow the shaft 224 pass therethrough and the grooves 335 are adapted to engage extensions connected to the shaft 224 in a manner so the power rotor 300 rotates with the shaft 224.

Figure 19A:
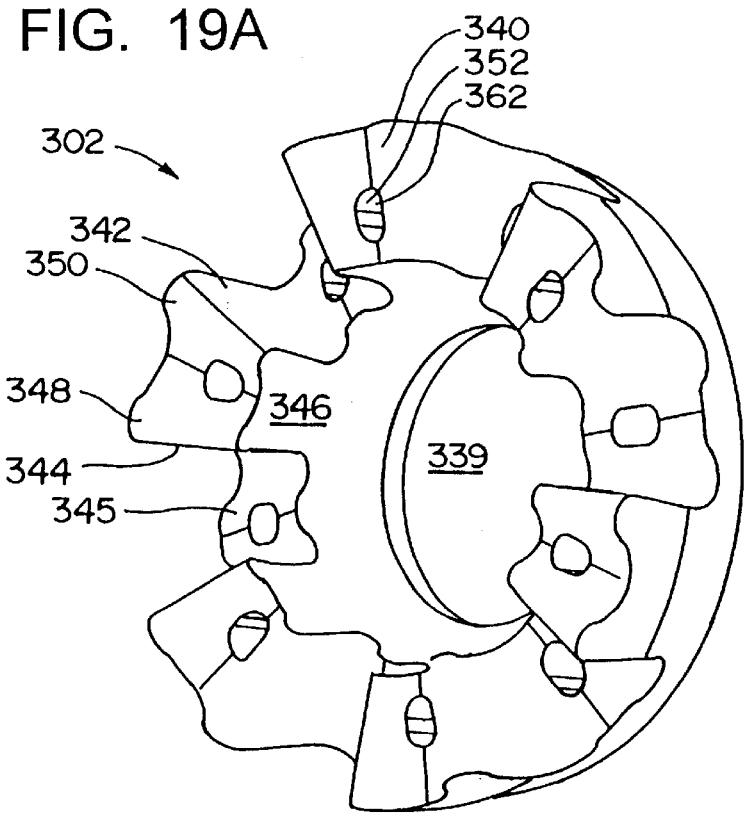
FIG. 19A is an isometric view of the inward portion of a slave rotor.
Figure 19B:
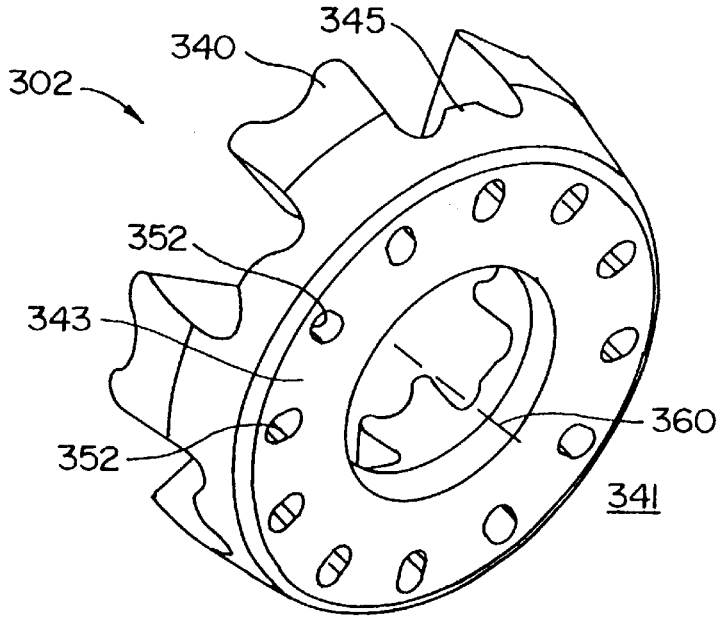
FIG. 19B is an isometric rearview of the rearward portion of the slave rotor.
Figure 20:
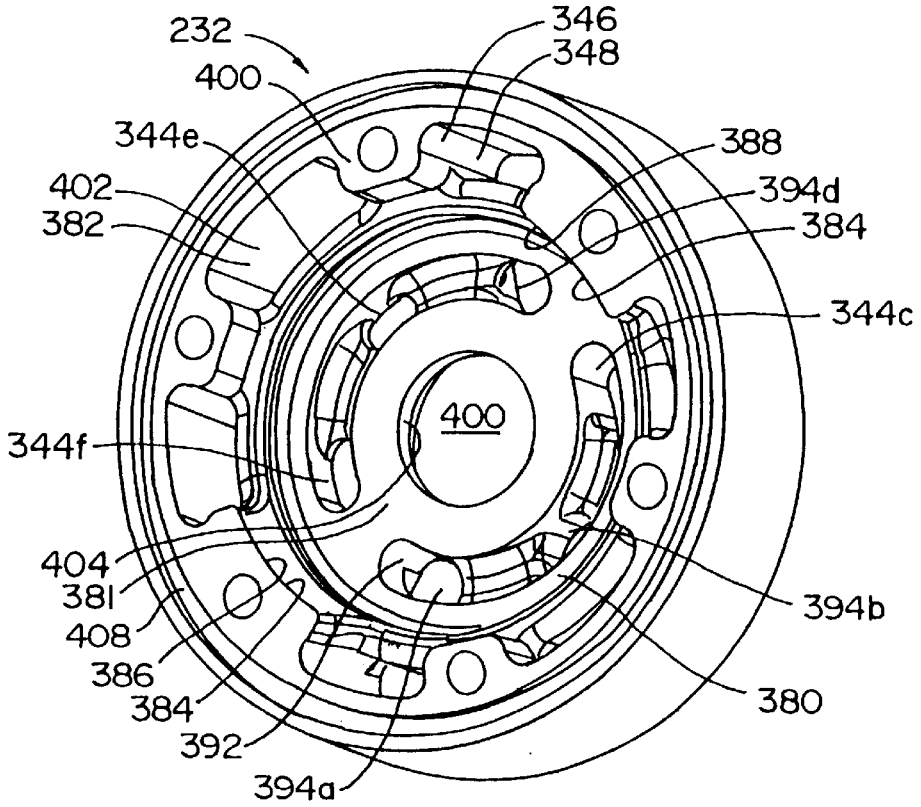
FIG. 20 is an isometric view of the inward portion of the power casing.
Figure 21:
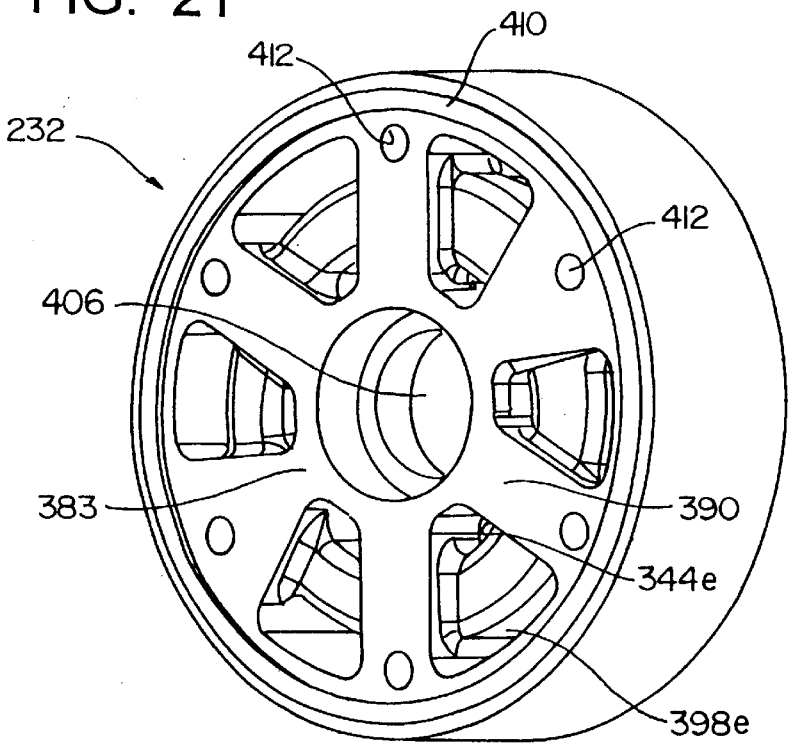
FIG. 21 is a rearward view of a power casing section of a casing portion.

As seen in FIGS. 19*a* and 19*b*, the slave rotor 302 has an inward region 339 and an outward region 341 and comprises a plurality of lobes 340 where each lobe has a first contact surface 342, a second contact surface 344, a base surface 345, and an inward surface 346. The slave rotor 302 further has a base surface 343 adapted to engage the support surface (base contact surface) 250 of the first section 230, and an inward surface 346 adapted to receive the outer surface 333 of the partial sphere 332 of rotor 300. Each lobe has tips 348 and 350 adapted to engage the first and second contact surfaces 306 and 308 respectively in a manner to define working chambers 352. The slave rotor 302 further has an axis of rotation 360 (referred to as the offset longitudinal axis, or slave longitudinal axis) that is offset from the longitudinal axis an angle indicated at $\alpha$. The surfaces 352 extend substantially longitudinally and are offset from the longitudinal axis 360 define conduits 362 to allow communication between the inward region 339 and the outward region 341.

It should be noted in that the conduits 362 and 330 are located on both the lobes as well as the base portions. However, these conduits can be located on either portion of the power and slave rotors 300 and 302. The conduits on the lobes are referred to as lobe conduits and the conduits in the base portions are referred to as base conduits.

As previously mentioned, the rotor assembly can be similar to the rotor assemblies described above, wherein the preferred form the tips 312 and 314 of the power rotor to not engage the base surface 343 of the slave rotor to allow communication therethrough to allow a balanced rotor assembly where the slave rotor is constantly balanced about the offset longitudinal axis 360 and the power rotor 300 has a constant torque about the longitudinal axis. This is particularly advantageous for high-speed rotation rotors with high compression ratios. Alternatively, a rotor design without the balanced rotor can be employed in the axial flow embodiment particularly with low compressor ratios and lower speeds.

In this embodiment the spherical portion 332 is a unitary structure with the lobes 304. Additionally, the shaft 224 can further be rigidly attached to the central portion of the rotor 300. Alternatively, the spherical center portion can be a separate unitary structure attached in to the cylindrical lobe portion of the rotor 300 by such connection methods such as where corresponding notches with a sheer member located therein between holding the parts together. Any similar attachment methods can be employed with the shaft 224 and either the spherical portion 332 or the peripheral lobe portion of the rotor 300.

As seen in FIGS. 20–23, the second section (power section) 232 of the casing 226 is preferably a unitary member and comprises a fluid entry region 380 and a fluid exit region 382. The second section 232 further has an inward region 381 and an outward region 383. The second section 232 has a radially inward surface 384 having a first sealing portion 386 and a second sealing portion 388. The sealing portions 386 and 388 define a diameter region that separates the entrance and exit regions 380 and 382 in conjunction with the outer contact surface of the power rotor 300. The second section 232 further comprises a base contact surface 390 and axially extending surfaces 392. The axially extending surfaces defined axial conduits 394. The axial conduits 394*a*–394*c* are located on the entry region 380 and allow communication between the outward region 383 and the inward region 381. The axial conduits 394*d*–394*f* are located on the exit region 382 and also allow communication between the inner and outer regions 381 and 383. The radially outward axial surfaces 396 defined axial conduits 398. The post portions 400 define radial conduits 402 that allow radial communication between the radially outward region and the radially inward region of the section 232. A center cylindrical surface 404 defines a center passage 406 adapted to allow shaft 224 to pass therethrough.

Figure 22:
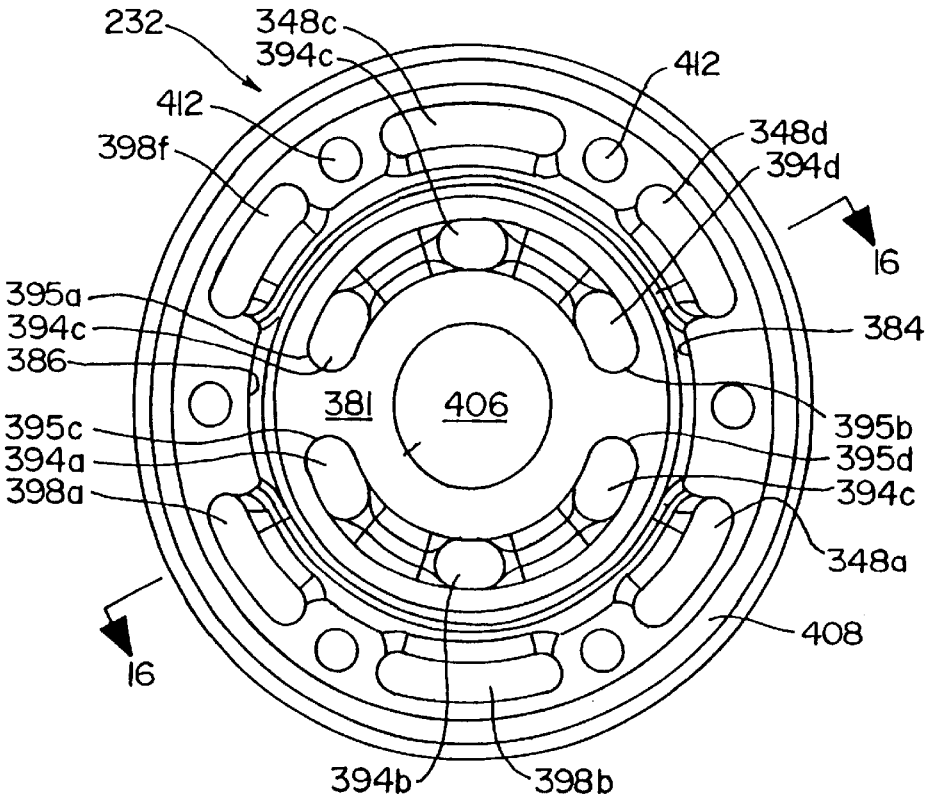
FIG. 22 is a top view of the inward portion of the power rotor casing.
Figure 23:
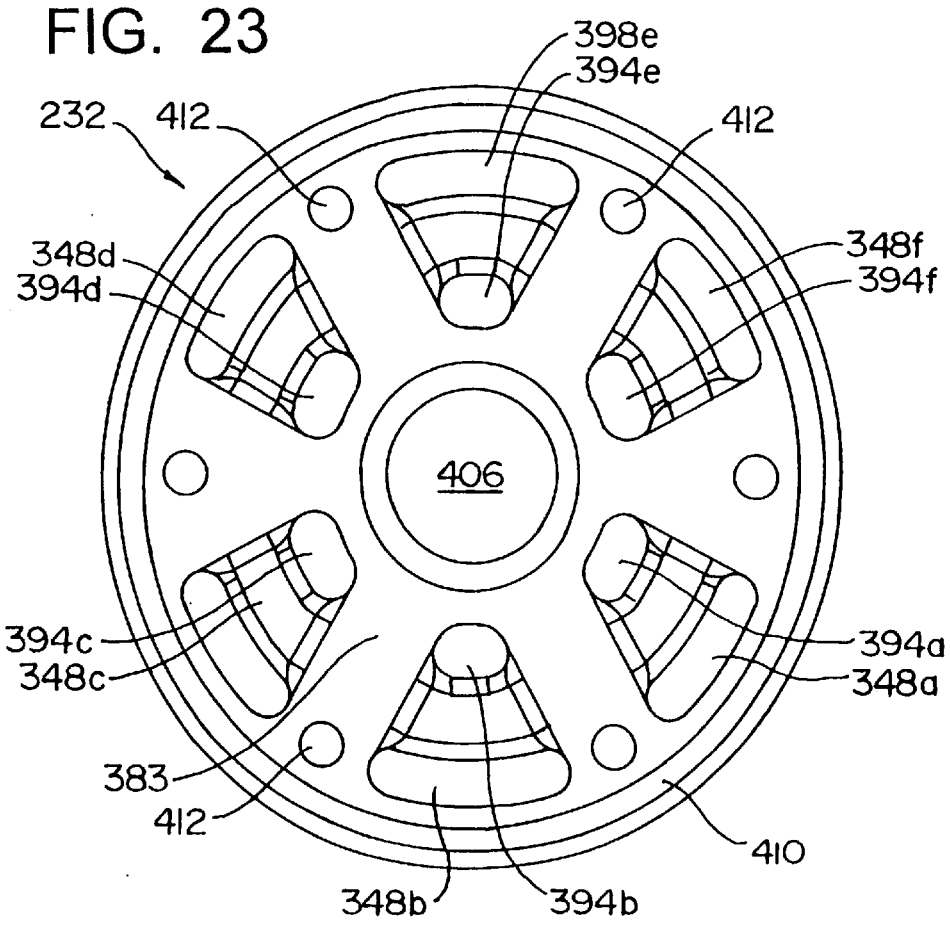
FIG. 23 is a rearview of the power rotor casing.

The axial ports 394 have end portions 395 that can be strategically aligned at certain degrees from the center of the section 232 in a manner to allow passage to the operating chambers of the rotor assembly 228 to rotationally balance a rotor therein about its axis of rotation (see FIG. 22). As shown in FIG. 18, the conduits 254 have end portions 259 that also can communicate the operating chambers of the rotor assembly 228 to supply communication to the operating chambers to the high and low pressure regions in a strategic manner to balance one of the rotors of the rotor assembly 228. Therefore, this balancing action could occur on either the section 232 or 230. In the preferred form, the slave rotor 302 is balanced about its longitudinal axis of rotation and the power rotor has a constant torque applied thereupon.

The shapes of the end portions 395 of the axial conduits can extend more radially where the radially extending end portions substantially lineup in a manner so maximum fluid flow occurs between the casing and the rotor to pressurized or depressurized the operating chambers of the rotor assembly. This allows the maximum fluid flow in a given amount of rotation of the rotor assembly.

The second section 232 further has an annular recess region 408 adapted to engage the annular extension 251 of the second section 232 and an annular extension 410 that is adapted to engage the annular recess region 426 of the cap 234. Further, a plurality of passageways 412 provide a passage of a bolt or connecting device to hold the casing portion 226 together. The passageways can be further used to allow axially extending conduits for conducting wires to pass therethrough. This is advantageous where the assembly 220 is used in a downhole pump and the driving electric motor is located below the assembly 220. Therefore, the electric wires providing electric current to pass-through conduits similar to or exactly like 257 and 412 to allow electric current to be supplied to a driving motor (not shown).

The final component used to comprise a casing portion 226 is the cap 234. To briefly review the assembly 220, the cap 234 is used in an in-series arrangement as shown in FIG. 15 and at the end portions of an assembly 220. The cap 470 as shown in FIG. 28 is employed for the in-parallel embodiment shown in FIG. 26. The primary distinction between the caps 234 and 470, is cap 470 allows communication between the sections 222 on the input region as well as the output region.

Figure 26:
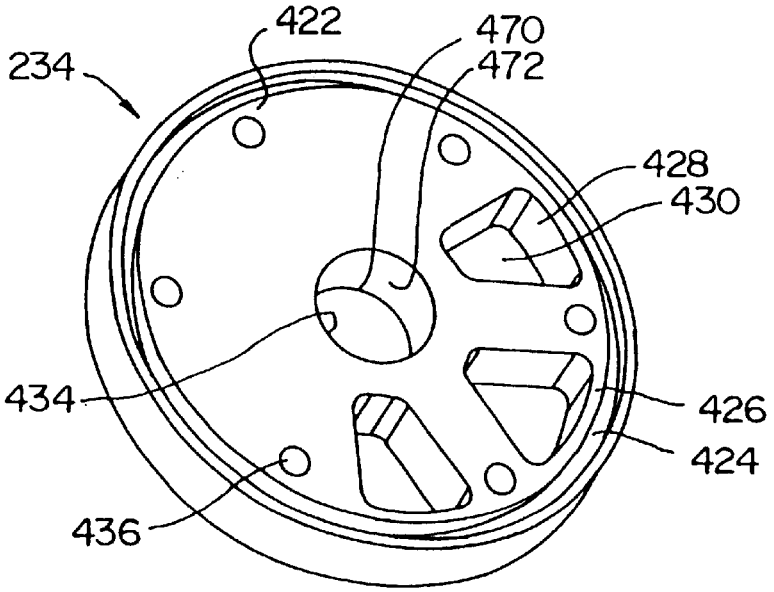
FIG. 26 is an isometric view of the cap employed in the fourth embodiment.
Figure 27:
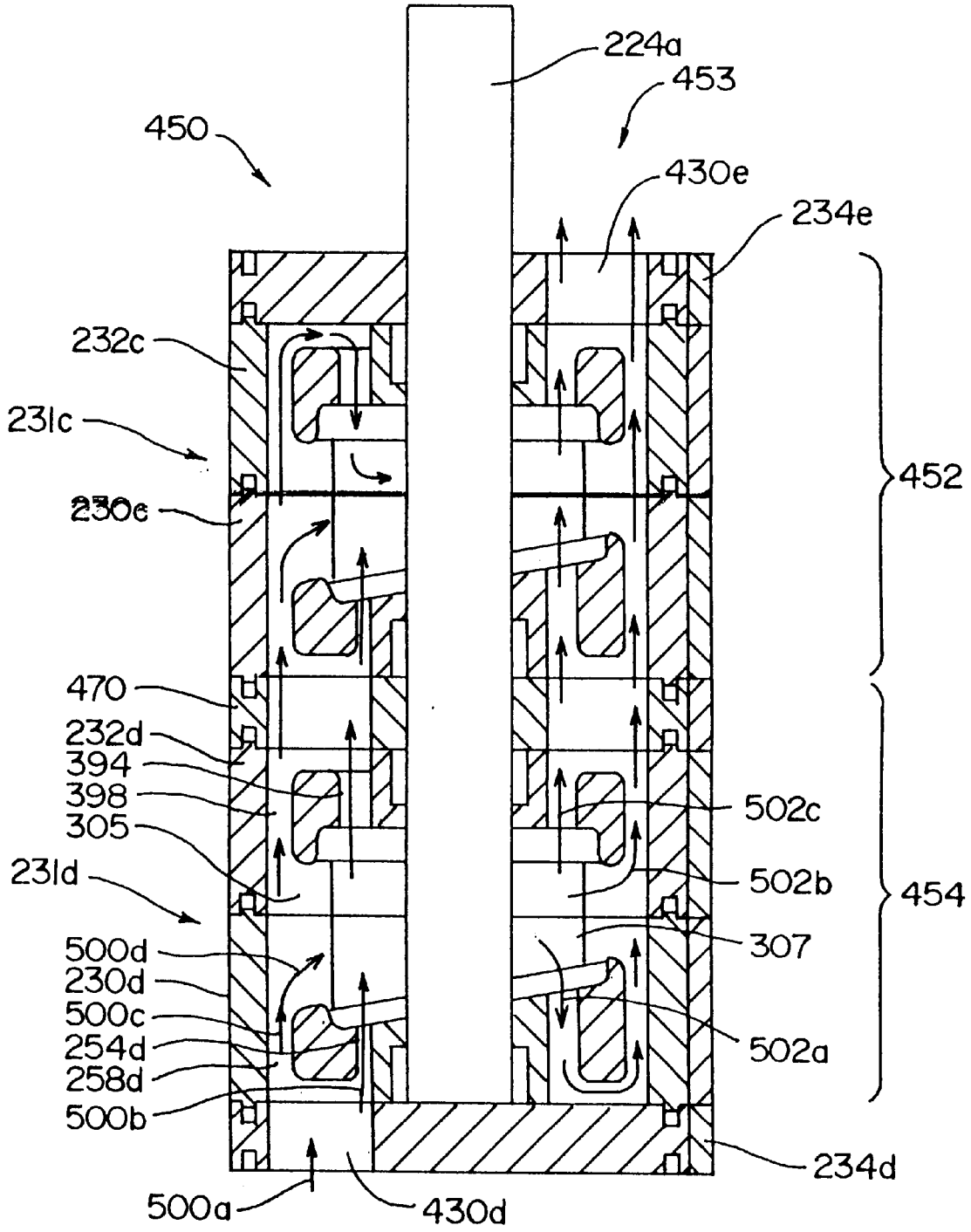
FIG. 27 is a horizontal sectional view of the fourth embodiment and a in-parallel arrangement.

The cap 234 as shown in FIG. 26 has a central region 420 and the peripheral region 422. Located in the peripheral region 422 is a peripheral surface 424 defining an engagement annular slot 426 that is adapted to engage the annular extension 251 and 410 of the first and second components 230 and 232. The longitudinally extending surfaces 428 define passageways 430. The passageways 430 allow communication between the exit and entrance regions of the conduits or passageways 254, 258, 394, and 398 of components 230 and 232. A cylindrical surface 432 defines a cylindrical opening 434 is adapted to allow the shaft 224 pass therethrough. The passageways 436 cooperate with passageways or conduits 257 and 412 of components 230 and 232 to allow bolts to pass therethrough to lock the rotor sections 222 together.

Now referring back to FIG. 15, there is shown two rotor sections 222*a* and 222*b*. To complete a functioning assembly 220, an additional cap 234*c* is attached to the lower portion of the assembly 220. The rotor sections 222*a* and 222*b* are substantially similar and out of phase one hundred and eighty degrees. This essentially means that two rotor sections 222 are retrieved and the outlet port 430 of the cap 234*b* is aligned in a manner to communicate with the inlet ports define as both conduits 254*a*–254*c* and 258*a*–258*c* of the first section 230.

Figure 17:
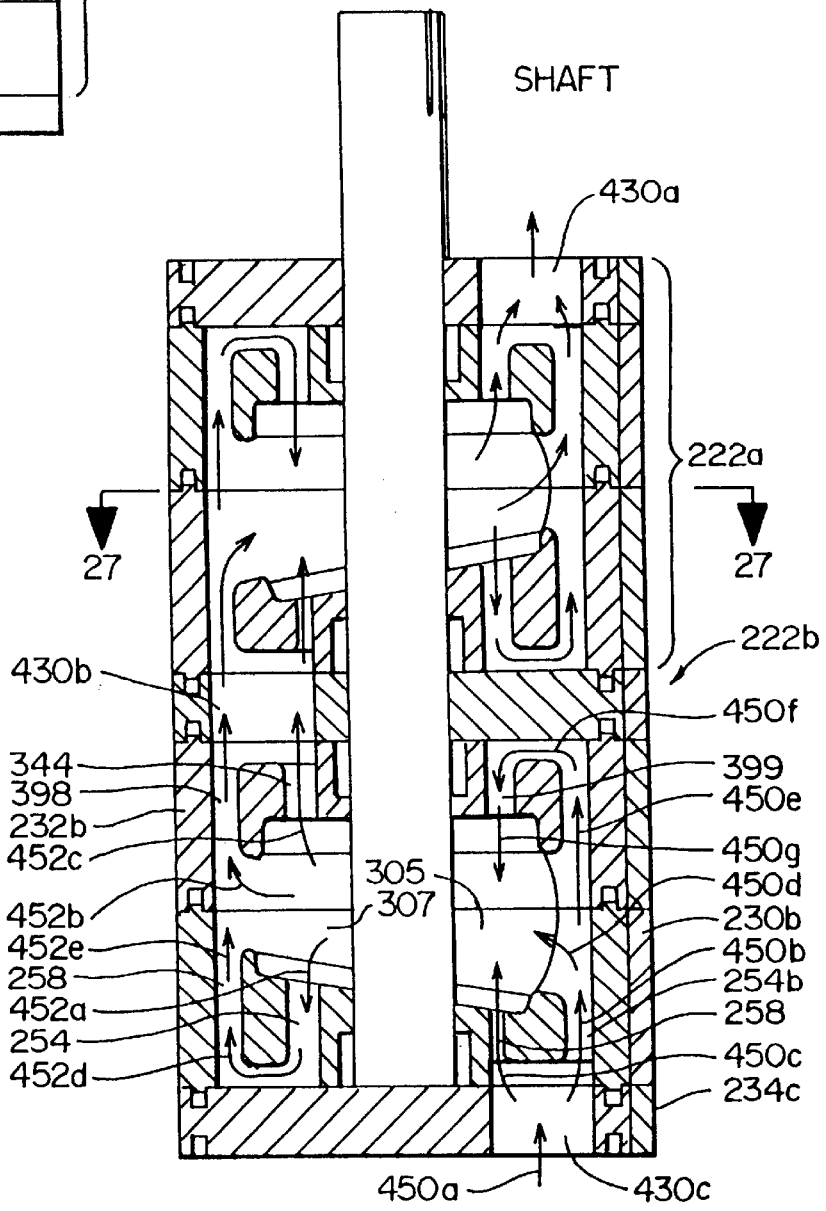
FIG. 17 is a cross-sectional horizontal view of the fifth embodiment taken at line 17—17 in FIG. 27, and illustrating the fluid flow through two rotor sections in a in-serial arrangement.

There will now be a discussion of the fluid flow through the assembly 220 in an in-series arrangement with reference to FIG. 17. The fluid flow is indicated by a plurality of arrows that illustrate the possible fluid pass that the operating fluid can take (rearward). It should be noted cross-sectional view shown in FIG. 15 is taken at line 15—15 in FIG. 22 where the cross-sectional view is not taken directly in line with the top dead center and bottom dead center of the rotor assemblies 228, but rather, the view is taken a few degrees counter clockwise to show the fluid flow through the radial conduits 262 and 402 of the first and second sections 230 and 232.

The pumping cycle begins with the fluid entering through the ports 430*c* and enters into the axial conduits 258*a*–258*c* indicated by arrows 450*a* and 450*b* on the fluid entry region 240 of the first section 230*b*. The fluid indicated by arrow 450*b* enters into the operating chambers 109 (shown in first embodiment) of the rotor assembly 228 (see arrow 450*d*) or the fluid travels upwardly through the axial conduits 398 indicated at 450*e* and around the radially extending open regions 262 and 402 indicated at 450*f* and through the axial conduits 394 and through the conduits 330 of the power rotor 300 (450*g*). Alternatively, the fluid enters through conduits 254*a*–254*d* indicated by arrow 450*c* and enters into the operating chamber 302 through conduits 362. It should be noted that for ease explanation the rotor assembly 228 is not shown in FIG. 17. However, the operations of the rotor assembly 228 is such that the expanding operating chambers 109 (see first embodiment) draw in the fluid and as the chambers pass the top dead center portion through the first sealing portion 246 the operating chambers began to positively displaced the working fluid as indicated by arrows 452*a*, 452*b*, and 452*c*.

It should be noted that in the preferred embodiment there are three paths of travel for fluid entering and exiting the operating chambers of the rotor assembly 228; however, a functional version could use any of the conduit paths indicated by arrows 450*c*, 450*d*, or 450*g* for entering the operating chamber of the rotor assembly 228 and could use any combination of exit passage is indicated by arrows 452*a*, 452*b*, or 452*c*.

The first exit passage from the operating chamber indicated by arrow 452a passes through the conduits 362 of the slave rotor 302 (not shown in FIG. 17) and through the axial conduits 258*e*–258*h* (the axial conduits on the fluid exit region 242 of the first section 230). The fluid then passes through radial conduits 262 and 402 indicated at arrow 452*d* and up through axial conduits 254*e*–254*g* (see arrow 452*e*). The second exit path indicated at arrow 452*b* exits radially outwardly between the upper radial slots, conduit or passage 262 of the first section 230*b* and through the lower radial slots and 402 of the second sections 232*b*. The fluid 452*b* then joins with the fluid indicated by arrow 452*e* and travels upwardly through axial conduits 398*d*–398*f* on the fluid exit region 382 of the second section 232*b*.

Finally, the third path for the fluid exiting the operating chambers as the rotor assembly 228 rotates and positively displaced as the fluid contained therein has indicated by arrow 452*c*. For this flow schema, the fluid exits the conduits 330 of the power rotor 300 and passes through axial conduits 394 of the second section 232. Finally, all the fluid exits through port 430*b*.

Therefore, all of the fluid that enters through port and 430*c* eventually exit through port 430*b*. The fluid flow through rotor sections 222*a* and is exactly the same as the fluid flow through rotor section 222*b* except the entire rotor section 222*a* is rotated one hundred and eighty degrees about the longitudinal axis of the shaft 224 and the fluid enters the entrance region 305 of the rotor assembly 228 and exits out the exit region indicated at 307 and exits through 430*a*.

It should be noted that the shaft 224 does not have to extend through the slave rotor or slave rotor casing in a single stage design or at the very end of the multistage design.

There will now be a discussion of the in-parallel version of the fourth embodiment with reference to FIG. 27. The assembly 450 comprises a first rotor section 452, a second rotor section 454, the cap 234*d* and the shaft 224*a*. The in-parallel flow assembly 450 has a low pressure region 451 and a high pressure region 453. The low and high-pressure regions 451 and 453 are separated by the vertically extending plane defined by the diameter 484 of the cap 470.

In general, the in-parallel embodiment uses the same first and second sections 230 and 232; however, a modified cap 470 as shown in FIG. 28. The cap 470 essentially allows fluid passage through two sets of ports 478 and 482 to enable parallel fluid flow as described further herein.

As seen in FIG. 28, the cap 470 has many of the same components as the cap 234 having a central region 472 and a peripheral region 474. A first set of longitudinally extending surfaces 476 defined a first passageway 478. A second set of longitudinally extending surfaces 480 define a second passageway 482. The cap 478 has a diameter indicated at 484 which defines a first portion 486 on the left-hand side of FIG. 28 and a second portion 488 located on the right hand side. It is important to note that the first and second passageways 478 and 482 are located on either the first or second portions 486 or 488. Although shown in FIG. 28 three separate ports comprising two passageways 478 and 482, the important aspect of the cap 486 is that the passageways on the first and second portions 486 and 488 do not communicate with one another in order to provide a pressure differential from the incoming and outgoing a fluid described further herein.

Now referring to FIG. 27, the assembly 450 has a first rotor section 452 that is the same as the rotor section 222*a* as shown in FIG. 17. Further, the cap 234*d* is the same as cap 234 as shown in FIG. 26. However, the cap 470, also referred to as an interior cap, is positioned between the base housing 231*c* of the first rotor section 452 and the base housing 231*d* of the second rotor section 454 (also referred to as an interior rotor section 454). The rotor sections 452 and 454 are collectively referred to as a parallel assembly 455.

There will now be a discussion of the parallel fluid flow through the assembly 450. FIG. 27 discloses two rotor sections 452 and 454. However, as will be come readily apparent herein, a number of interior rotor sections 454 can be employed increasing the volumetric flow throughput of the assembly 450. Further, as described further herein, the in-combination assembly utilizes an arrangement of base housings 231, rotor assemblies 228 and caps 234 and 470 to create a combination of parallel flow and serial flow therethrough.

As shown in FIG. 27, the fluid enters through the passageway 430 and this fluid flow as indicated by arrow 500*a*. A portion of this fluid indicated by arrow 500*b* enters through axial conduits 254*d* and through the conduits 362 of the slave rotor 302, and the rest of the fluid travels through the axial conduits 258*d* indicated by arrow 500*c*. A portion of this fluid 500*d* enters the operating chambers (see 109 of first embodiment) of the rotor assembly 228 and enters the high-pressure region at 453 of the assembly 450.

The portion of the fluid that passes to the high-pressure region 453 exits the operating chamber through arrows indicated at 502*a*, 502*b*, and 502*c*. The exit paths are similar to the exit paths indicated by arrows 452*a*, 452*b*, and 452*c*. The remainder of the fluid passes through axial conduits 398 and 394 and pass through the passageways 478 of the cap 470. Thereafter, the fluid passes through the rotor assembly of rotor section 452 in a similar manner as the rotor section 454.

On the high-pressure side of the assembly 450, the fluid exiting the rotor assembly of the rotor section 452 mixes with the discharge fluid from the rotor assembly 454 and the entire fluid exits through passageway 430*e* of the cap 234*e*. Thereafter, the fluid is transported to the desired location at a higher pressure than as it entered through passageway 430*d* of cap 234*d*.

Figure 29A:
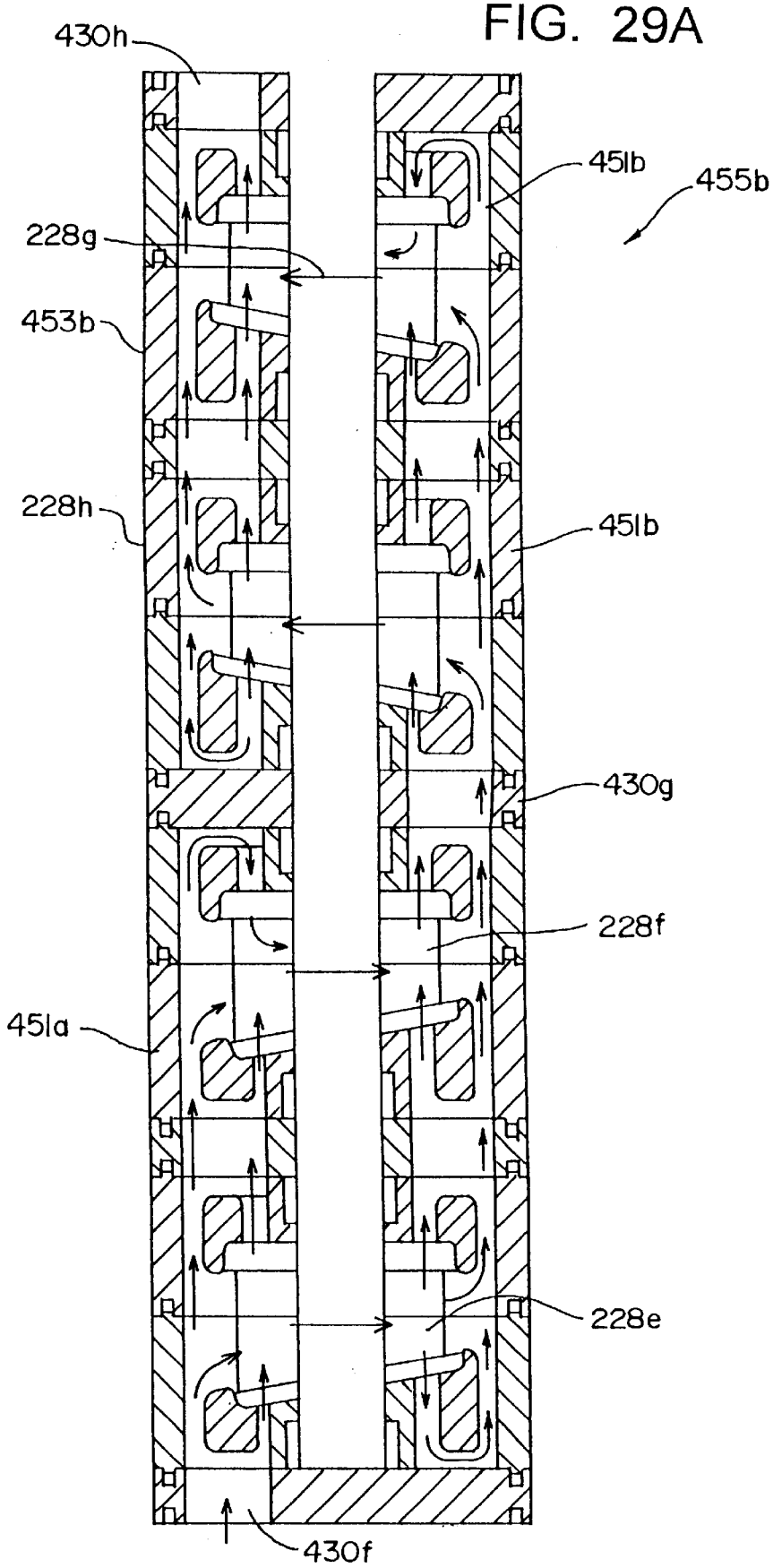
FIG. 29A shows an in-combination flow arrangement.

With the foregoing in mind, it can be appreciated that two parallel assemblies are retrieved and stacked upon one another with the shaft 224 passing therethrough the center portion as shown in FIG. 29*a*. The parallel assemblies 455*a* and 455*b* are stacked upon one another in a manner so the fluid entering through passageway 430*f* passes through the rotor assemblies 228*e* and 228*f* to the high-pressure region 453*a* of the parallel assembly 455*a*. Thereafter, the fluid passes through passageway 430*g* to the low-pressure region 451b of the second parallel assembly 455*b*. The fluid passes through the rotor assemblies 228*g* and 228*h* to the high-pressure zone 453*b* and thereafter exits through passageway 430*h*. It should be noted that that the high-pressure and low-pressure zones 451 and 453 are located on opposite sides of each successive stage for each parallel assembly stage.

Figure 29B:
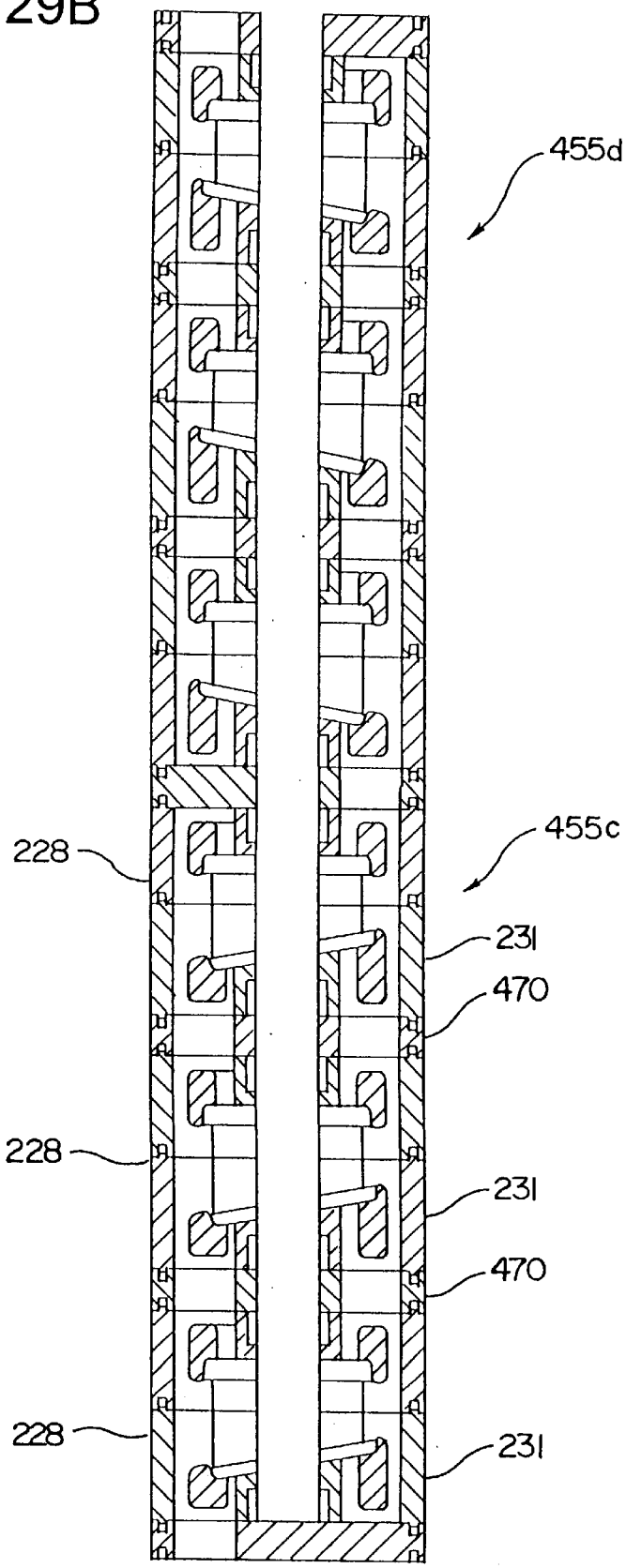
FIG. 29B shows an in-combination flow arrangement where three rotor sections are shown in an in-parallel flow arrangement followed by an additional three parallel rotor sections positioned in-serious.
Figure 30:
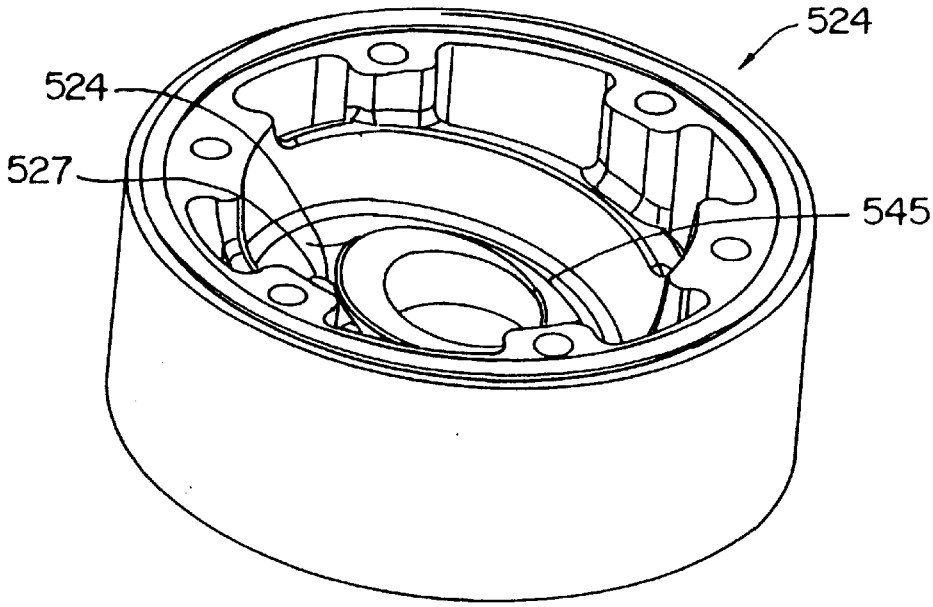
FIG. 30 is an isometric view of a slave casing section.
Figure 31:
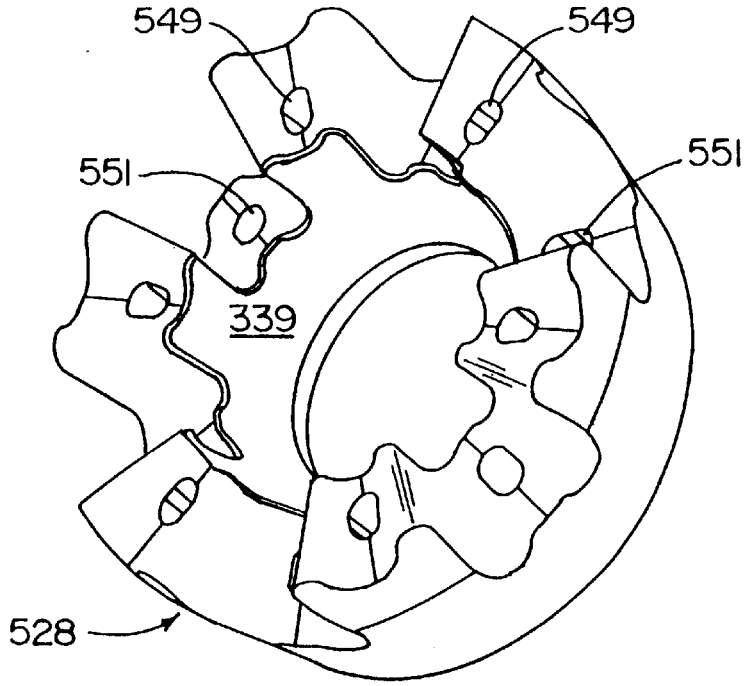
FIG. 31 is an Isometric view of the forward portion of the slave rotor.

FIG. 29*b* shows a parallel assembly 455*c* and 455*d* where three rotor assemblies 228 are employed with two caps 470 are positioned between the three base housings 231 for each parallel assembly 455*c* and 455*d*. Of course, any number of intermediate casing portions 227 (comprising a first and second sections 230 and 232) can be employed to create a multi-rotor combination parallel and in series flow arrangement. A parallel section is defined as any integer number of rotor sections aligned in a parallel flow configuration.

It is important that there is a consistent volumetric flow for each parallel flow configuration aligned in series for each parallel flow assembly to do the approximate same amount of work. Therefore, if each rotor assembly has a similar angle $\alpha$ and hence having the same fluid displacement per rotation, each in-serious parallel flow configuration will have the same number of rotor section 222. However, if the angle a is increased in a rotor assembly 228 in a rotor section to increase the operating chamber size and hence increase the volumetric flow for rotation, a less number of rotor sections would be required in that parallel flow assembly with respects to the other parallel flow assemblies with smaller angles $\alpha$.

As shown in FIGS. 30–40, a fifth embodiment of the present invention is shown. In general, this embodiment allows a balancing about the slave radial transverse axis indicated at 530.

Figure 33:
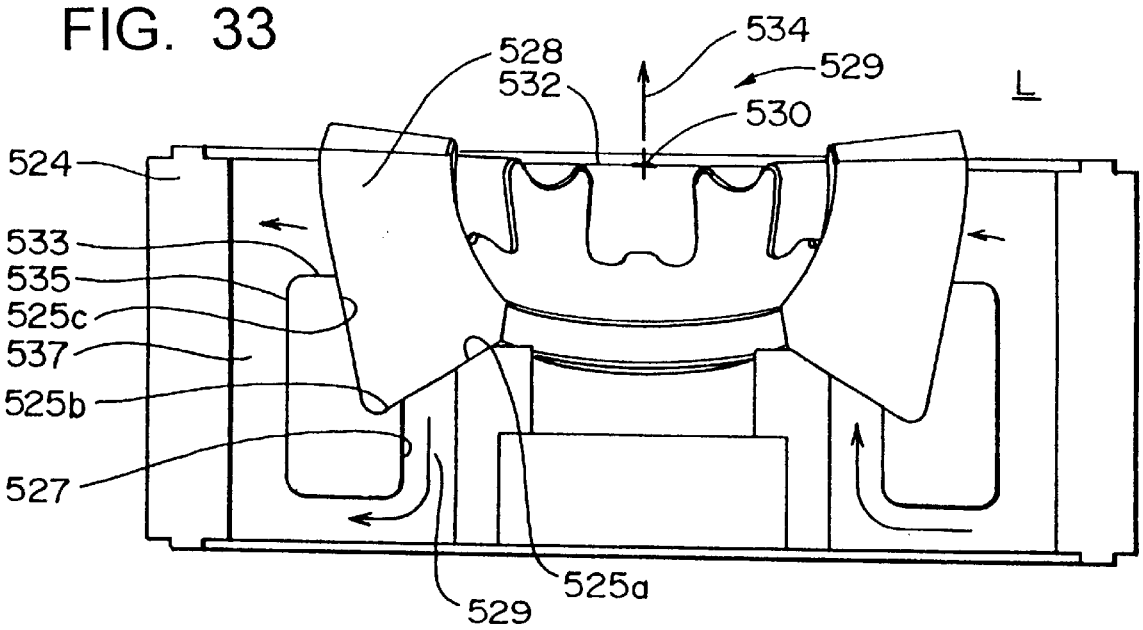
FIG. 33 is a cross-sectional view of an angle back face rotor assembly taken at line 33—33 in FIG. 42.

As shown in FIG. 33, the assembly 520 comprises a rotor assembly 522 and a casing 524. The rotor assembly comprises a power rotor 526 and a slave rotor 528. Only the slave rotor is shown for exemplary purposes where the balance about the transverse axis also applies to the power rotor. The assembly 520 has an axis system 529 comprising a slave radially transverse axis numerals 530, a slave lateral axis 532 and a slave vertical axis 534. The axis system 529 intersects at a centerpoint indicated at 530 which coincides to the center of rotation of the slave and power rotors 528 and 526. As shown in FIG. 33, there is shown in a cross-sectional view where a portion of a slave rotor 528 where on the left-hand portion of the vertical axis 534 is a high-pressure zone indicated at "H" and on the right hand portion is a low pressure zone indicated by "L".

The casing 524 comprises a first section 524*a* and a second section(not shown). The first and second sections are very similar to the section 230 and 232, except the base surface 545 has a different radially outward slope to support the surface 544 of the slave rotor (see FIG. 30). The first section 524*a* comprises an annular base 529 and a plurality of radial connectors 529a and 529*b*. The annular base 529 has a base surface 545 adapted to engage the base surface 544 of the slave rotor 528 and as shown in FIG. 33, the base surface 545 comprises a radially inward portion 525*a*, a radially outward portion 525*b*, and an outward surface 525c. The annular base 529 further has an upper surface 533 and a radially outward surface 535. The longitudinally extending surfaces 537 on the radial connectors 529*a* define radially inward passageways 539. Likewise, the upper surface 533 and the radially outward surface 535 comprise a passage 537.

Figure 42:
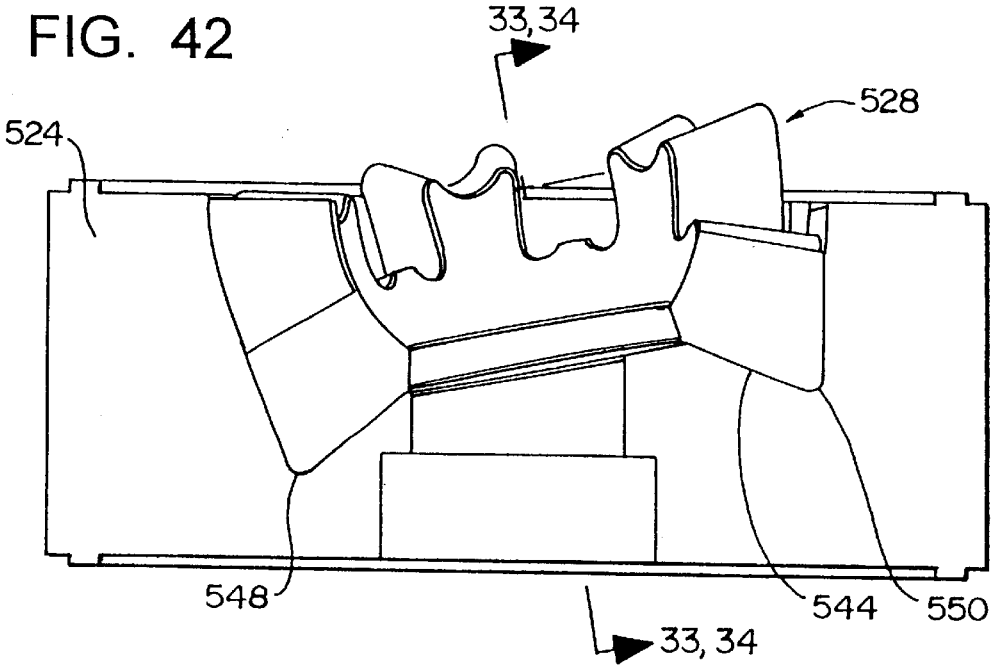
FIG. 42 is a side cross-sectional view of a slave rotor.

FIG. 42 shows a side view of the slave rotor taken in the slave radially lateral direction, where the radially transverse portion referred to as the top dead center (TDC) portion 548 is located on the left-hand portion of that figure. On the diametrically opposed region, the bottom dead center (BDC) portion the 550 is located. As referred to above, the bottom dead center portion 550 is the region where the operating chamber is enclosed and at a minimum volume. Likewise, the top dead center portion 548 indicates a location where a operating chamber is at a maximum volume.

The slave rotor 528 and the power rotor 526 are substantially similar and hence base surface 544 of the slave rotor will be described in detail with the understanding the specification is relevant and applies to the power rotor as well.

The slave rotor 528 comprises a plurality of lobes 542 that have the properties which are is very similar to the lobes discussed above. However, the base surface 544 is angled with respects to the radial axis. Further, the outward surface 531*c* is angled with respects to the slave longitudinal axis 534. For purposes of explanation, the base surface on the high-pressure side is referred to as 544H and the base surface on the low-pressure side is referred to as 544L.

Figure 32:
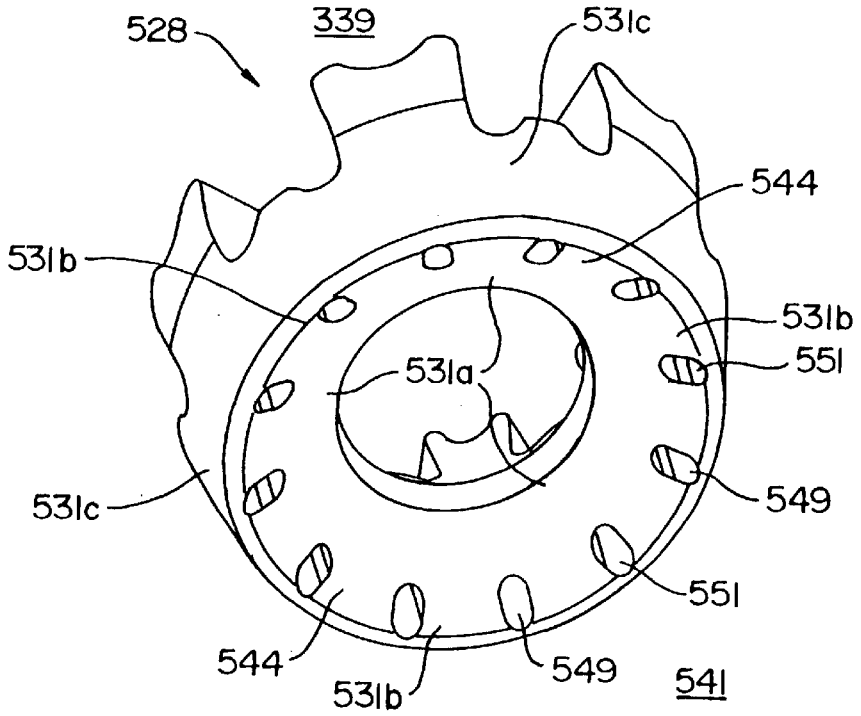
FIG. 32 is an isometric view of the rearward portion of the slave rotor.

As shown in FIG. 32, base surface 544 has a radially inward portion 545 and a radially outward portion 547. The longitudinally extending conduits 549 allow passageway between the inward region 339 and the outward region 541 and extending through the lobe portions and the base regions respectively.

Figure 35:
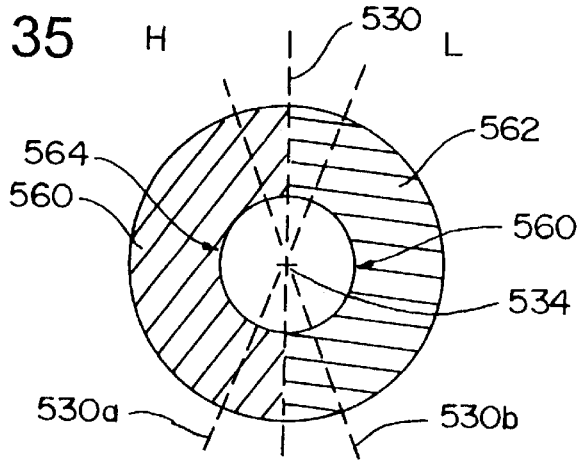
FIG. 35 is a schematically top view of the mean surface area acting upon a rotor in the radial plane.

In order to best understanding the balancing of the slave rotor 528, reference is made to FIG. 35 which is a top view schematically shown in the cross-sectional of the slave rotor in the slave longitudinal direction. The area indicated by 560 which is located in the slave radial plane, indicates the average high-pressure surface area acting upon the slave rotor in the radial plane. Likewise, the area 562 represents the radial plane of the low pressure region of the slave rotor. In operation, as the rotor assemblies rotate the high-pressure zones would shift about the axis 530*a* and numerals 530*b* depending upon the position of the chambers with respects to the sealing surface (see FIGS. 10*a*–11*e*). The average force acting in the slave longitudinal direction as a result of the pressure in the high-pressure region multiplied by the surface area 560 is indicated by force vector 564. Likewise, the average forces acting in the slave longitudinal direction that is a product of the pressure in the low-pressure zone multiplied by the surface area 562 results in a force vector 566.

Figure 34A:
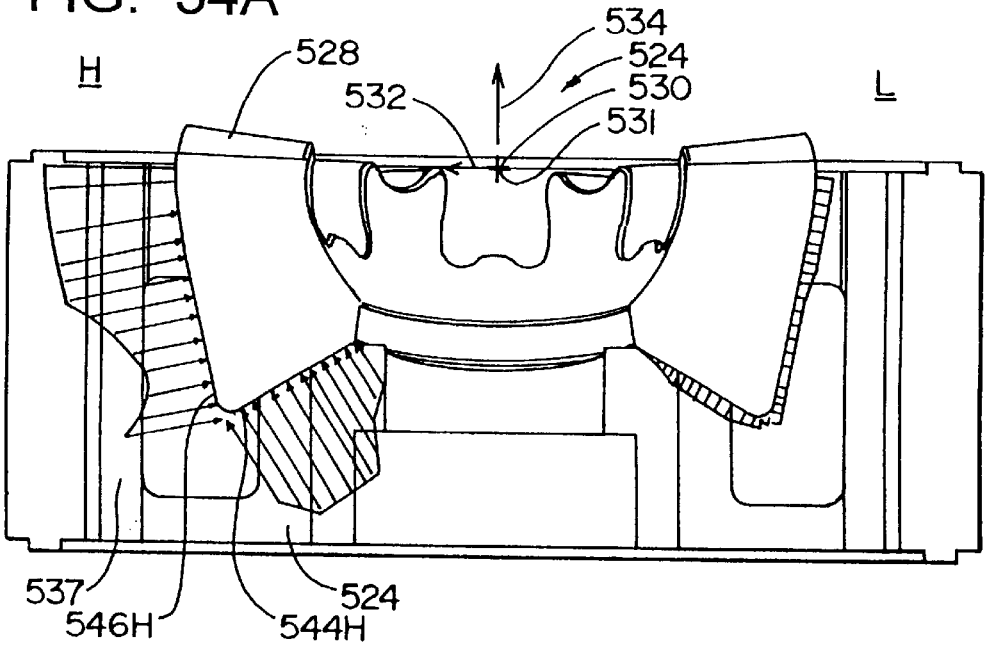
FIG. 34A shows a pressure distribution acting upon the rotor taken at line 34—34 in FIG. 42.
Figure 34B:
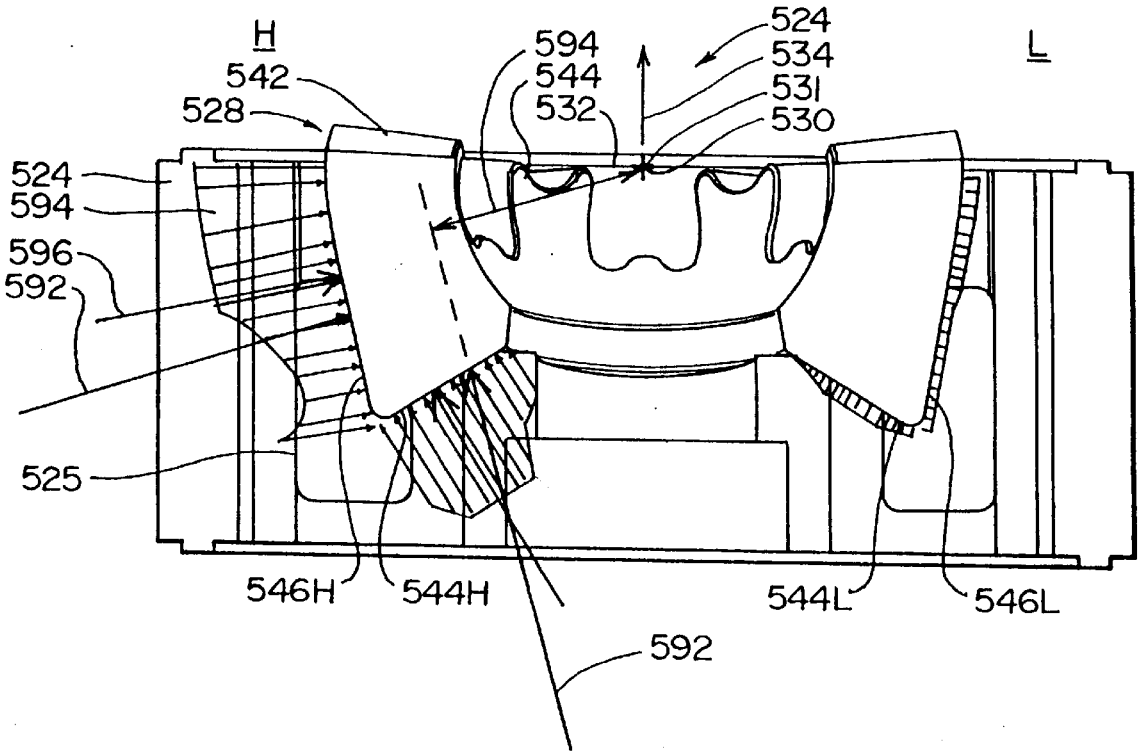
FIG. 34B shows a resultant force acting upon the rotor taken at line 34—34 in FIG. 42.
Figure 36:
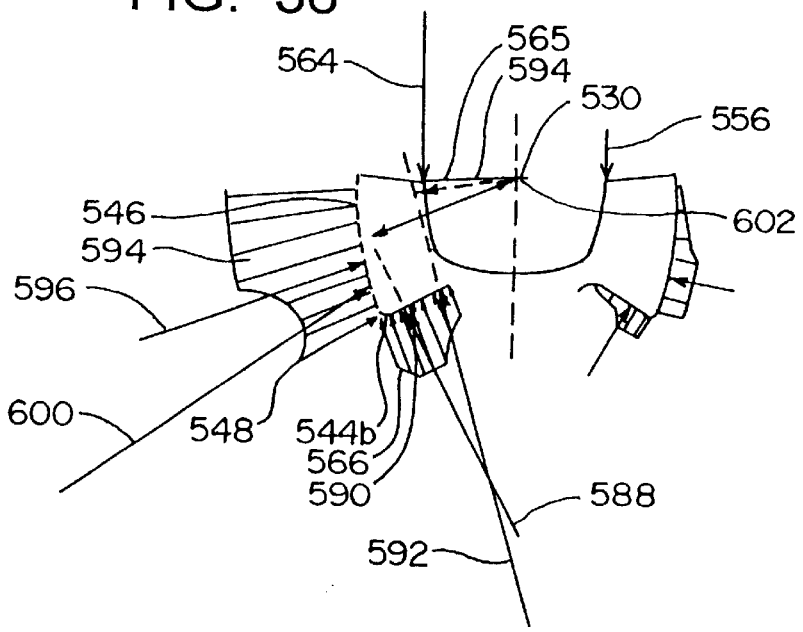
FIG. 36 is a schematic sectional view illustrating the pressure distribution upon a rotor.
Figure 38:
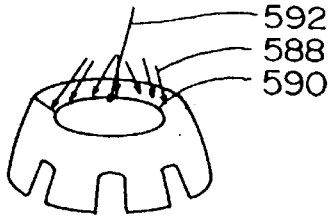
FIG. 38 is a bottom view of a rotor showing the resultant force acting upon the rotor.

As shown in FIGS. 34 and 36, the mean pressure acting upon surface 544*b* is indicated at 566. The mean force vector 588 is the sum of the area 566 multiplied by the pressure to get the mean force acting upon the line 589 (see FIG. 40). The force vector 588 actually acts upon the annular line 590 as shown in FIG. 38. Therefore, the force vectors 588 (an infinite number of two dimensional force vectors acting upon annular line 590) are summed and indicated by force vector 592 the force vector 592 is a perpendicular distance from the transverse axis 530 a distance indicated at 594 (see FIG. 34).

Figure 39:
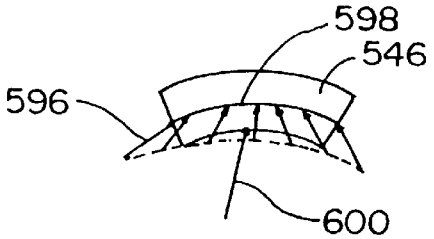
FIG. 39 illustrates the resultant force acting upon the outer surface of a rotor.

The pressure acting upon outward surface 546 is indicated by pressure distribution 594. The sum of this pressure multiplied by the surface area is indicated by force vector 596 acting upon annular line 598. In a similar analysis as force vector 588, as shown in FIG. 39, the force vector 596 is an infinite number of vectors acting upon the annular line 598. The sum of the factors acting upon the line is a resultant vector 600. The resultant vector is a perpendicular distance from the transverse axis 530.

With the foregoing vectors in mind, namely 564, 592, and 600, a moment analysis about the transverse axis 530 can be conducted. It is a well-known in engineering disciplines that a moment is a force times a perpendicular distance about a point or axis. For our analysis we will be concerned about the forces acting in the plane defined by the slave radially lateral axis and the slave longitudinal axis about the slave radially transverse axis 530 (which extends straight out of from the page in FIG. 33*b*). The force vector 592 which only has axial components in the slave radially lateral direction and the slave longitudinal direction is a distance 594 from the slave radially transverse axis 530. Therefore distance 594 multiplied by force vector 592 creates a clockwise moment about transverse axis 530. The resultant force vector 564 acts substantially downward in the slave longitudinal axis and is a perpendicular distance 565 from the transverse axis 530 and the product of distance 565 and force vector 564 results in a moment in the counter clockwise direction.

Figure 37:
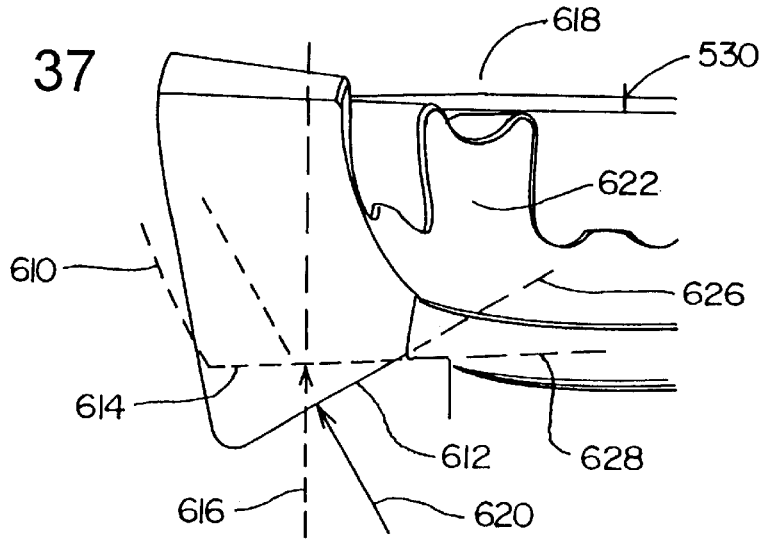
FIG. 37 illustrates the resultant force based upon the pressure and surface area orientation and the advantageous rotation about the centerpoints of the rotor.

To understand the balanced improvements of the conical surface 544, reference is now made to FIG. 37 where there is shown a rotor 610 having a conceptual base surface 614 and a conceptual base surface 614 is similar to the base surface 544 of the rotor 528. If the rotor 610 adopted the surface 612, the resultant force based upon the pressure in surface area would be aligned somewhat close to force vector 616. By extending the line of force of force vector 616 is shown the perpendicular distance about the slave radially transverse axis 530 is indicated at 618. However, by having a base surface 614, a resultant force 618 is produced and the perpendicular distance from the line of force of vector 620 is indicated at 622. It is graphically shown in FIG. 37 that distance 622 is greater in length then distance 618. Therefore, the surface 614 will inherently create a greater moment about the slave radially transverse axis 530. A similar analysis can be conducted with resultant force vector 600. The angle of the conical backface 544 where it slants rearwardly with respects to the radial plane of the rotor with respects to traveling radially outwardly is referred to as a positive angle or positive conical angle. Further, the corresponding angle of the back face 525 is referred to as a positive angle or positive conical angle.

It should be reiterated that the base surface 544 analysis is relevant to the power rotor 542 about the reference axis for the power rotor (e.g. the longitudinal power axis, the power radially lateral axis, and the power radially transverse axis). It is very desirable to have the counteracting moment resulted from the pressure acting upon the base surface 544 to prevent unnecessary wear thereon.

Figure 37B:
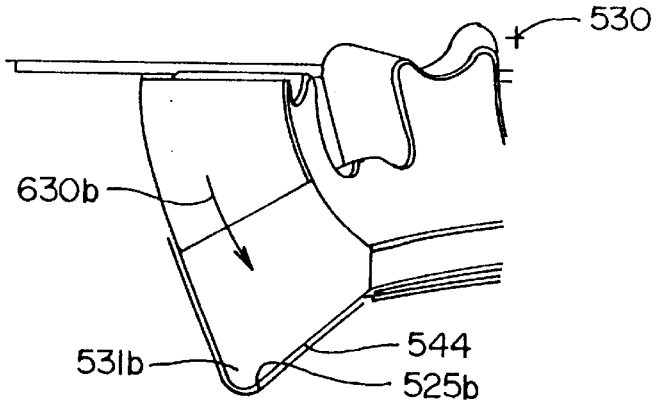
FIG. 37A and FIG. 37B illustrate the benefits of having the tapered back face where an even where is more likely to occur.
Figure 37A:
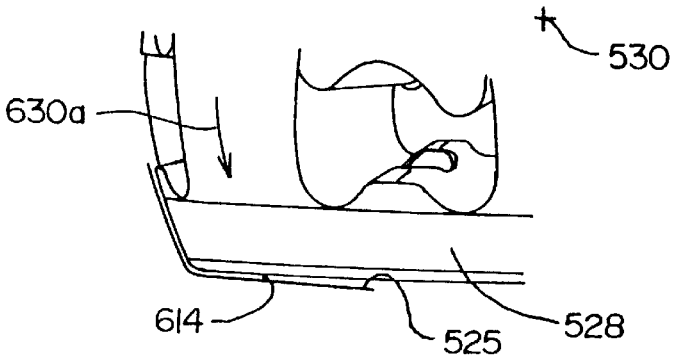

The second benefit of having the base surface 544 a tapered back face where it is angled with respects to the radial location, when the force vector 564 applies a moment about the slave radially transverse axis 530, the base surface 525 is better adapted to handle this rotation than a flat surface 525 as shown in FIG. 37*a*. As seen in FIGS. 37, 37*a*, and 37*b*, the extension 626 of surface 612 is closer to the slave radially transverse axis 530 than the extension 626 of the mean plane of surface 612. Therefore, the surface 614 is better adapted to evenly distributed the pressure along surface 614. As shown in FIG. 37*a* it can be shown that the rotating action of the rotor 528 about the transverse axis 530 will cause the radially outward portion 547 to hit the radially outward portion of the casing first causing additional wear at this location for the rotor and the housing. Now referring to FIG. 37*b* it can be appreciated that as the rotor 528 rotates in a manner indicated by arrow 630*b* the surface 614 is better adapted to evenly distribute pressure thereupon upon the base surface 525. In other words, the distance separating between the surfaces 614 came and 525 are substantially uniform (at least much more than in FIG. 37*a*) with respects to the distance radially outward from the transverse axis 530.

A further advantage of having a tapered back face as shown in FIG. 37*b* is that a greater surface area extending from the central shaft is created allowing a result of force greater force acting about the transverse axis 530.

It is desirable to have a mean surface angle for surface 544 with respects to the plane defined by the longitudinal axis (the plane in the radially lateral and radially transverse axis) an angle between 10–50 degrees. A more desirable angle would be in the range between 20–40 degrees. The preferred angle is in the proximity of 30 degrees with respects to the plane defined by the respective longitudinal axis (for the power or slave rotor respectively).

Figure 40:
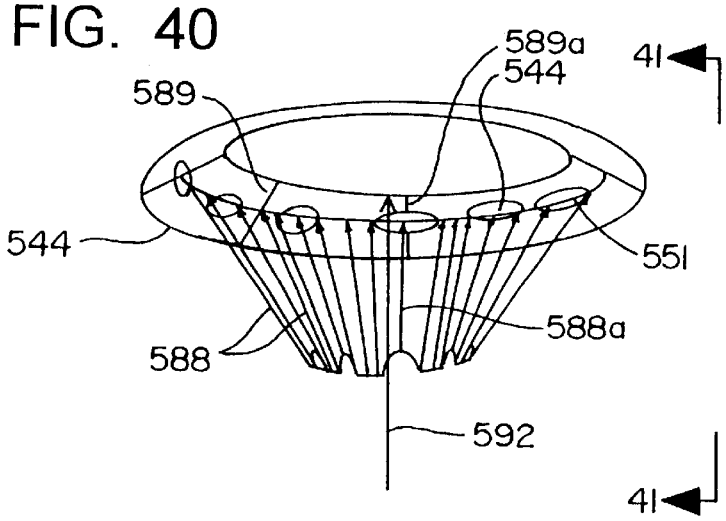
FIG. 40 shows the tapered back face surface of a rotor with a plurality of conduit openings and the force distribution thereupon.
Figure 41:
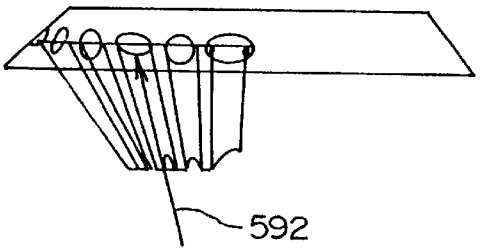
FIG. 41 is a side view showing the high-pressure side of a tapered back face illustrating a resultant force acting thereupon.

FIG. 40 shows a more inclusive method of calculating resultant force vector 592. As mentioned previously, the force vector is 588 are a summation of the pressure force along the surface 544 and radial lines 589. For example, the force vector 588*a* is of lower magnitude then the adjacent force factors. This is because the pressure line 589*a* is of smaller magnitude because the passes therethrough the conduits 549 and 551 of the surface 544. The resultant force vector 592 extends in the longitudinal slave axis and slave radially lateral axis directions at the approximated angle shown in FIG. 41 of course the pressure acts upon the axial conduits of the rotors.

The there is force vectors disclosed in the preferred embodiment are for exemplary purposes illustrating the fundamental concepts of having a desirable tapered conical back face. The force vectors are for explanation purposes so the reader may better understand the fundamental concepts. The force vectors are no way intended to limit the invention whatsoever, but rather are intended for an analysis to appreciate the moment that is created about the transverse axis 530. It should be reiterated that the exact position and magnitude of the force vectors will alter with respects to certain degrees of rotation of the rotors and various pressure differentials between the high-pressure port and the low-pressure port; however, the figures disclosed are intended to illustrate the general aspects of having the conical backspace 544.

Figure 43:
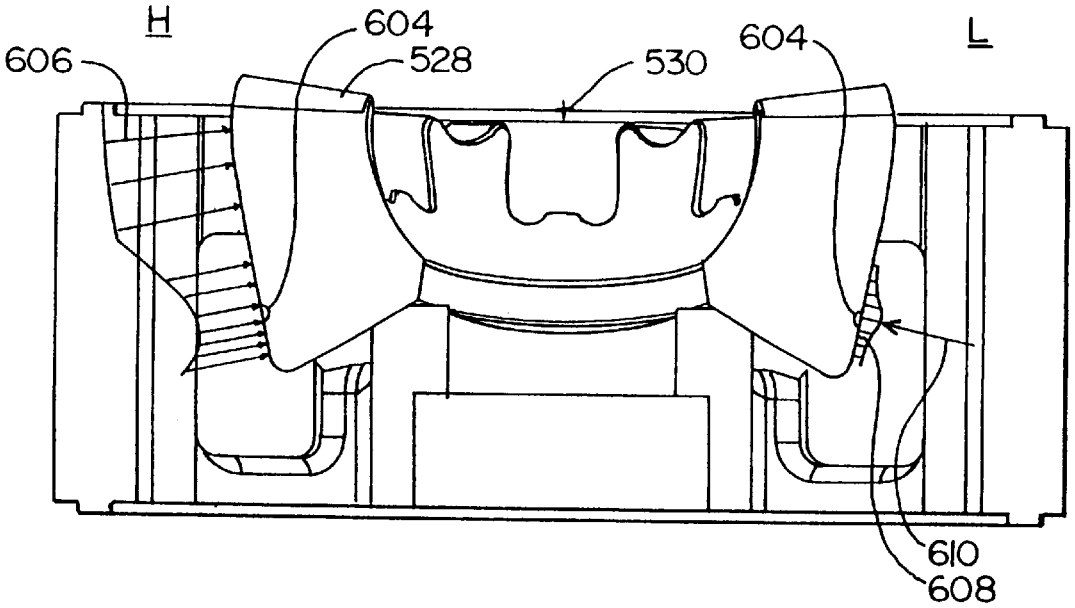
FIG. 43 is a front cross-sectional view of a rotor with and annular recessed portion to allow a high-pressure distribution on the low-pressure side of the rotor.

FIG. 43 shows an adaptation to the fifth embodiment where an annular notch portion 604 is removed from the rotor 528. This embodiment allows fluid to annularly pass around the rotor 528 to create a high-pressure resultant force 610. As shown on the high-pressure side "H" the conduit 604 will pass a portion of the high-pressure distribution 606 annularly around to create a high-pressure distribution 608 on the low-pressure "L" portion. A resultant vector 610 is a product of the surface area of the rotor multiplied by the mean pressure distribution 608. This resultant vector 610 is desirable for certain pressure schemes where a counter torque about the radially transverse axis 530 is desired.

It should be noted that the slave rotor is not supported by exterior bearings it is supported by the ball on the power rotor, or it could have a ball that is supported by the concave spherical inner surface of the power rotor. Therefore, the ball, the power rotor, and the housing support the slave rotor in various combinations. Additionally, there could be support bearings upon a shaft of a slave rotor that supply partial anti-rotational support about one of the radial axis. Alternatively, a thrust bearing about the base surface could be employed.

The various components discussed above could have a Teflon coating or any conventional coating to reduce friction or has desirable wear characteristics where the contact portions of the various components slide upon one another are subject to a coating procedure. The various components can be produced by a CNC machine or cast from a mold.

Figure 44:
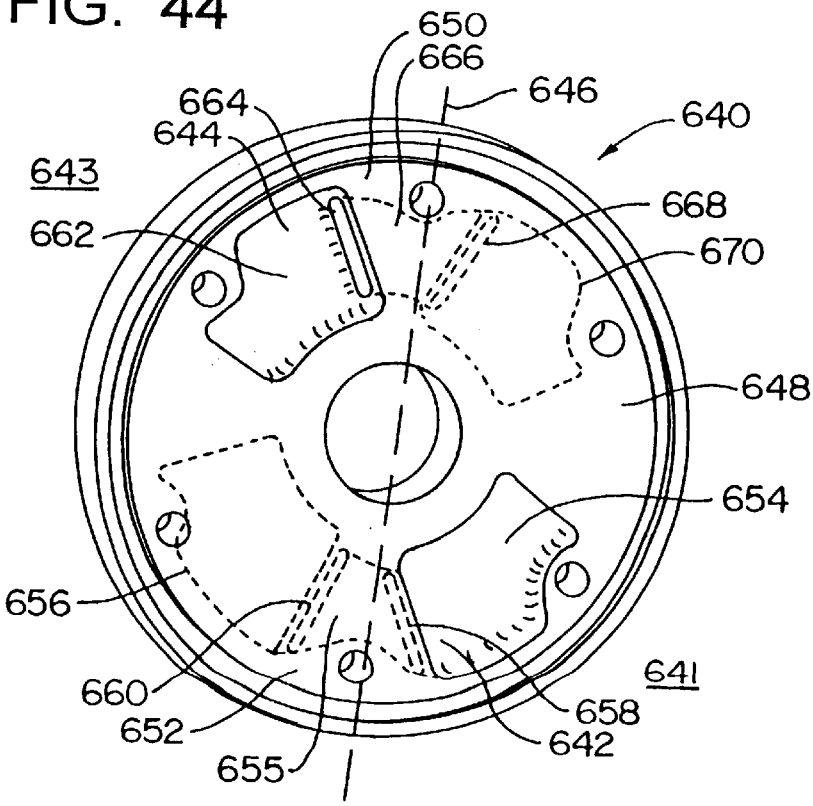
FIG. 44 is an isometric view of an end cap that allows an in-parallel flow combination to have the rotor sections be inverted one hundred eighty degrees about the shaft.

As shown in FIG. 44, the cap 640 discloses an alternative method of directing the flow between rotor sections 222. In general, this cap allows an in-parallel flow between rotor sections with the advantage of offsetting the radially lateral force upon the shaft 224 (discussed further herein below). The cap has a first longitudinal region 641 and a second longitudinal region 643. The cap 640 is similar to be previous caps 232 and 470 with the exception the cap 640 has a first passage system 642 and a second passage system 644. The cap has a transverse axis 646 that separates the high pressure side and the low-pressure side. The front surface 648 has contact surfaces 650 and 652 adapted to engage the upper and lower surfaces of the sections 230 and 232 to provide a seal from the high pressure side to the low-pressure side. Corresponding surfaces are located on the opposite longitudinal side of the cap 640.

The first passage system 642 comprises a first opening 654, a passage 655, and a second opening 656. The first opening 654 is in communication with the first longitudinal region 641. The first opening 654 has an entrance passage 658 in communication with the passage 655. The passage 655 extends to an exit passage 660 that is in communication with the second opening 656. The second opening 656 is in communication with the second longitudinal region 643 (the other side of the cap) as indicated by the dashed lines in FIG. 44.

In a similar configuration as to the first passage system 642, the second passage system 644 comprises a third opening 662 having a second entrance passage 664 that is in communication with a passageway 666. Fluid is adapted to extend to the passageway 666 through the second exit passage 668 and exit through the fourth opening 670. The fourth opening 670 is in communication with the second longitudinal region 643 and the third opening 662 is in communication with the first longitudinal region 641.

Figure 45:
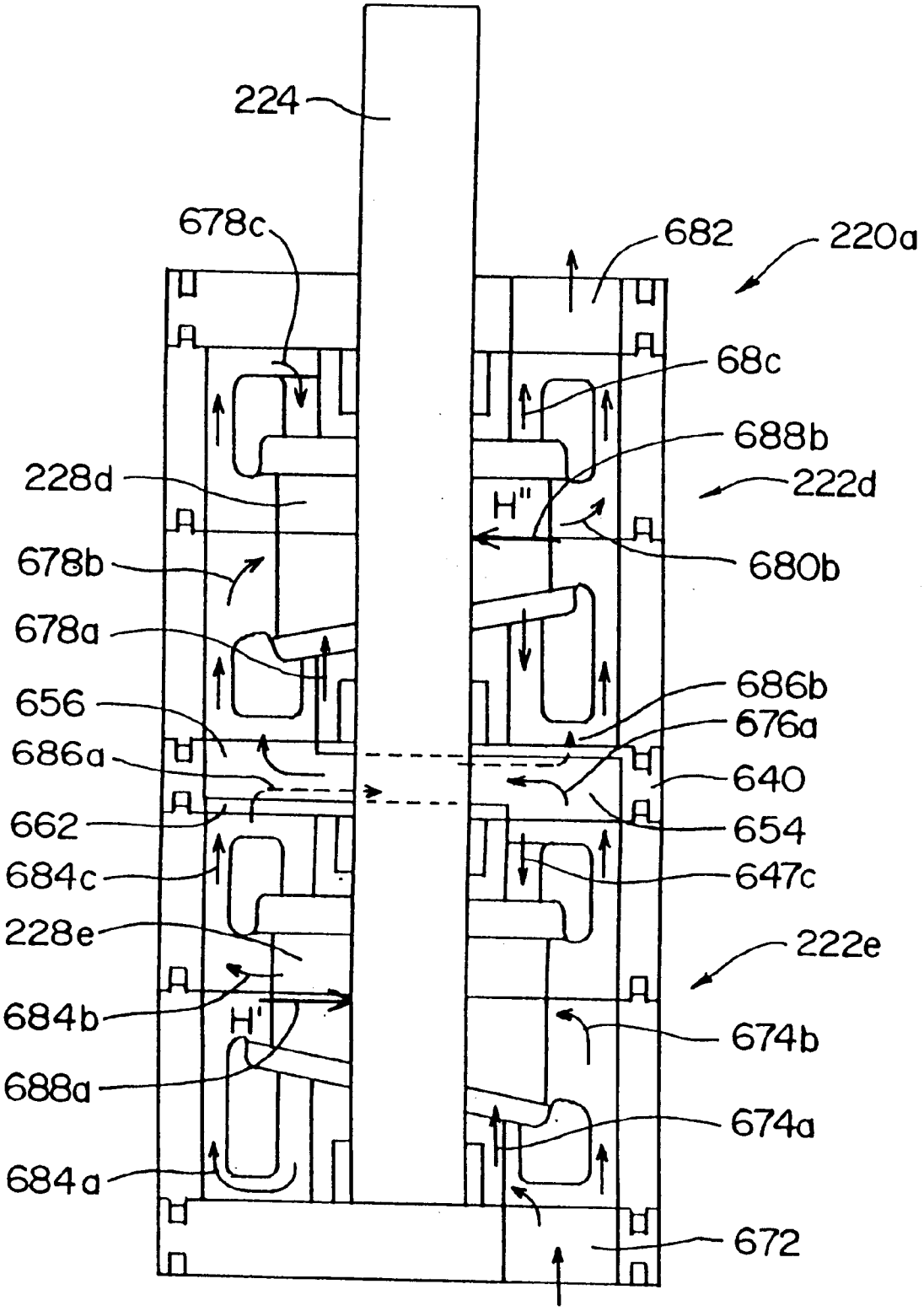
FIG. 45 shows an in-parallel flow arrangement utilizing the cap as shown in FIG. 44.

The cap 640 is symmetrical about the radially transverse extending line 646 and a manner so if the cap 640 was rotated one hundred eighty degrees about axis 646 it will, in the preferred form, look exactly the same as shown in FIG. 44. Any number of implementations for passageways 655 and 666 can be employed, the important aspect of the passageways 655 and 666 is a pressure differential is maintained between the high pressure side and the low-pressure side. As seen in FIG. 45, the assembly 220*a* the rotors configured a similar manner as the in-series flow as shown in FIG. 17, however the cap 640 is used to join the rotor sections 222*d* and 222*e* so the flow is actually and in-parallel flow arrangement. The fluid and enters into the entrance port 672 and can in general take two separate paths. First, the fluid can enter into the operating chambers of the rotor assembly 228*e* as indicated by arrows 674*a*, 674*b*, and 674*c*. Alternatively, the fluid can pass through the first opening 654 of the cap 640 as indicated by arrow 676*a*. Thereafter, the fluid would pass through the passageway 655 and exit through the second opening 656. Thereafter, the fluid enters into the operating chambers that are not shown but located at location 228*d* indicated by arrows 678*a*, 678*b*, and 678*c*. Finally, the fluid exits from the rotor assembly 228*d* as indicated by arrow 680 and exits the exit port 682.

The fluid exiting the rotor assembly 228*e* indicated by arrows 684*a*, 684*b*, and 684*c* enters into the third opening 662 as indicated by the dashed arrow 686*a* and passes through the passageway 666 (see FIG. 44) and exits through the fourth opening 670 as indicated by the dashed arrow 686*b* as shown in FIG. 45. Thereafter, this fluid is substantially similar in pressure to the fluid exiting the operating chambers of the rotor assembly 228*d* and mixes with this exiting fluid to exit through the exit port 682.

There will now be an analysis of the moments substantially about the radially transverse axis of the shaft 224. It should be reiterated that the FIG. 45 is not taken exactly along the radially transverse axis as for that view would not illustrate the radial flow into and out of the operating chambers as indicated by arrows 678*b* and 674*b*, and 684*b* and 680*b*.

As discussed above, in a pump configuration, the torque about the shaft 224 creates a high pressure side in the rotor section 222*e* indicated by H' and a high pressure side in the rotor section 222*d* indicated by H". Therefore, a resultant force 688*a* and 688*b* results on the shaft. In many implementations the offsetting forces 688 is desirable than having both of these forces aligned and distributing a transverse force on the shaft in the same direction. Therefore, an additional assembly similar to that of 220*a* has shown in FIG. 29*a* can be attached in an upper or lower portion along the shaft 224 to create an in-combination flow and each section 222 will have resultant forces 688 that offset one another and hence creates balance upon the shaft 224 in the transverse direction. Further, by having four sections 222 opposing one another any moment about the lateral direction of the shaft 222 is reduced.

Figure 46:
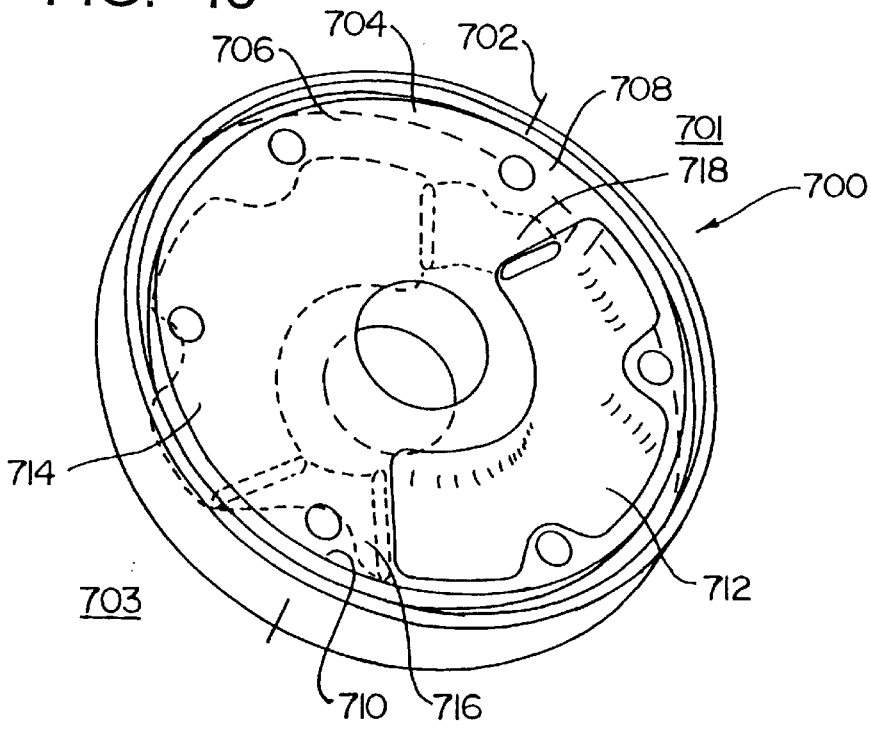
FIG. 46 shows a nether variation of a cap that can be used in an in-series combination flow or alternatively and in-parallel flow pursuant to the embodiment shown in FIG. 49.

FIG. 46 shows a cap 700 that is adapted to direct the flow from one lateral portion on a first axial side in to the opposite lateral portion on the opposite axial side. The cap 700 has a transverse axis 702 that separates the high pressure side from the low-pressure side of the cap 700. The cap further has a first axial or longitudinal portion 701 and a second axial or longitudinal portion 703. The cap further has a first surface 704 and a rearward surface 706 the first and second surfaces 704 and 706 have transverse portions 708 and 710 that are adapted to engage the first and second sections 230 and 232 to provide a seal between the high pressure side and the low-pressure side. The cap 700 comprises a first opening 712 and a second opening 714. The first opening 712 is in communication with the first axial portion 701 and communicates to the second opening 714 and through passages 716 and 718. In the preferred form, the cap 700 is symmetrical about the transverse axis 702 whereby rotating the cap about the said axes one hundred and eighty degrees would still appear exactly like the cap as shown in FIG. 46.

Figure 47:
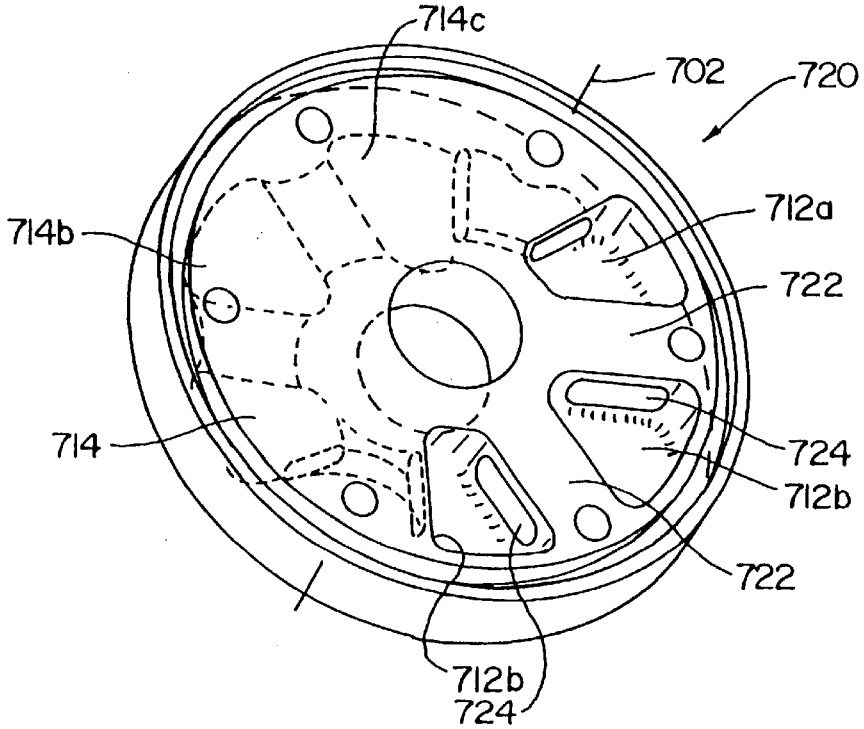
FIG. 47 shows a modified form to the cap as shown in FIG. 47 having radially extending ribs.

As shown in FIG. 47, a second version of the cap 700 is employed referred to as numeral 720. This version is substantially similar as the cap 700, however, radially extending ribs 722 are employed having tangential passageways 724. The openings 712*a*, and 712*b*, and 712*c* or similar to the openings 714*a*, 714*b*, and 714*c*.

The cap 640 can be used for an in serious flow arrangement where the lateral pressure upon the shaft would be more similar to an in-parallel flow using the modified cap 470. Alternatively, the cap 700 or 720 can be used in an in-parallel flow arrangement as shown in FIG. 49.

As seen in FIG. 48, the assembly 220*c* has a plurality of exit ports 730, 732, and 734. Now referring to FIG. 49, fluid enters into the entrance region 738 as indicated by arrow 736. Thereafter, the fluid enters into the operating chamber of the rotor assembly (not shown but indicated by numeral 228*g*) of the rotor section 222*g* by any one of the arrows 740. Thereafter, the fluid exits from the operating chambers on the high pressure side indicated by arrows 742 and exit through any one of the radial passageways 730, 732, or 734. Three radial passageways are shown for illustrative purposes where the passageway 730 remain solely on a section (the second section 232*g* in this example). Alternatively, the exit passage can coexist in a combination form between two sections as indicated by passage 732. Alternatively, the radial passage can exist in combination of recess portions between a section and a cap as indicated by radial passage 734.

The other approximate one half embodiment of flow of the fluid will pass through the opening 712 as indicated by arrow 744*a* and pass through the passageways 716 and 718 (see FIG. 46) and exit through the second opening 714 as indicated by arrow 744*b*. Thereafter, the fluid passes to the section 222*f* in a similar manner as described above.

It should be noted that radial ports can be employed in a similar manner for exit and entrance regions for any rotor section alone or in-combination with the entrance and exit ports of the caps 234, 470, 640, 700, and 720.

The inlet ports can be located in the radially outward portion of either the first section or the second section or a combination thereof. The benefit of having additional inlet and outlet ports is there is potentially less fluid resistance by having the additional paths of travel.

This is very beneficial in situations where the fluid is not available in an axial flow situation, but rather only available along a radial side portion of the casing portion 226. A combination of axial and radial flow inlet and outlet ports (vice versa) can be advantageous to give increase design flexibility in many situations and applications. It should be noted that the exit ports 730, 732, and 734 are at the substantially same pressure as the exit ports 731 and all of these high-pressure ports should be confined from the entering fluid indicated at 736.

It should further be noted that in all of the above embodiments, the cap diameter of the assembly 220 can be reduced if the radially outward ports for entering the operating chambers are removed.

Figure 50:
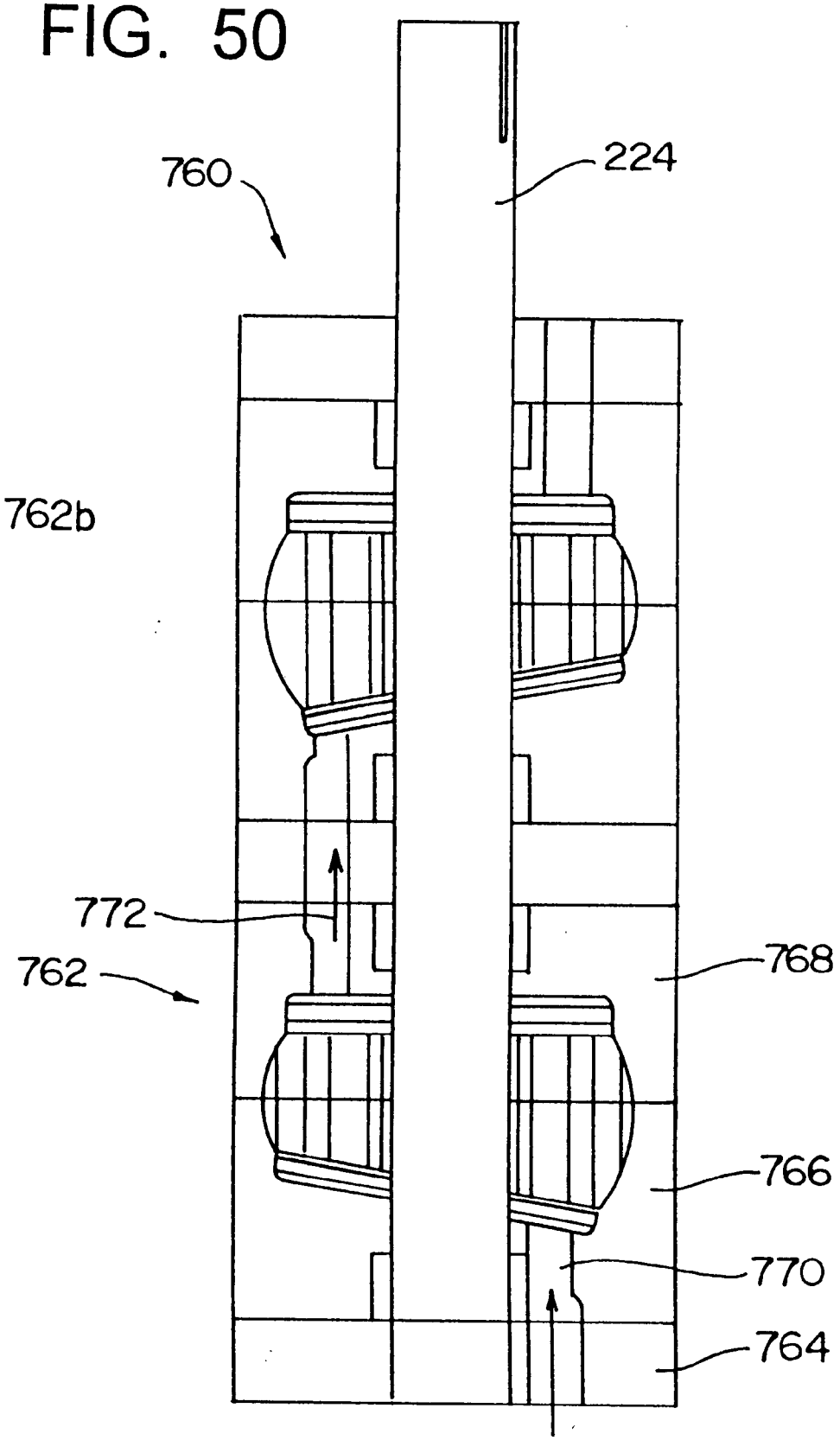
FIG. 50 shows another embodiment of the present invention that is purely axial flow having axial ports that enter into the operating chambers of the rotor assembly.

As shown FIG. 50, the assembly 760 comprises a first rotor section 762*a* and a second rotor section 762*b*. Rotor section 762 comprises a cap 764 a first section 766 and a second section 768 that are very similar to the sections and caps of the previous embodiments; however, the section 766 has only an axial conduit passage 770 that enters into the operating chambers through the conduits 362 of the slave rotor (not shown in FIG. 50). The fluid exits through the conduits 330 of the power rotor on the high pressure side and passes through the passageway 772 of the second section 768. Thereafter, the fluid passes to the rotor section 762*b*. As with the previous embodiments a fluid with a pressure differential can pass through the entrance and exit ports of the assembly 716 and rotational work can be extracted from the shaft 224 in a motor embodiment. Essentially, the embodiment as shown in FIG. 50 removes the radial entrance and exit portions for entering and exiting the operating chambers. Of course a number of in serious or in-parallel or in-combination arrangements of the rotor sections 762 can be employed.

Figure 51:
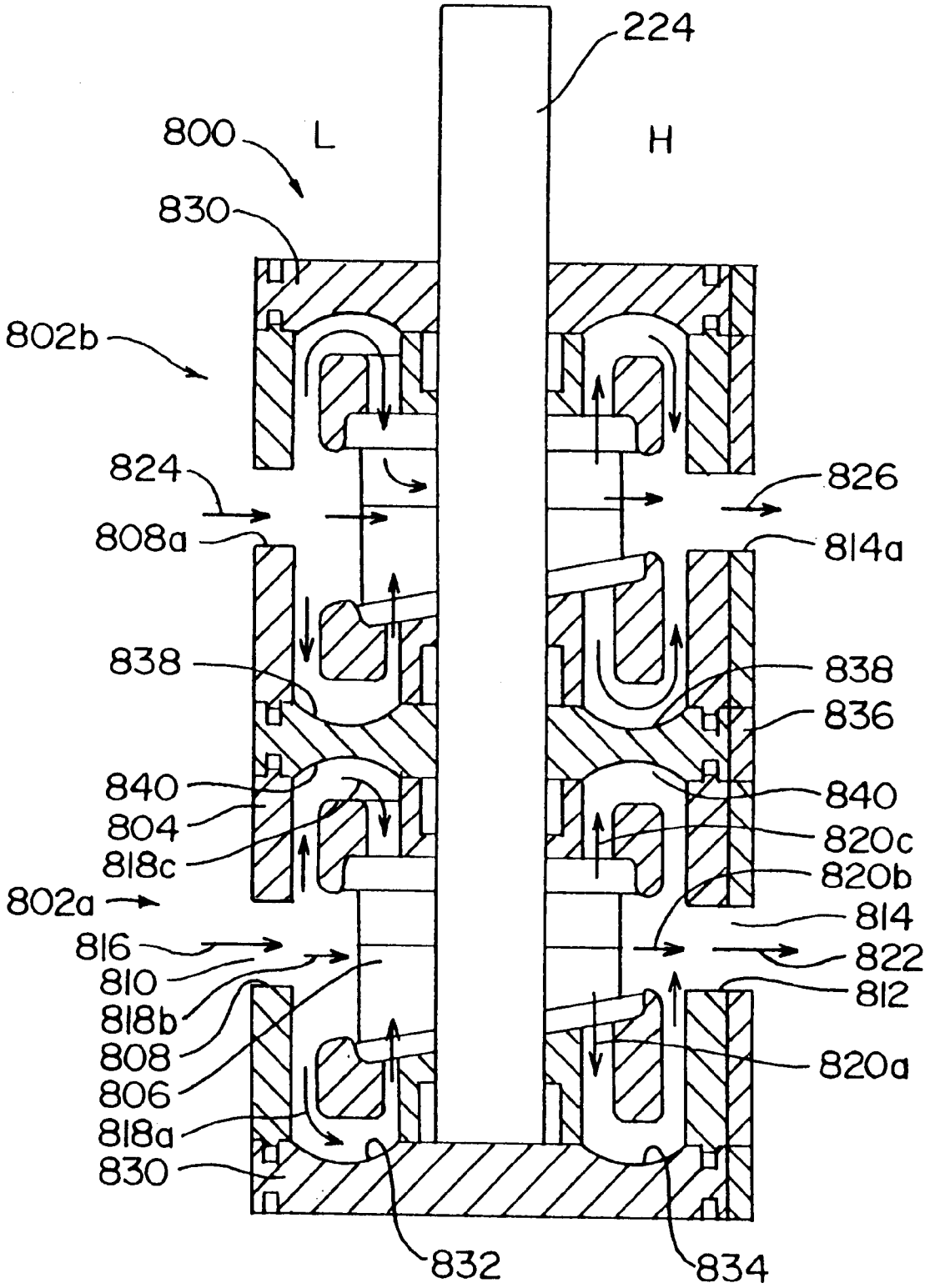
FIG. 51 discloses a radial flow entrance and exit embodiment where the rotor assemblies potentially have discrete fluids passing therethrough and are both rotated by a common shaft.
Figure 52:
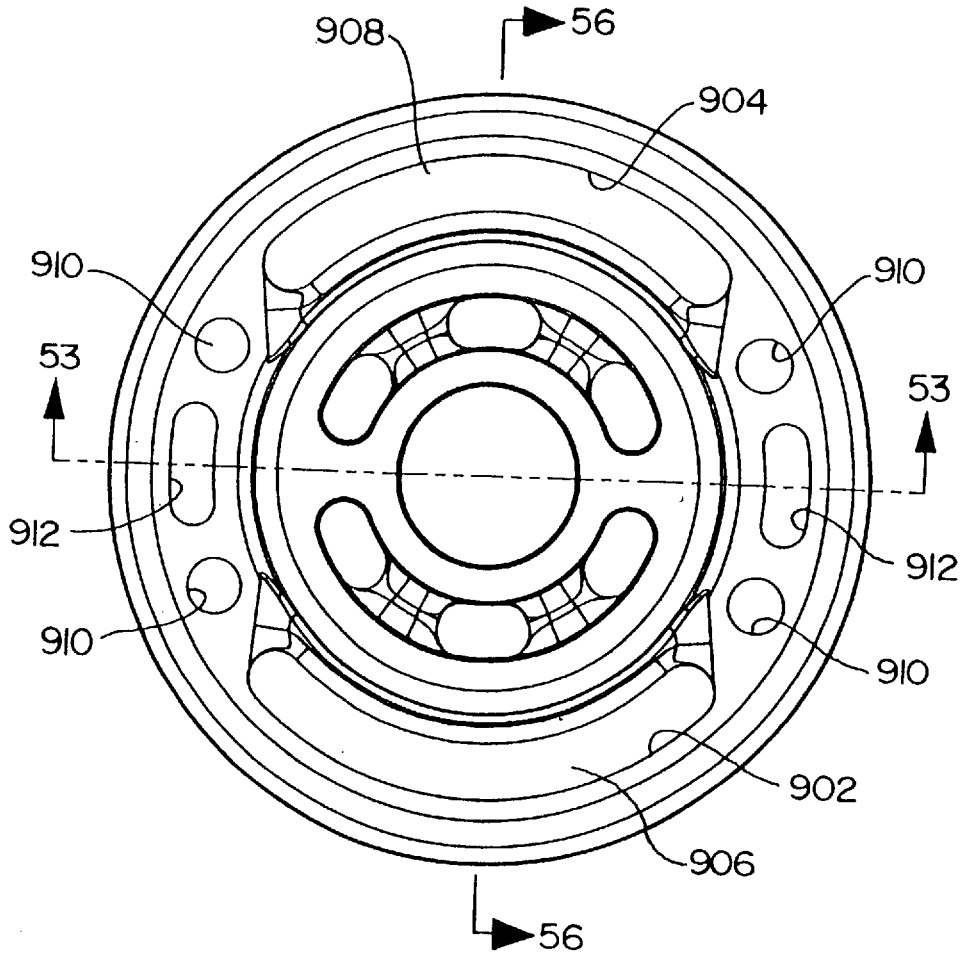
FIG. 52 is a top view of another version of a section that is a portion of the casing.
Figure 53:
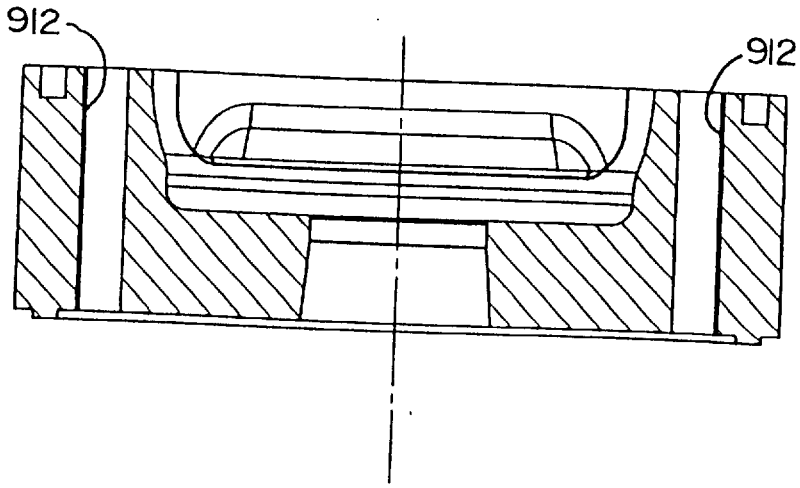
FIG. 53 is a cross-sectional view taken at line 53—53 of FIG. 52.
Figure 54:
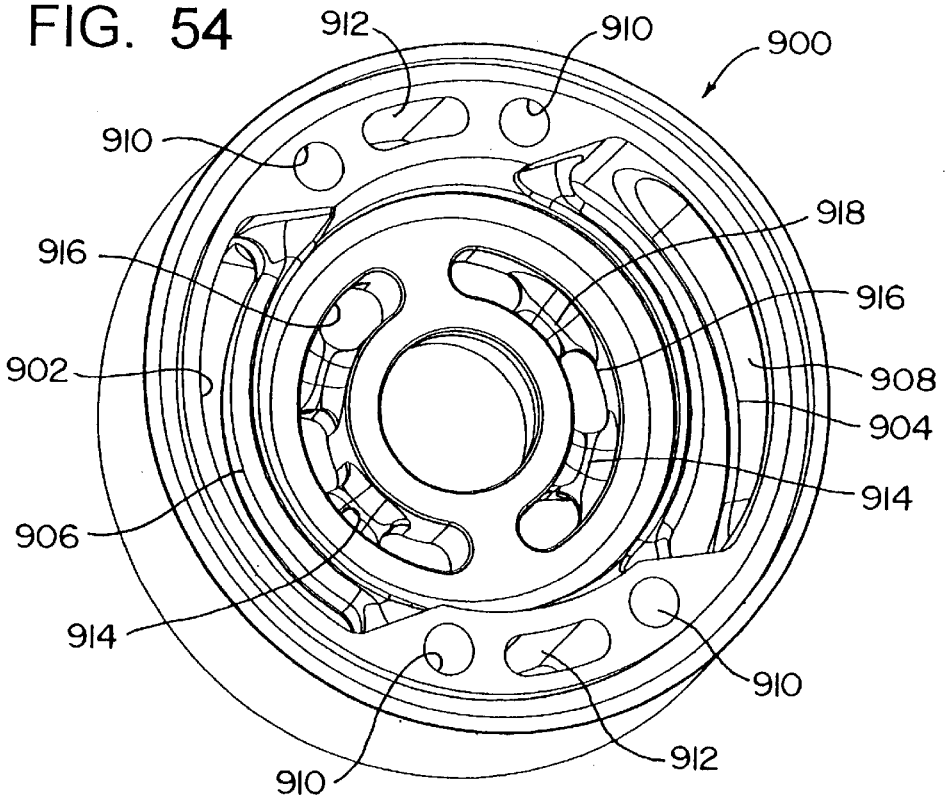
FIG. 54 is an isometric view of the inward portion of the casing section.

It should be noted that another key advantage of the embodiments disclosed in FIG. 16 and on is that a straight shaft 224 can be employed. As seen in FIG. 51 there is shown a radial flow embodiment with two rotor sections employed. Further, the caps 830 and 836 have recess portions to induce the flow in and out of the rotors.

The assembly 800 comprises rotor sections 802 where each rotor section comprises a casing 804 and a rotor assembly 806 (not shown) that is similar to the rotor assembly as described above. The casing 804 is similar to the casing described above with the exception there are radial entrance and exit ports located on the radially lateral portions of the casing a first surface 808 defines a first radial passageway 810. The passageway (as with many of the passageways) can have a threaded recess region adapted to screw into a fluid line. Further, the exit passageway 814 is defined by a surface 812 and is located on the high-pressure region. Therefore, fluid that radially enters as indicated by arrow 816 can then into the operating chambers by either 818*a*, 818*b*, and 818*c*. It should be noted that the casing 804 and rotor assembly 806 can be constructed for any combination of entrance into the operating chambers using any combination of the paths 818 (of course this applies as well for the exit passage and the other embodiments). Thereafter, the fluid passes through the top dead center portion of the assembly 800 and exits on the high pressure side. The fluid can exit the operating chambers by either passage 820*a*, 820*b*, or 820*c*. Thereafter, the fluid exits through the exit passageway 814 as indicated by arrow 822. A similar analysis can be conducted for fluid enters into the rotor section 802*b* indicated by arrow 824 and exits out of the rotor section 802*b* indicated at 826.

Therefore, it can be appreciated that the shaft 224 in FIG. 51 is operating two separate rotor assemblies. The fluid lines entering the ports 808 and 808*a* can be separate lines that are not in communication. This is advantageous if it is desired to not have the fluids mixed together but a common shaft is desired to increase the pressure of these respective fluids. Likewise, the exit ports 814 and 814*a* need not communicate with one another and can pass to separate lines or be mixed together if desired.

FIG. 51 illustrates the clear benefits of having a single shaft pass through the various rotor assemblies.

A further modification in the assembly shown in FIG. 51 is the end caps have recess regions to improve the flow of fluid in and out of the operating chambers. The top and bottom end caps 830 have semi annular recess regions 832 and 834. These regions to not extend beyond the transverse axis in order to create a seal between the high-pressure side and the low-pressure side. Alternatively, the internal sections of the casing 802 extend longitudinally into the recess region of the cap to prevent leakage from the high-pressure side to the low-pressure side. The cap 836 has opposing semi annular recessed regions 838 and 840 on opposing longitudinal sides of the cap 836. This allows greater fluid flow for both rotor sections 802*a* and 802*b*.

There will now be a discussion of a high flow section apparatus with reference to FIGS. 52–56. In general, the section 900 has a substantial open region to allow greater fluid flow to enter the chambers of the rotor assembly (see FIG. 12 ). The substantial difference of the section 900 is there is a single axial surface 902 and 904 defining axial conduits 906 and 908. The large radial cross-sectional area for the conduit 906 allows low resistance fluid flow to pass therethrough. The section 900 further comprises the conduits 910 that are adapted to allow bolts or connecting devices to pass therethrough. Further, the conduits 912 can be used to pass electrical wires or other material therethrough. As with the previous embodiments the surfaces 914 define axially extending conduits 916. The radially extending ribs 918 provided additional support for the radially outward portion of the section 900. A similar embodiment can be employed for the power rotor.

Figure 55:
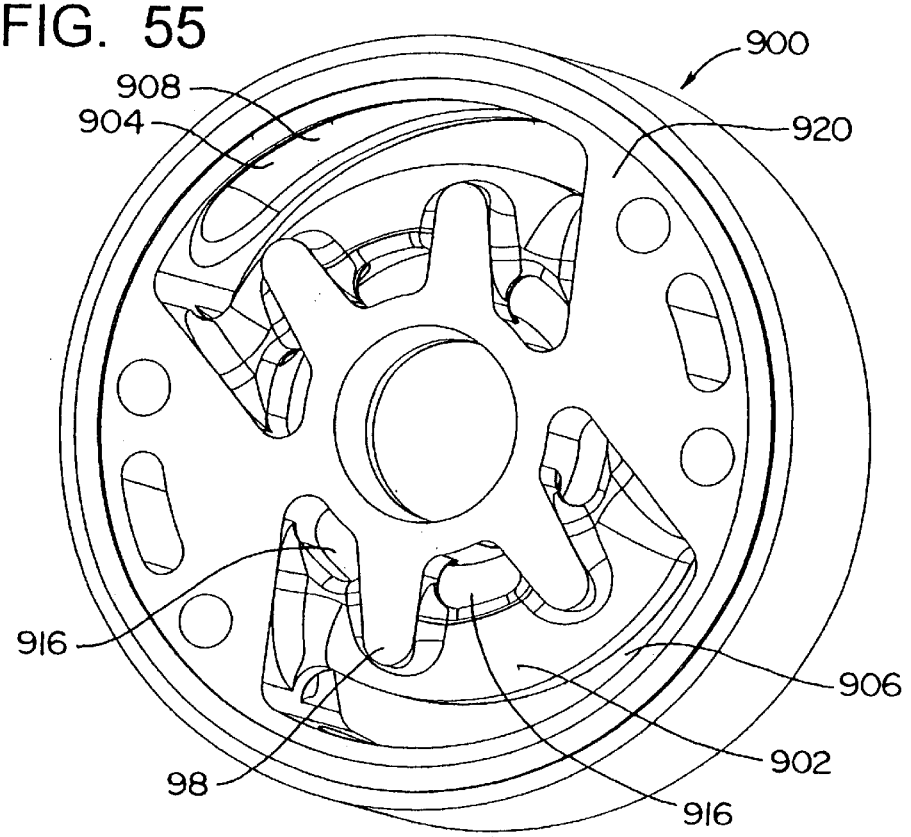
FIG. 55 is a rearview of the casing section as shown in FIG. 54.
Figure 56:
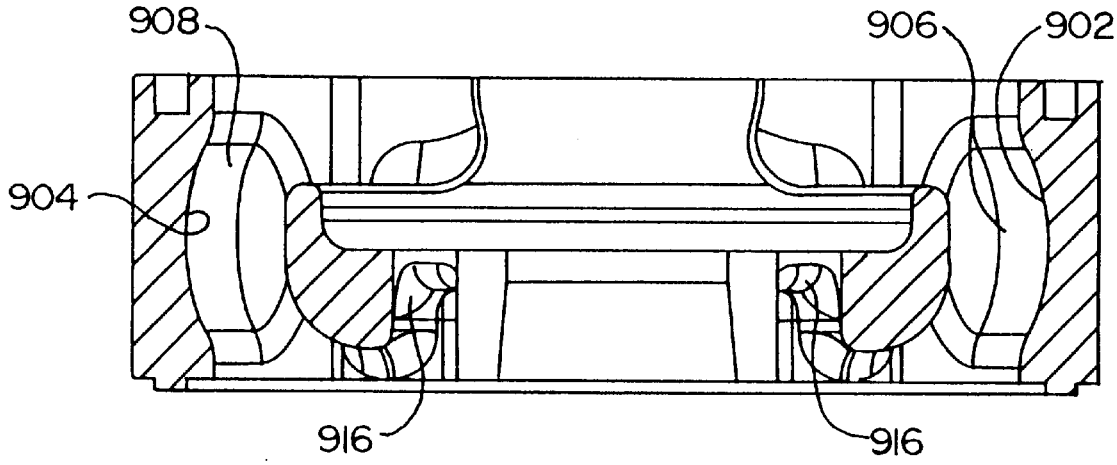
FIG. 56 is a cross-sectional view taken at line 56—56 of FIG. 52.

FIG. 55 shows a rearview of the section 900 where the base surface 920 is adapted to be supported upon a cap. FIG. 56 is a cross-sectional view where the surfaces 904 extend radially outwardly in the longitudinal central portion to provide a more desirable fluid flow therethrough.

It should be noted that many of the various corner portions through out the various embodiments have tapered corners to allow more desirable fluid flow therearound.

While the invention is susceptible of various modifications and alternative forms, specific embodiments thereof have been shown by way of example in the drawings and will herein be described in detail. It s should be understood, however, that it is not intended to limit the invention to the particular forms disclosed, but, on the contrary, the intention is to cover all modifications, equivalents and alternatives falling within the spirit and scope of the invention as expressed in the appended claims.

Therefor I claim:

1. A machine that converts energy comprising:

a housing having an inner surface;

a first rotor mounted for rotation in the housing about a first axis, a first outer surface defining at least part of a sphere having a common center with the first inner surface and adapted to intimately engage the inner surface of the housing;

a second rotor having a forward portion and a rearward portion, mounted for rotation on the housing about a second axis offset from the first axis and being collinear by an angle $\alpha$ and intersecting at the common centers of the rotors, the second rotor including a second inner surface defining at least part of a sphere having a common center with the center of the first rotor, a second outer surface defining at least part of a sphere and having a common center with the second inner surface and adapted to engage the inner surface of the housing;

the said first rotor further having a first contact face that is defined by the locus formed by points on the second rotor as the second rotor rotates about the second axis, and a first contact surface is positioned in the forward region of the first rotor;

the second rotor further having a second contact face that is defined by the locus formed by points on the first rotor as the first rotor rotates about the first axis, the second rotor further having a rearward surface that is positioned in the rearward portion of the second rotor;

the points of each rotor that define the locus line along and outer edges of a common central axis is essentially a radius extending outward from the common centers of the rotor at an angle $\alpha/2$ from a normal to the axis of the other rotor;

whereas the first contact surface of the first rotor does not come into contact with the rearward surface of the second rotor allowing fluid to pass thereinbetween to cause the second rotor to be substantially hydraulically balanced about the second axis during the complete revolution of the second rotor.

2. The apparatus as recited in claim 1 further comprising:

whereas the machine to convert energy is a pump that is adapted to increase the pressure of a fluid, and the housing has a first lateral radial portion and a second has an input port located on and an output port.

3. A pump to transport a fluid comprising:

a housing having an inner surface;

a first rotor mounted for rotation in the housing about a first axis, a first outer surface defining at least part of a sphere and adapted to intimately engage the inner surface of the housing;

a second rotor having a forward portion and a rearward portion, mounted for rotation in the housing about a second axis offset from being collinear with the first axis by an angle $\alpha$ and intersecting at the common centers of the rotors, the second rotor including a second inner surface defining at least part of a sphere having a common center with the center of the first rotor, a second outer surface defining at least part of a sphere and having a common center with the second inner surface and adapted to engage the inner surface of the housing;

the said first rotor further having a first contact face that is defined by a locus formed by points on the second rotor as the second rotor rotates about the second axis, and the first rotor further has a first contact surface which is positioned in the forward region of the first rotor;

the second rotor further having a second contact face that is defined by a locus formed by points on the first rotor as the first rotor rotates about the first axis, the second rotor further has a rearward surface that is positioned in the rearward portion of the second rotor;

the points of each rotor that define the locus along an outer edge of a common central axis is essentially a radius extending outward from the common centers of the rotor at an angle $\alpha/2$ from a normal to the axis of the other rotor;

whereas the first contact surface of the first rotor does not come into contact with the rearward surface of the second rotor allowing fluid to pass thereinbetween to cause the second rotor to be substantially hydraulically balanced about the second axis during the complete revolution of the second rotor.

4. The pump as recited in claim 3 further comprising:

where the first rotor has a center surface defining at least part of a sphere and is adapted to engage the second inner surface of the second rotor.

5. The pump as recited in claim 4 where the center surface of the first rotor is convex[MFH24].

6. The pump as recited in claim 3 further comprising:

where the first and second rotors have inward surfaces adapted to allow a shaft to pass therethrough.

7. The pump apparatus as recited in claim 6 further comprising:

where the inner surface of the first rotor engages the shaft in a manner to rotate in conjunction therewith.

8. The pump as recited in claim 7 further comprising:

the second rotor is substantially balanced about the second axis with respects to the rotational position of the second rotor.

9. A pump assembly adapted to increase the pressure of a fluid where the pump assembly comprises:

a central shaft having a longitudinal central axis and is adapted to rotate about said central axis, said central shaft further having a cylindrical outer surface;

a rotor assembly comprising;

a power rotor adapted to rotate about a longitudinal power axis the power rotor comprising, a first outer surface defining at least part of a sphere having a common center with the first inner surface and adapted to intimately engages the inner surface of the housing, the power rotor having an inward region and an outward region and comprising a plurality of lobes and further comprising an outward contact surface and longitudinally extending surfaces defining conduits allowing communication between the inward region and the outward region, a first contact surface that is positioned in the forward region of the first rotor;

a slave rotor adapted to rotate about a longitudinal slave axis and having an inward region and an outward region;

a base housing having a central portion and a peripheral portion, the base housing further having a master region and a slave region the base housing comprising;

a central surface located in the central portion and is adapted to be in close engagement of the cylindrical surface of the central shaft;

a first surface adapted to engage the outward surface of the said power rotor, a first longitudinally extending surface defining a first passageway allowing communication to the power conduits of the power rotor, a second surface located in the slave region of the base housing and is adapted to engage the outward surface of the slave rotor and support the slave rotor about the longitudinal slave axis at an angle $\alpha$ with respects to the longitudinal power axis, whereas the said first rotor further having a first contact face that is defined by the locus formed by points on the second rotor as the second rotor rotates about the second axis, the second rotor further having a first contact face that is defined by the locus formed by points on the first rotor as the first rotor rotates about the first axis, and the central surface of the power rotor is connected to the central shaft and the inward regions of the slave rotor and the power rotor are adapted to engage one another and rotate where the lobes of the slave rotor and the power rotor define operating chambers that change in volume with respects to rotation of the central shaft and fluid is displaced through the conduits of the power rotor and through the first passageway whereby reducing the axial thrust load upon the power rotor.

10. A device to convert energy comprising:

a first rotor adapted to rotate about a first axis where the first rotor having a plurality of lobes each lobe having a leading and trailing engagement surface, an engagement tip surface and a forward surface, a second rotor adapted to rotate about a second axis where the second rotor having a plurality of lobes each lobe having a leading and trailing engagement surface, an engagement tip surface and a forward surface the first and second axes are offset from being collinear by an angle $\alpha$ and the lobes of the lobes of the first and second rotors are adapted to intermesh between one another where a second rotor lobe bottom dead center position is defined as the orientation where a second rotor lobe is fully inserted between two adjacent leading and trailing first rotor lobes a casing having an inner surface adapted to house the first and second rotors and having an inlet port and an outlet port, whereas the leading and trailing engagement surfaces of the first and second rotors are each defined by points about an axis that is equidistant between the first and second axes at an equidistant angle where the engagement surface to be defined is defined by mutually rotating the engagement surface to be defined about its axis of rotation and as the said axis about the opposing axis at the equidistant angle from the opposing axis where points about the said axis define the engagement surface, and when the rotors are orientated in the second rotor lobe bottom dead center position a first sub chamber is partially defined by the trailing engagement surface of the leading lobe of the first rotor and the leading engagement surface of the second rotor lobe at the second rotor lobe bottom dead center position and a second sub chamber is partially defined by the leading engagement surface of the trailing lobe of the first rotor and the trailing engagement surface of the second rotor lobe at the second rotor lobe bottom dead center position where the first and second sub chambers are in communication with one another allowing a the pressure forces acting upon the trailing engagement surface of the leading lobe of the first rotor is substantially equal to the leading engagement surface of the trailing rotor whereby substantially rotationally balancing the second rotor about the second axis during the complete revolution of the second rotor.

11. A device to convert the energy of a fluid that is non-compressible, the device comprising:

a rotor assembly comprising:

a first rotor having a center point and a first axis of rotation extending through the first rotor's center point and a plurality of lobes each lobe having a forward engagement surface and a trailing engagement surface, the first rotor further having an outer surface that partially defines a sphere, a second rotor having a center point and a second axis of rotation that extends through the second rotor's center point and is offset from being collinear from the first rotor by an angle $\alpha$, where as the second rotor further comprising a plurality of lobes each lobe having a rotationally forward engagement surface and a rotationally trailing engagement surface where the lobes of the first and second rotor are adapted to be intermeshed to define operating chambers and the center point of the second rotor coincides in location to the center of the first rotor, the second rotor further having an outer surface that partially defines a sphere, whereby the rotor assembly has first and second lateral regions and a top dead center region and a bottom dead center region and the engagement surfaces of the lobes of the first and second rotor are defined by points on the outer portion of a locus on the opposing rotor as the first and second rotors mutually rotate where the points on the outer portion of the locus are about a central axis that is fixed angle from the opposing rotor at the fixed angle is an equidistant angle between the first and second axis, and when a power lobe is at the bottom dead center portion of rotation a forward and trailing sub chambers on each rotational side of the power lobe are defined, a casing having an inner surface that partially forms a sphere and is adapted to house the rotor assembly, the casing comprising inlet port that is in communication with the first lateral region and an outlet ports that is in communication with the second lateral regions of the rotor assembly, the inner surface of the casing engaging the outer surfaces of the first and second rotor whereby creating a seal between the inlet and outlet ports whereby the first and second subchambers are in communication allowing the pressure in the first and second subchambers to be substantially equal whereby creating rotational hydraulic balance upon the second rotor during the complete revolution of the second rotor.

12. The device as recited in claim 11 where the operating chambers of the first lateral region of the rotor assembly increase in volume and the operating chambers second lateral region decrease in volume with respects to rotation of the rotor assembly in a first rotational direction whereby the second lateral region that is in communication with the outlet port is at a higher pressure than the first lateral region.

13. The device as recited in claim 12 where the first rotor is adapted to have a torque applied thereto in the said first rotational direction to increase the pressure of the said fluid.

14. The device as recited in claim 12 where the first rotor further comprises a forward and a rearward portion whereby a surface defining a passageway allow communication to the operating chambers of the rotor assembly and to the rearward portion of the first rotor.

15. The device as recited in claim 14 where the casing defines axially extending conduits whereby fluid is adapted to pass through axially extending conduits and the passageway of the first rotor to enter in the operating chambers of positioned in the first lateral region.

16. The device as recited in claim 12 where the second rotor further comprises a forward and a rearward portion whereby a surface defining a passageway allow communication to the operating chambers of the rotor assembly and to the rearward portion of the first rotor.

17. The device as recited in claim 16 where the casing defines axially extending conduits whereby fluid is adapted to pass through axially extending conduits and the passageway of the second rotor to enter in the operating chambers of positioned in the first lateral region.

18. The device as recited in claim 16 where a transverse axis is defined as extending between the top dead center and bottom dead center regions where the rearward region of the second rotor has a conical backface having first and second lateral regions that correspond in location to the first and second regions of the rotor assembly and the high pressure fluid is adapted to apply pressure upon the first lateral conical backface in the first region whereby causing a torquing moment about the transverse axis.

19. The device as recited in claim 18 where the second rotor is substantially balanced about the transverse axis.

20. The device as recited in claim 11 where the first rotor has a center region and a central surface is located in the center region and partially defines a sphere and the second rotor has a central region that has an inner surface that partially defines a sphere and is adapted to receive the central surface of the first rotor.

21. The device as recited in claim 20 where the central region of the first rotor comprises a shaft extending therethrough where the shaft is rotationally fixed to the first rotor and the central region of the second rotor comprises a surface that defines a partially cylindrical region and the shaft extends therethrough.

22. The device as recited in claim 21 further comprising:

a second rotor assembly comprising:

a first rotor having a center point and a first axis of rotation extending through the first rotor's center point and a plurality of lobes each lobe having a forward engagement surface and a trailing engagement surface, the first rotor further having an outer surface that partially defines a sphere, a second rotor having a center point and a second axis of rotation that extends through the second rotor's center point and is offset from being collinear from the first rotor by an angle $\alpha$, where as the second rotor further comprising a plurality of lobes each lobe having a rotationally forward engagement surface and a rotationally trailing engagement surface where the lobes of the first and second rotor are adapted to be intermeshed to define operating chambers and the center point of the second rotor coincides in location to the center of the first rotor, the second rotor further having an outer surface that partially defines a sphere, whereby the rotor assembly has first and second lateral regions and a top dead center region and a bottom dead center region and the engagement surfaces of the lobes of the first and second rotor are defined by points on the outer portion of a locus on the opposing rotor as the first and second rotors mutually rotate where the points on the outer portion of the locus are about a central axis that is fixed angle from the opposing rotor at the fixed angle is an equidistant angle between the first and second axis, and when a power lobe is at the bottom dead center portion of rotation a forward and trailing sub chambers on each rotational side of the power lobe are defined.

* * * * *